US009873012B2

(12) United States Patent
Huppée et al.

(10) Patent No.: US 9,873,012 B2
(45) Date of Patent: Jan. 23, 2018

(54) EXERCISE MACHINE HAVING ELASTIC EXERCISE RESISTANCE CABLES

(71) Applicant: Liberty Active Body & Mind Inc., Vancouver (CA)

(72) Inventors: Roman Huppée, Sainte-Julie (CA); Robert F. Huppée, Vancouver (CA)

(73) Assignee: Liberty Active Body & Mind Inc., Vancouver (CA)

( * ) Notice: Subject to any disclaimer, the term of this patent is extended or adjusted under 35 U.S.C. 154(b) by 214 days.

(21) Appl. No.: 14/570,899

(22) Filed: Dec. 15, 2014

(65) Prior Publication Data

US 2015/0165259 A1 Jun. 18, 2015

(51) Int. Cl.
*A63B 21/02* (2006.01)
*A63B 21/06* (2006.01)
(Continued)

(52) U.S. Cl.
CPC .... *A63B 21/0618* (2013.01); *A63B 21/00065* (2013.01); *A63B 21/0442* (2013.01); *A63B 21/0552* (2013.01); *A63B 21/0557* (2013.01); *A63B 21/4029* (2015.10); *A63B 21/4031* (2015.10); *A63B 21/4034* (2015.10); *A63B 21/4035* (2015.10); *A63B 21/4043* (2015.10); *A63B 23/0417* (2013.01);
(Continued)

(58) Field of Classification Search
CPC ..... A63B 21/154
See application file for complete search history.

(56) References Cited

U.S. PATENT DOCUMENTS 195,116 A * 9/1877 Foster ..... A63B 21/068 482/95
382,440 A * 5/1888 Sanchez ..... A63B 21/0628 16/216
(Continued)

FOREIGN PATENT DOCUMENTS

EP 1125599 8/2001
GB 2257921 1/1993
(Continued)

OTHER PUBLICATIONS

"The ChairMaster" http://web.archive.org/web/20131103184849/http://www.chairmaster.com/ Date: Nov. 3, 2013.
(Continued)

*Primary Examiner* — Loan H Thanh
*Assistant Examiner* — Rae Fischer
(74) *Attorney, Agent, or Firm* — Cameron IP

(57) ABSTRACT

There is provided an exercise machine. The machine includes an upright mounting assembly having a top and a bottom spaced-apart from the top. The machine includes a seat operatively connected to the mounting assembly. The machine includes a first pair of space-apart pulley assemblies rotatably mounted adjacent to the top of the mounting assembly. The machine includes a second pair of spaced-apart pulley assemblies rotatably mounted adjacent to the bottom of the mounting assembly. The machine includes a plurality of exercise resistance cables connected at proximal end portions to the mounting assembly and extending around and outward from the pulley assemblies.

15 Claims, 54 Drawing Sheets

(51) Int. Cl.

| | |
|---|---|
| ***A63B 21/04*** | (2006.01) |
| ***A63B 21/055*** | (2006.01) |
| ***A63B 23/04*** | (2006.01) |
| ***A63B 23/12*** | (2006.01) |
| ***A63B 21/00*** | (2006.01) |
| *A63B 23/035* | (2006.01) |
| *A63B 23/02* | (2006.01) |
| *A63B 23/10* | (2006.01) |
| *A63B 23/14* | (2006.01) |

(52) U.S. Cl.

CPC ..... *A63B 23/1254* (2013.01); *A63B 23/1263* (2013.01); *A63B 23/1272* (2013.01); *A63B 23/0205* (2013.01); *A63B 23/0233* (2013.01); *A63B 23/03525* (2013.01); *A63B 23/03541* (2013.01); *A63B 23/03558* (2013.01); *A63B 23/0458* (2013.01); *A63B 23/10* (2013.01); *A63B 23/14* (2013.01); *A63B 2023/0411* (2013.01); *A63B 2225/09* (2013.01); *A63B 2225/10* (2013.01); *A63B 2225/105* (2013.01); *A63B 2225/107* (2013.01)

(56) References Cited

U.S. PATENT DOCUMENTS

| | | | | |
|---|---|---|---|---|
| 679,784 | A | 8/1901 | Ryan | |
| 704,840 | A | 7/1902 | Korth et al. | |
| 1,610,324 | A | 12/1926 | Roche et al. | |
| 2,720,396 | A | 10/1955 | Pfaus | |
| 2,930,614 | A | 3/1960 | McIntosh | |
| 3,589,715 | A | 6/1971 | Mark et al. | |
| 3,633,907 | A | 1/1972 | Cane et al. | |
| 3,749,400 | A | 7/1973 | Stoffel | |
| 3,917,262 | A | 11/1975 | Salkeld | |
| 4,093,211 | A | 6/1978 | Hughes et al. | |
| 4,248,420 | A | 2/1981 | Hayes | |
| 4,423,865 | A | 1/1984 | Mahnke | |
| 4,625,962 | A | 12/1986 | Street | |
| 4,645,204 | A | 2/1987 | Berger | |
| 4,706,953 | A | 11/1987 | Graham | |
| 4,709,918 | A | 12/1987 | Grinblat | |
| 4,733,858 | A | 3/1988 | Lan | |
| 4,913,423 | A | 4/1990 | Farran et al. | |
| 4,921,247 | A | 5/1990 | Sterling | |
| 4,974,832 | A | 12/1990 | Dalebout | |
| 5,029,850 | A | 7/1991 | van Straaten | |
| 5,042,797 | A | 8/1991 | Graham | |
| 5,066,005 | A | 11/1991 | Luecke | |
| 5,131,895 | A | 7/1992 | Rogers, Jr. | |
| 5,171,295 | A | 12/1992 | Schwalm, Jr. | |
| 5,217,422 | A | 6/1993 | Domzalski | |
| 5,221,240 | A | 6/1993 | Mann et al. | |
| 5,224,909 | A | 7/1993 | Hamilton | |
| 5,234,394 | A | 8/1993 | Wilkinson | |
| 5,261,864 | A | 11/1993 | Fitzpatrick | |
| 5,277,683 | A | 1/1994 | Wilkins | |
| 5,279,530 | A | 1/1994 | Hess | |
| 5,295,935 | A | 3/1994 | Wang | |
| 5,429,567 | A | 7/1995 | Gerschefske et al. | |
| 5,468,205 | A * | 11/1995 | McFall ..... | A63B 21/169 482/121 |
| 5,496,247 | A | 3/1996 | Anderson | |
| 5,499,958 | A | 3/1996 | Hess | |
| 5,538,011 | A | 7/1996 | Craft et al. | |
| 5,586,962 | A | 12/1996 | Hallmark | |
| 5,637,066 | A | 6/1997 | Chang | |
| 5,718,659 | A | 2/1998 | Van Straaten | |
| 5,807,219 | A | 9/1998 | Webber et al. | |
| 5,885,196 | A | 3/1999 | Gvoich | |
| 5,899,836 | A | 5/1999 | Chen | |
| 5,911,535 | A | 6/1999 | Gvoich | |
| 5,934,751 | A | 8/1999 | Johnson et al. | |
| 5,997,448 | A | 12/1999 | Duba | |
| 6,013,014 | A | 1/2000 | Hern | |
| 6,015,371 | A | 1/2000 | Davitt | |
| 6,042,523 | A | 3/2000 | Graham | |
| 6,045,487 | A | 4/2000 | Miller | |
| 6,110,082 | A | 8/2000 | Tsai | |
| 6,117,056 | A | 9/2000 | Cataldi, Jr. et al. | |
| 6,159,133 | A | 12/2000 | Shugg | |
| 6,220,992 | B1 | 4/2001 | Shafik | |
| 6,238,322 | B1 | 5/2001 | Hsu | |
| 6,319,179 | B1 | 11/2001 | Hinds | |
| 6,338,701 | B1 | 1/2002 | Webber | |
| 6,338,704 | B1 | 1/2002 | Endelman | |
| 6,483,026 | B1 | 11/2002 | Snider, Jr. et al. | |
| 6,500,104 | B1 | 12/2002 | Rich | |
| 6,641,509 | B1 | 11/2003 | Chen | |
| 6,676,576 | B1 | 1/2004 | Wu | |
| 6,705,976 | B1 | 3/2004 | Piane, Jr. | |
| 6,733,427 | B1 | 5/2004 | He | |
| 6,805,409 | B2 | 10/2004 | Parker | |
| 6,808,476 | B2 | 10/2004 | Zagone | |
| 6,910,994 | B2 | 6/2005 | Mitchell et al. | |
| 6,929,589 | B1 | 8/2005 | Bruggemann et al. | |
| 6,988,978 | B1 | 1/2006 | Nault et al. | |
| 7,025,710 | B2 | 4/2006 | Corbalis et al. | |
| 7,137,936 | B1 | 11/2006 | Shaw et al. | |
| 7,223,218 | B2 | 5/2007 | Karafa | |
| 7,316,634 | B2 | 1/2008 | Webber | |
| 7,377,886 | B2 | 5/2008 | Wu | |
| 7,465,258 | B1 | 12/2008 | Mortorano | |
| 7,481,751 | B1 | 1/2009 | Arnold | |
| 7,621,852 | B2 | 11/2009 | Bowser | |
| 7,635,323 | B2 | 12/2009 | Halbridge | |
| 7,651,450 | B2 | 1/2010 | Wehrell | |
| 7,708,670 | B2 | 5/2010 | Bowser | |
| 7,762,935 | B2 | 7/2010 | Doble et al. | |
| 7,775,949 | B2 | 8/2010 | Bowser | |
| D623,244 | S | 9/2010 | Hoffman | |
| 7,803,095 | B1 | 9/2010 | LaGree | |
| 7,815,552 | B2 | 10/2010 | Dibble et al. | |
| 7,850,578 | B2 | 12/2010 | Balaker et al. | |
| 7,918,507 | B2 | 4/2011 | Schmale | |
| 7,931,570 | B2 | 4/2011 | Hoffman | |
| 7,988,601 | B2 | 8/2011 | Bowser | |
| 8,162,809 | B1 | 4/2012 | Eastwood | |
| 8,216,114 | B1 | 7/2012 | Wynn, III | |
| 8,241,190 | B2 | 8/2012 | Van Straaten | |
| 8,387,217 | B1 | 3/2013 | Hinds et al. | |
| 8,485,950 | B2 | 7/2013 | Adams | |
| 8,500,609 | B1 | 8/2013 | Williams | |
| 8,500,611 | B2 | 8/2013 | Hoffman | |
| 2001/0001777 | A1 | 5/2001 | Webber et al. | |
| 2001/0046928 | A1 | 11/2001 | Nette | |
| 2003/0195095 | A1 | 10/2003 | Endelman et al. | |
| 2003/0207741 | A1 | 11/2003 | Yu | |
| 2005/0009673 | A1 | 1/2005 | Harris | |
| 2005/0075223 | A1 | 4/2005 | Wu | |
| 2005/0187082 | A1 | 8/2005 | Bowser | |
| 2007/0123402 | A1 | 5/2007 | Cantrell | |
| 2008/0039301 | A1 | 2/2008 | Halbridge | |
| 2008/0070763 | A1 | 3/2008 | Greene | |
| 2008/0220953 | A1 | 9/2008 | Bowser | |
| 2008/0287271 | A1 | 11/2008 | Jones | |
| 2009/0170672 | A1 | 7/2009 | McMullen | |
| 2009/0305827 | A1 | 12/2009 | Webb et al. | |
| 2010/0151999 | A1 | 6/2010 | Kuo | |
| 2010/0173759 | A1 | 7/2010 | Lalaoua | |
| 2010/0216612 | A1 | 8/2010 | Graham | |
| 2011/0034307 | A1 | 2/2011 | Eddy | |
| 2011/0070021 | A1 | 3/2011 | Huang et al. | |
| 2012/0021876 | A1 | 1/2012 | Hsiung | |
| 2013/0072361 | A1 | 3/2013 | Ellis | |
| 2013/0079202 | A1 | 3/2013 | Librizzi | |
| 2014/0121076 | A1 | 5/2014 | Lagree | |
| 2014/0274605 | A1 | 9/2014 | McCanney et al. | |

FOREIGN PATENT DOCUMENTS

| | | |
|---|---|---|
| WO | 8704633 | 8/1987 |
| WO | 9403088 | 2/1994 |

(56) References Cited

FOREIGN PATENT DOCUMENTS

| | | |
|---|---|---|
| WO | 9404228 | 3/1994 |
| WO | 9920352 | 4/1999 |
| WO | 03041811 | 5/2003 |
| WO | 2008054809 | 5/2008 |
| WO | 2008082818 | 7/2008 |

OTHER PUBLICATIONS

Chairmaster. http://www.chairmaster.com/ from video seen on Mar. 6, 2013.
International Search Report & Written Opinion for PCT/CA2014/051215 dated Apr. 16, 2015.

* cited by examiner

EXERCISE MACHINE HAVING ELASTIC EXERCISE RESISTANCE CABLES

CROSS REFERENCE TO RELATED APPLICATION

This application is a non-provisional of U.S. Provisional Patent Application No. 61/915,704 filed in the United States Patent and Trademark Office on Dec. 13, 2013, the disclosure of which is incorporated herein by reference and priority to which is claimed.

BACKGROUND OF THE INVENTION

Field of the Invention

There is provided an exercise machine. In particular, there is provided an exercise machine having elastic exercise resistance cables.

Description of the Related Art

U.S. Pat. No. 5,899,836 to Chen discloses an exerciser. The exercise includes a foot support secured in front of a base. A lever has a lower portion pivotally coupled to the base and has a bracket and a seat cushion pivotally secured on the top for allowing the seat cushion to be moved upward and downward. A tube is secured to the bracket for supporting one or more pulleys. The base has one or more pulleys secured to the front and the rear portions. One or more resilient members are engaged with the pulleys. A handle may be secured to the resilient member for conducting pulling exercises. The tube may be moved upward and downward in concert with the seat cushion.

U.S. Pat. No. 7,775,949 to Bowser discloses a shoulder stretcher assembly. The assembly detachably connects to a chair frame of a chair. It includes an elongated support assembly that includes a substantially vertical portion securely supportable adjacent to a rear portion of a chair frame of the chair. An upper portion of the elongated support assembly projects forwardly from the substantially vertical portion so as to extend over the chair. The upper portion includes a pulley assembly attaching element for attaching a pulley assembly for supporting a cable assembly.

U.S. Pat. No. 5,029,850 to van Straaten discloses an exercise apparatus comprising elastic bands which extend between anchor points on a bottom bar and pulleys on a top bar. Their free ends are engaged individually or jointly by handles. A brace extends between stretchers, spacing the bars apart. By standing on the bottom bar while the apparatus leans against a wall a large number of exercises can be performed by manipulating the handles. The device can be inverted for further exercises or laid flat for further exercises.

The above systems may be limited in the numbers of exercises that may be performed therewith. Some of these and other systems may also take up a relatively large amount of work-out space. There is accordingly a need for an improved exercise machine.

BRIEF SUMMARY OF INVENTION

There is provided herein, and it is an object to provide, an improved exercise machine having elastic exercise resistance cables.

There is accordingly provided an exercise machine according to a first aspect. The machine comprises an upright, hollow mounting assembly having a top and a bottom opposite the top. The machine comprises upper and lower pulley assemblies disposed within and rotatably connected to the mounting assembly adjacent to the top and the bottom thereof, respectively. The machine comprises a plurality of exercise resistance cables having proximal end portions positioned within and coupling to the mounting assembly. The cables have distal end portions which are spaced-apart from the proximal end portions. The distal ends of a first pair of the cables extend around respective ones of the pulley assemblies and extend outwards from the mounting assembly at the top and the bottom thereof, respectively.

According to a second aspect, there is accordingly provided a system for selectively moving an exercise machine. The machine has a base that abuts a floor when in use. The system comprises a lever arm having a handle at a first end portion thereof, a second end portion opposite the first end portion, and a protrusion extending outwards therefrom. The protrusion is located adjacent to the second end portion of the arm and operatively abuts the base. The machine comprises a wheel rotatably connected to the second end portion of the arm. The arm is pivotable about the wheel from a first position to a second position relative to the base. Movement of the handle from the first to the second position causes the lever arm to raise the base upwards, the exercise machine being supported by the wheel for moving the machine.

There is further provided an exercise machine according to a third aspect. The machine comprises a housing having a bottom and a top opposite the bottom. The machine also comprises a cable mounting assembly. The cable mounting assembly includes a lower pulley assembly rotatably mounted to the housing adjacent to the bottom thereof and an upper pulley assembly rotatably mounted to the housing adjacent to the top thereof. The machine has a plurality of exercise resistance cables having proximal end portions disposed within and coupling to the housing. The cables extend around a first one of the lower and upper pulley assemblies, and extend around and outwards from a second of the lower and upper pulley assemblies at distal end portions thereof.

There is also provided an exercise machine according to a fourth aspect. The machine comprises a hollow, upright housing having a bottom, a top opposite the bottom, a front and a rear opposite the front. The front and rear of the housing extend from the bottom to the top thereof. The machine has a plurality of exercise resistance cables having proximal end portions disposed within and coupling to the housing. The cables have distal end portions extending outwards from the housing. A first one of the cables extends outwards from the housing at the bottom and the front thereof. A second one of the cables extends outwards from the housing at the bottom and the rear thereof. A third one of the cables extends outwards from the housing at the top and the front thereof. A fourth one of the cables extends outwards from the housing at the top and the rear thereof.

There is further provided an exercise machine according to a fifth aspect. The machine comprises a housing having a pair of spaced-apart sides. The machine comprises a mounting rod extending between the sides of the housing. The machine also has a plurality of pulleys rotatably mounted to the mounting rod. There is a retaining rod extending between the sides of the housing and positioned adjacent to the pulleys. A plurality of stretch resistance cables have proximal end portions coupled to the housing and distal end portions extending about and outwards from respective ones of the pulleys with the retaining rod functioning to inhibit dislodgement of the cables therefrom.

There is also provided an exercise machine according to a sixth aspect. The machine comprises an elongate mounting assembly. A pair of foot-engaging members slidably connect to the mounting assembly. The foot-engaging members are moveable from a retracted position to an extended position. A plurality of exercise resistance cables have proximal end portions coupled to the mounting assembly and have distal end portions selectively connectable to the foot-engaging members. The cables are configured to inhibit movement of the foot-engaging members from the retracted position to the extended position.

There is further provided a cable connector mechanism for an exercise assembly using exercise resistance cables according to a seventh aspect. The cables have distal end portions. The cable connect mechanism comprises a cable mount with at least one slot extending therethrough. The slot has an enlarged circular portion and a slotted portion extending radially outwards from the circular portion. The slotted portion is shaped to receive respective ones of the cables therethrough. A plurality of protrusions are connectable to the distal end portions of the cables. Each of the circular portions of the slots is shaped to receive respective ones of the protrusions. Portions of the cables adjacent to the protrusions are received by the slotted portions of the slots thereafter for selectively connecting the cable to the exercise assembly thereby.

There is also provided an exercise machine according to an eighth aspect. The machine comprises a horizontally-extending, first mounting assembly. A pair of foot-engaging members slidably connect to the first mounting assembly. The foot-engaging members are moveable from retracted positions to extended positions. A first plurality of exercise resistance cables couple to the first mounting assembly and selectively connectable to the foot-engaging members for inhibiting movement thereof towards the extended positions. A vertically-extending, second mounting assembly couples to and extends upwards from the first mounting assembly. A second plurality of exercise resistance cables couple to the second mounting assembly and extend outwards therefrom at an upper end thereof.

There is further provided an exercise machine according to a ninth aspect. The machine comprises a leg press module and a seat assembly. At least one cam lever operatively couples together the seat assembly and the leg press module.

There is also provided an exercise machine according to a tenth aspect. The machine comprises an upright mounting assembly having a first mounting bracket and a second mounting bracket angled relative to the first mounting bracket. A pair of pulleys rotatably mount to the mounting brackets. A plurality of exercise resistance cables have proximal end portions coupled to the mounting assembly and distal end portions extending around and outward from the pulleys.

There further provided a seat assembly for an exercise machine according to an eleventh aspect. The seat assembly comprises an upright support member having a pair of spaced-apart seat brackets connected thereto. A seat mount has a mounting bar and a protrusion spaced-apart from the mounting bar. A first one of the seat brackets is shaped to receive the mounting bar. A second one of the seat brackets has a slot shaped to receive the protrusion for coupling the seat mount to the support member thereby.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
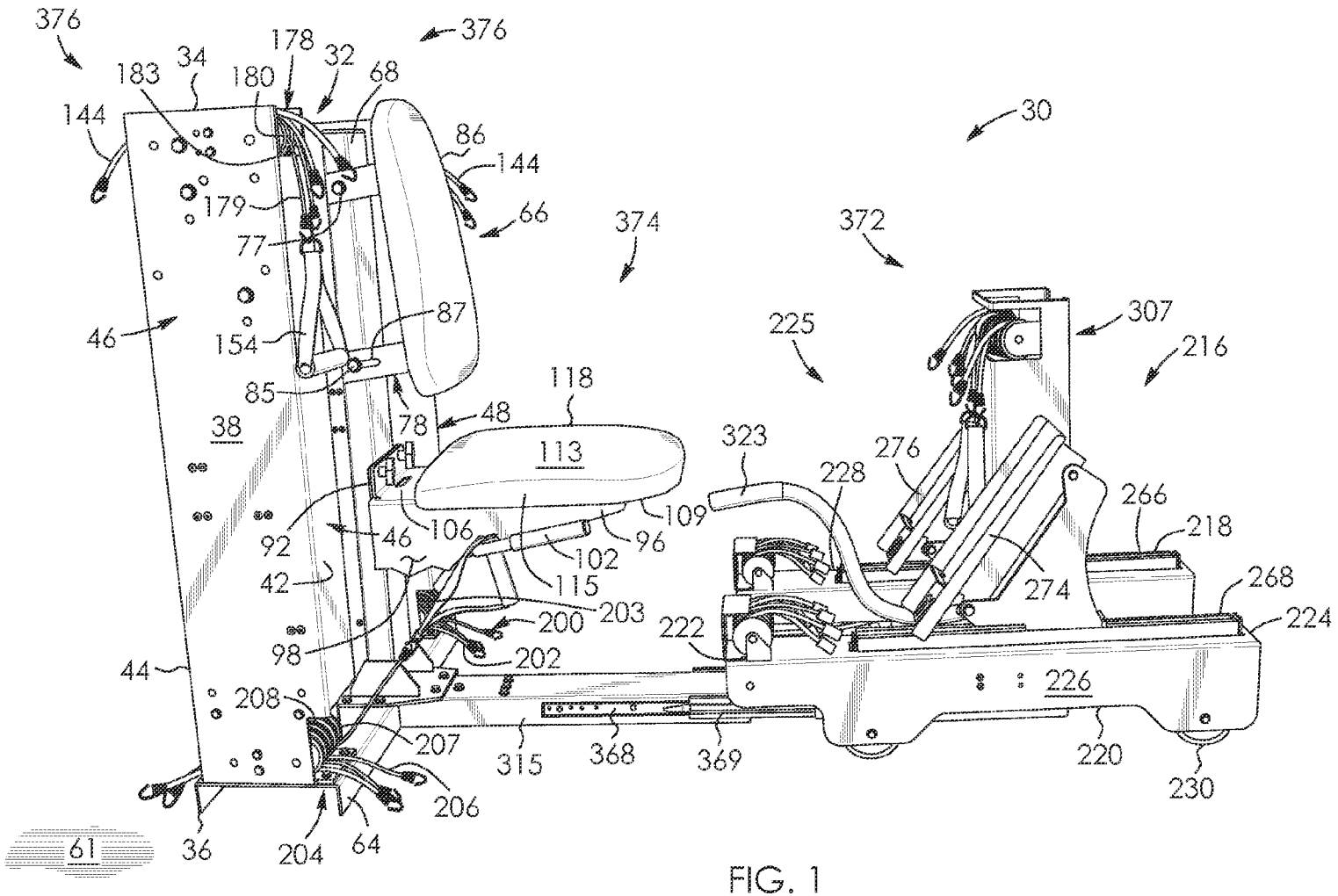
FIG. 1 is a side perspective view of the exercise machine according to a first aspect, in an extended position, the machine having a seat assembly with a seat mount having its sides partially shown in fragment.
Figure 17:
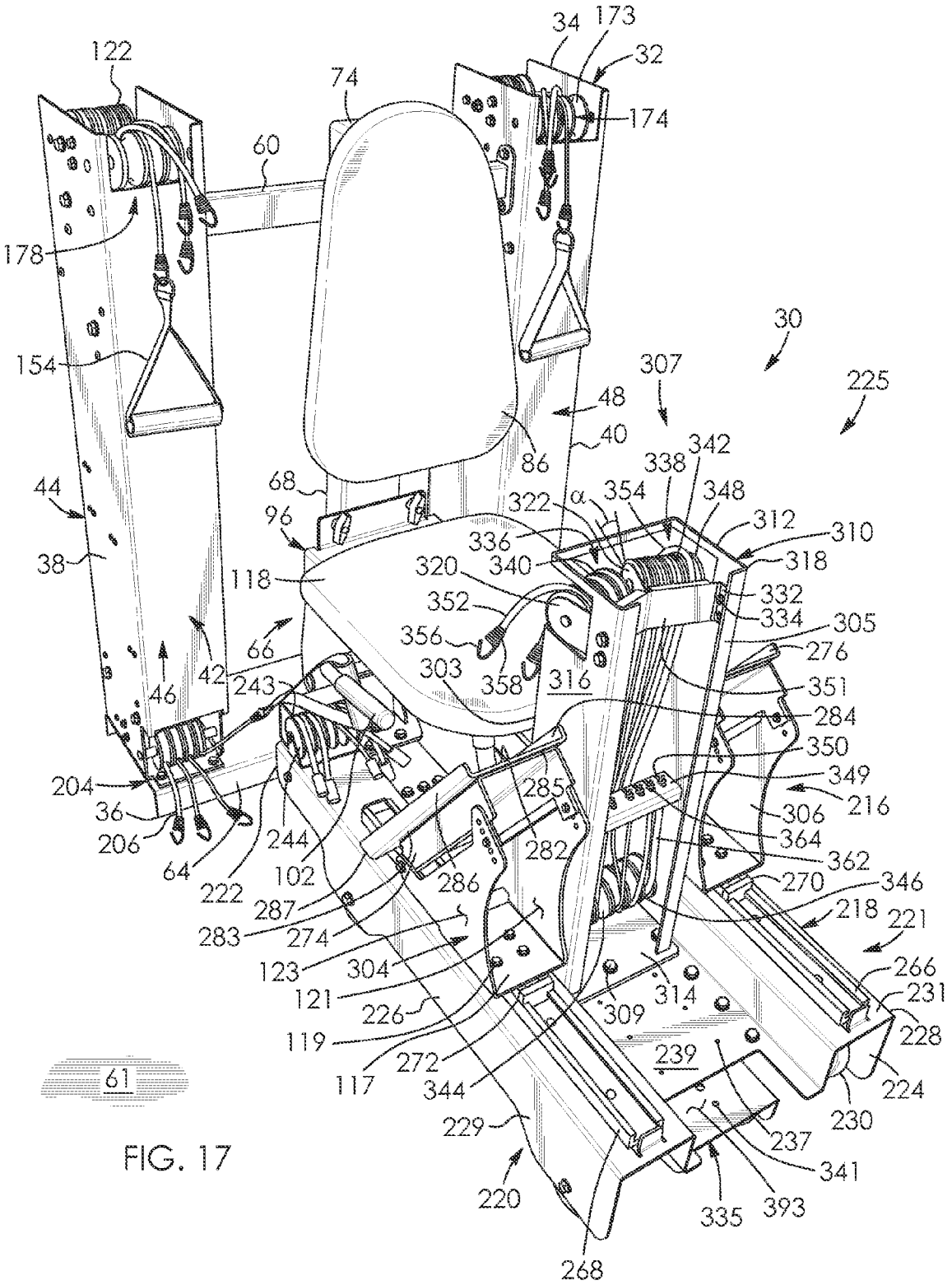
FIG. 17 is a front, side perspective view of the exercise machine of FIG. 1 shown in the refracted position.

Referring to the drawings and first to FIG. 1, there is shown an exercise machine 30 according to a first aspect. The exercise machine includes an upright mounting assembly 32. The mounting assembly has a top 34 and a bottom 36 that is spaced-apart from the top. The mounting assembly 32 has a pair of spaced-apart ends 38 and 40 as seen in FIG. 17, and a first side 42 and a second side 44 opposite the first side as seen in FIG. 1. The ends and sides of the mounting assembly extend from top 34 to bottom 36.

Figure 2:
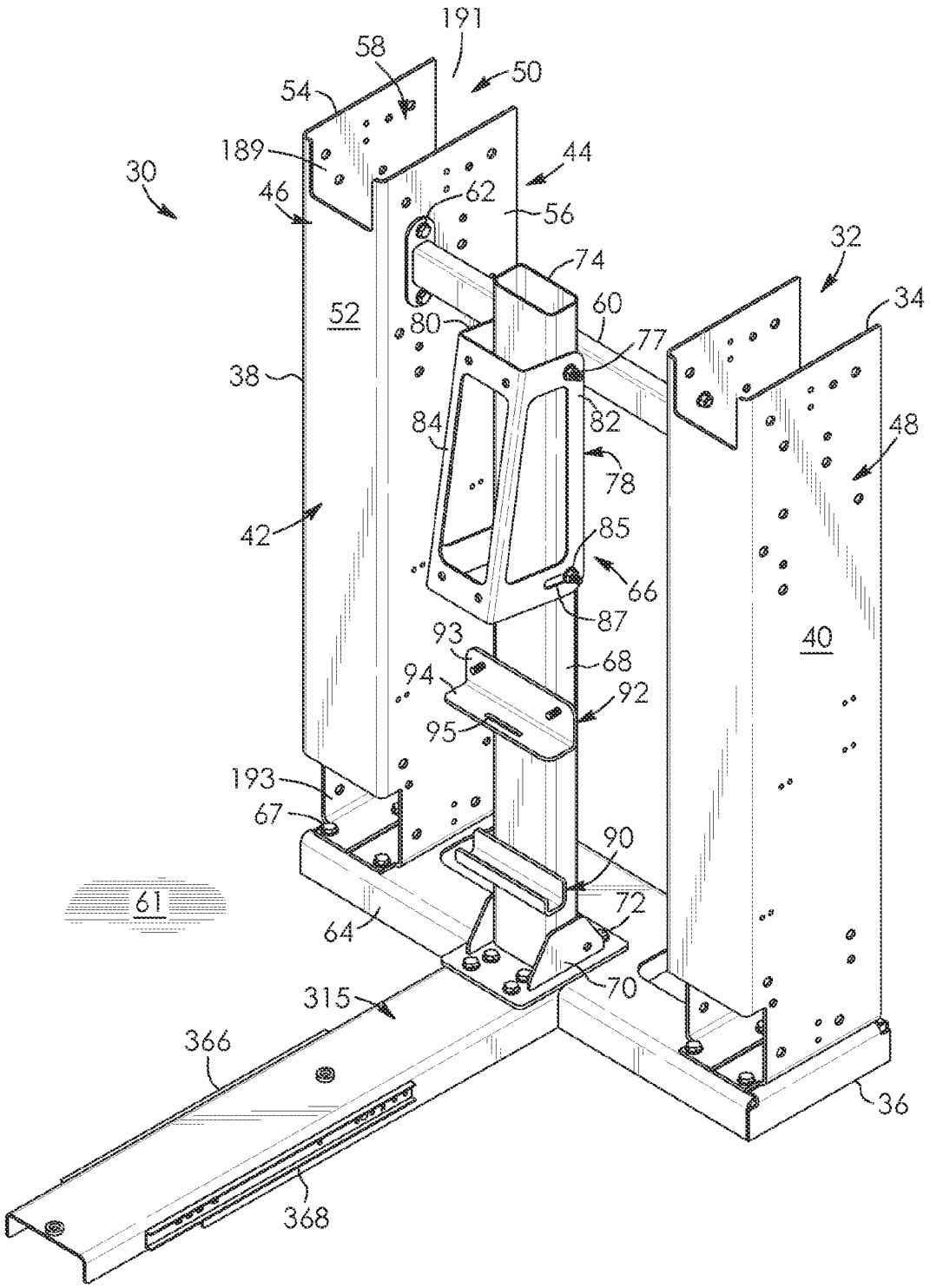
FIG. 2 is a front perspective view of an upright mounting assembly for the exercise machine of FIG. 1.

As seen in FIG. 2, the mounting assembly 32 includes a pair of spaced-apart upright housings 46 and 48 aligning with ends 38 and 40, respectively, of the assembly 32. The housings extend between sides 42 and 44 of the assembly as seen in FIG. 1. Referring back to FIG. 2, the housings 46 and 48 extend between bottom 36 and top 34 of the assembly 32. Each of the housings is generally in the shape of an upright, vertically-extending hollow rectangular prism. Each housing in this example has an elongate vertically-extending open end, an elongate vertically-extending closed end, a vertically-extending outer side facing away from the assembly 32, a vertically-extending inner side that is spaced-apart from the outer side, the sides extending between the ends thereof, and an interior, as seen by a first, or front, open end 50, a second, or rear, closed end 52, outer side 54, inner side 56 and interior 58 for housing 46 in FIGS. 2 and 4. The open ends 50 of the housings 46 and 48 align with side 44 of the mounting assembly 32 in this example and the closed ends 52 of the housings align with side 42 of the assembly.

Referring back to FIG. 2, the mounting assembly 32 includes a horizontal brace or crossbar 60. The crossbar extends between inner sides 56 of the housings 46 and 48 and connects the housings together. In this example, the crossbar 60 is positioned adjacent to the top 34 of the assembly 32 and secured to the housings via fasteners 62. The crossbar 60 is rectangular in cross-section in this example. The mounting assembly 32 includes a frame or base 64 that is rectangular in shape in this example. The base abuts the floor 61 when the machine 30 is in use. The housings 46 and 48 are connected to the base in this example via fasteners 67, with the base extending between and further connecting the housings together adjacent to the bottom 36 of the assembly 32.

Figure 5:
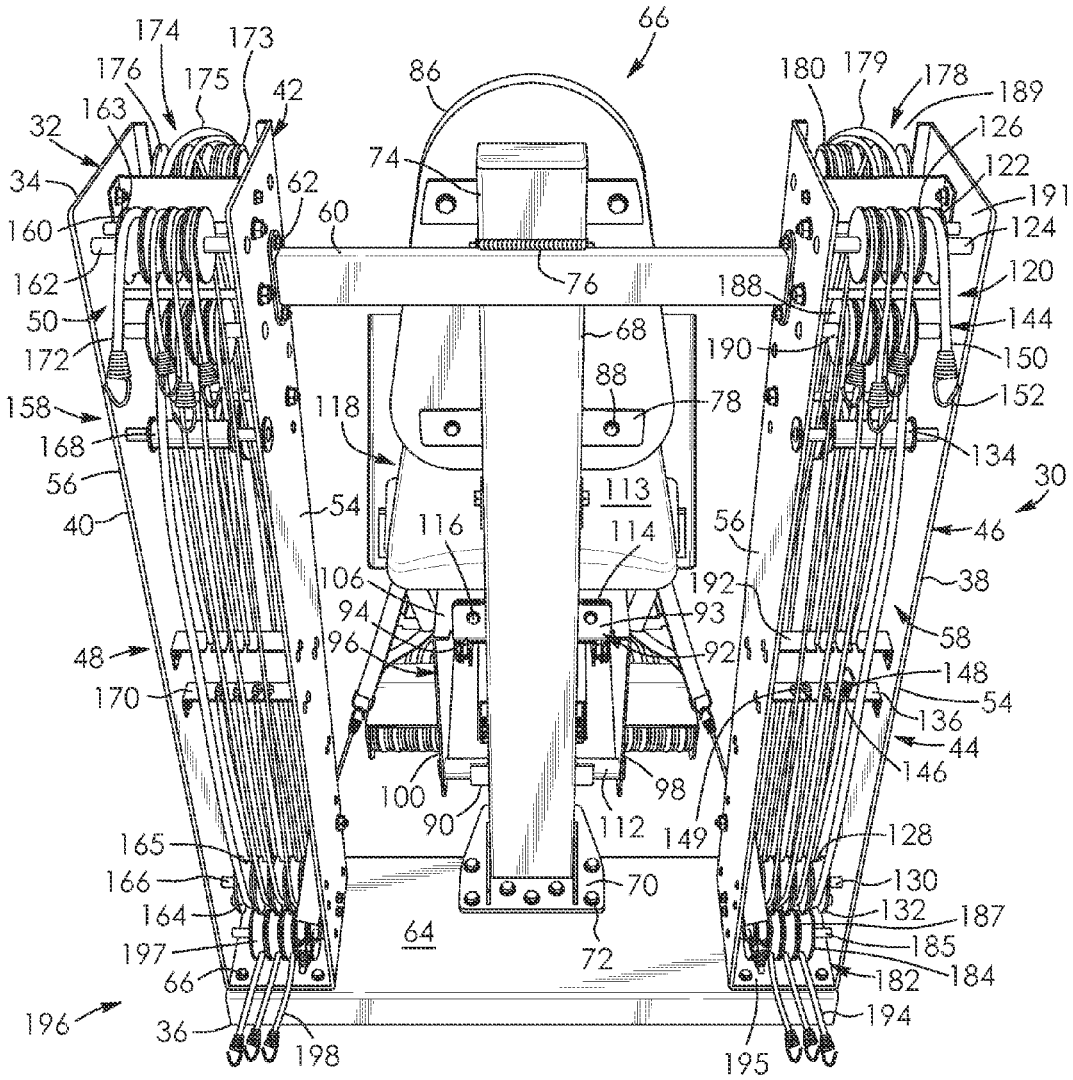
FIG. 5 is a rear, top perspective view of the exercise machine of FIG. 1.

As seen in FIG. 1, the exercise machine 30 has a seat assembly 66. Referring to FIG. 2, the seat assembly includes an upright support member, in this example a support bar 68. The support bar is centrally disposed between housings 46 and 48 in this example. The support bar 68 has a lower flanged end 70 that connects via fasteners 72 in this example to base 64. The support bar has an upper end 74 that is spaced-apart from its lower flanged end. The upper end 74 of the support bar 68 connects to crossbar 60 via welding 76 in this example, as seen in FIG. 5.

Referring back to FIG. 2, the seat assembly 66 includes a backrest bracket 78 positioned adjacent to the upper end 74 of the support bar 68. Upper fasteners 77 connect backrest bracket 78 to support bar 68, as seen in FIG. 2. The backrest bracket includes a pair of spaced-apart side portions 80 and 82 and an angled, front portion 84 extending between the side portions. The side portions of the bracket connect to the support bar 68 via fasteners 85 in this example. The seat assembly 66 includes a cushioned backrest 86 as best seen in FIG. 1, which connects to front portion 84 of bracket 78 via fasteners 88, in this example, as seen in FIG. 5. According to one aspect shown in FIG. 2, the side portions 80 and 82 have slots 87 through which the fasteners 85 extend. This enables angling of the front portion 84 to be selectively adjusted for reclining backrest 86 towards the mounting assembly 32 as desired.

Referring back to FIG. 2, the seat assembly 66 includes a pair of spaced-apart seat brackets 90 and 92 connected to the support bar 68. Bracket 90 is u-shaped in cross-section and is positioned adjacent to lower flanged end 70 of the support bar. Bracket 92 is L-shaped in this example. Bracket 92 has a first elongate plate 93 connected to and extending along support bar 68. The bracket 92 has an outwardly extending second elongate plate 94 that is perpendicular to plate 93 in this example and which extends outwards from the support bar 68. The elongate plate 94 has a centrally positioned slot 95.

Figure 3A:
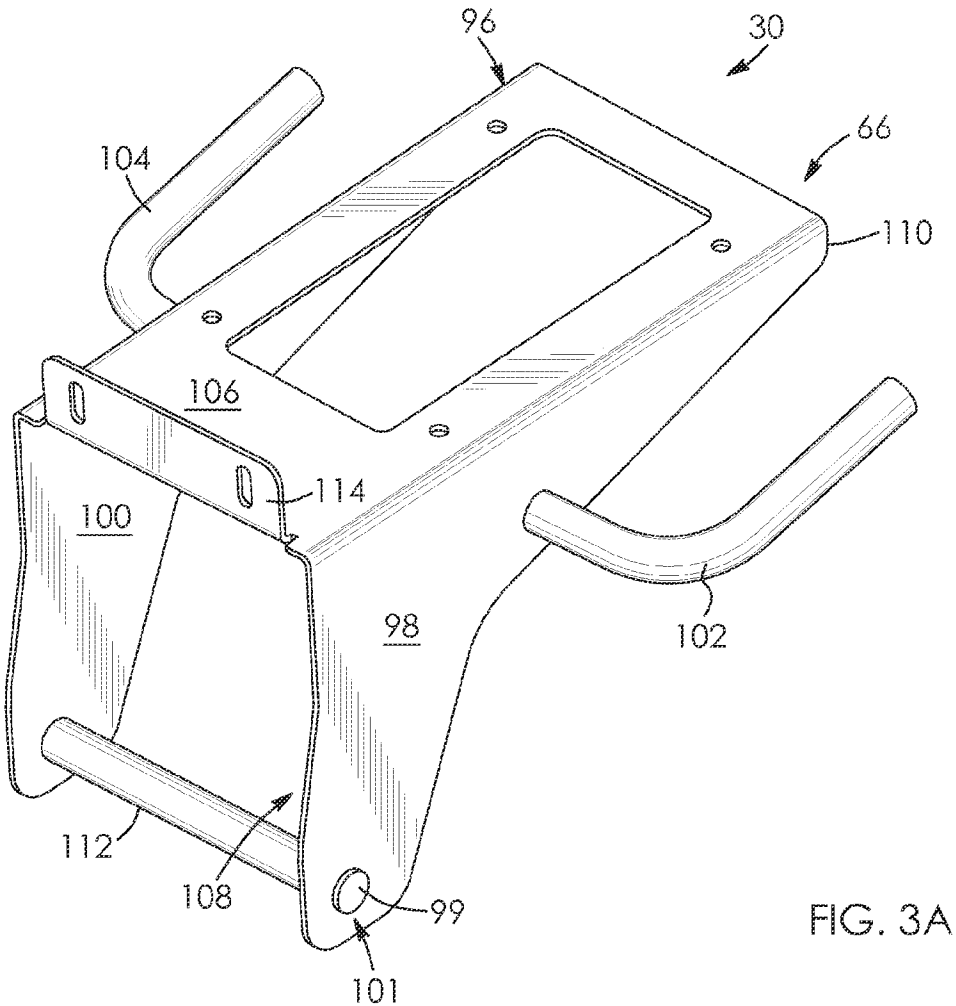
FIG. 3A is a rear, top perspective view of a seat mount for the exercise machine of FIG. 1.
Figure 3B:
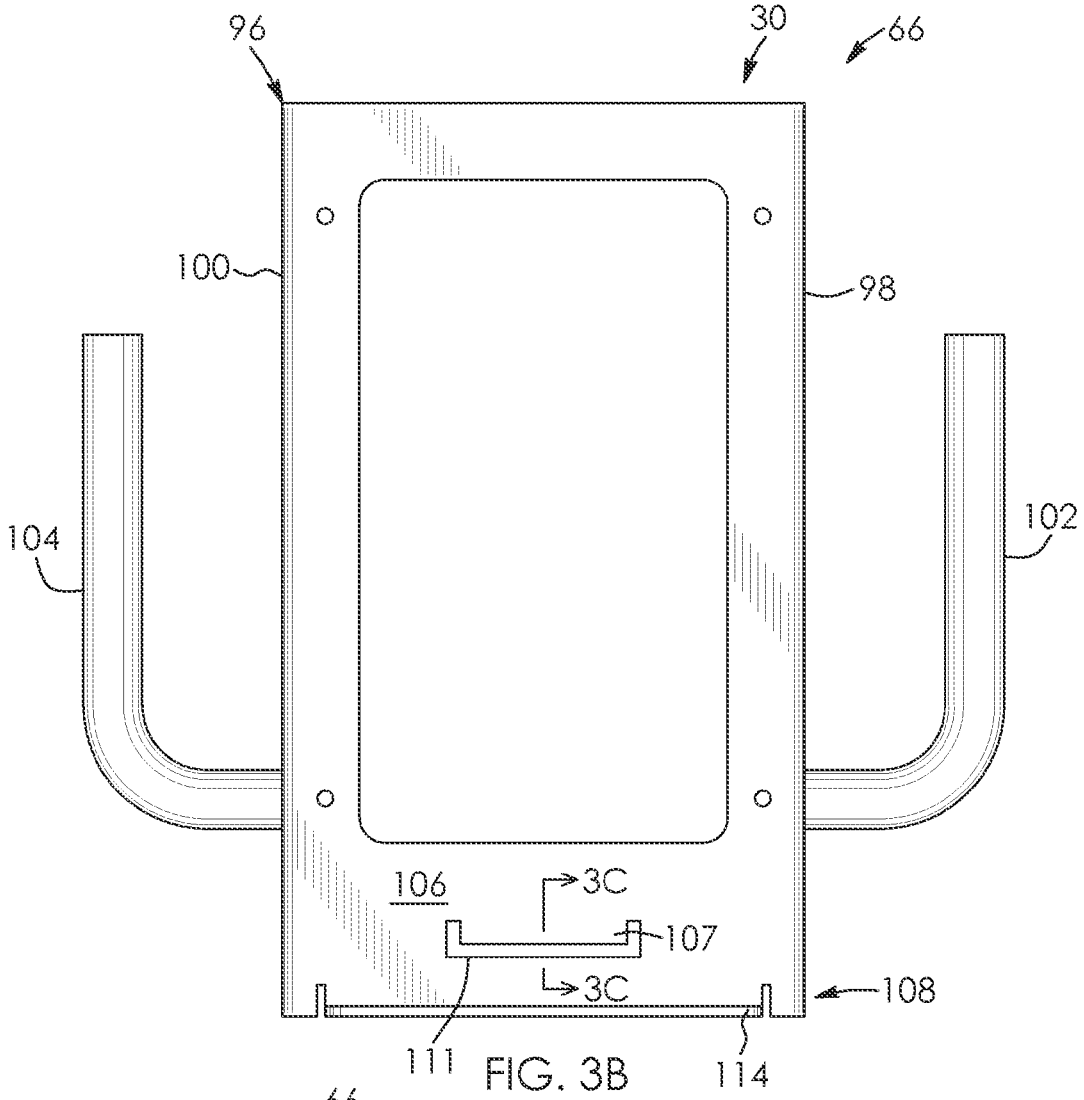
FIG. 3B is a top plan view of the seat mount showing an elongate tab thereon.
Figure 3C:
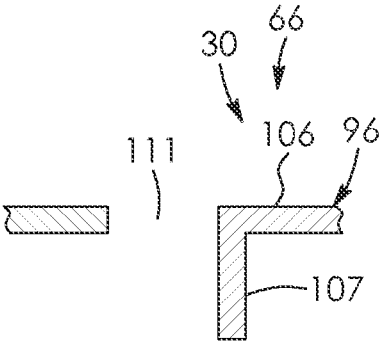
FIG. 3C is a sectional view of the seat mount taken along lines 3C-3C showing the elongate tab of the seat mount.
Figure 3D:
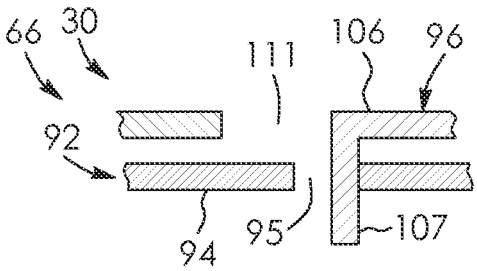
FIG. 3D is a sectional view similar to FIG. 3C showing the elongate tab fitted within a slot of a seat bracket of the machine.

As best seen in FIG. 3A, the seat assembly 66 includes a seat mount 96 comprising a pair of L-shaped spaced-apart sides 98 and 100, a pair of L-shaped, hand gripping bars 102 and 104 connected to and extending outwards from the sides, and a top mounting portion 106 extending between the sides. The seat mount has a proximal base end 108 and a distal tapered end 110 that is spaced-apart from the proximal end portion. The sides 98 and 100 and mounting portion 106 extend between ends 108 and 110. The sides 98 and 100 are generally L-shaped in this example. The seat mount 96 includes a mounting member, in this example a bar 112 and a mounting flange 114 that is spaced-apart from the bar 112, both of which are located at base end 108. In other embodiments, a tube may be substituted for the bar, for example. The mounting flange connects to and extends upwards from the top mounting portion 106. Mounting bar 112 connects to and extends between sides 98 and 100. The bar 112 is made of steel in this example and includes a pair of end caps at its ends that are made of plastic in this example, as seen by cap 99 at end 101. As seen in FIG. 3B, a u-shaped aperture 111 extends through the top mounting portion 106 of the seat mount 96 adjacent to the base end 108 of the seat mount. The seat mount includes a protrusion, in this example an elongate tab 107 as best seen in FIGS. 3B to 3D, which is positioned adjacent to and in parallel with the mounting flange 114 in this example. The elongate tab is bent downwards relative to mounting portion 106. Slot 95 of plate 94 shown in FIG. 2 is shaped to receive tab 107, with the tab hooking the slot.

To install the seat mount 96 and referring to FIG. 5, mounting bar 112 is shaped to connect with, and be received, by bracket 90. The seat mount and its load are vertically solely supported by bracket 90 in this example. Tab 107, seen in FIGS. 3B to 3D, is positioned within slot 95 of plate 94, as seen in FIG. 3D. This inhibits the seat mount from pitching. Tab 107 and slot 95 thus facilitate installation and removal of the seat and also provide a significant safety feature for ensuring the seat mount 96 remains securely connected to the rest of the exercise machine 30. Plate 93 of bracket 92 may then be connected to mounting flange 114 of mount 96 in this example via fasteners 116 as seen in FIG. 5. Fasteners 116 also inhibit seat mount 96 from angling downwards or pitching clockwise from the perspective of FIG. 1. The seat mount 96 thus connects to the support bar 68. As seen in FIG. 1, the seat assembly 66 has a cushioned seat 118. The seat has a bottom 109, a top 113 and a pair of spaced-apart side portions as seen by side portion 115 in FIG. 1. The bottom and top of the seat 118 extend between side portions thereof. The bottom 109 of the seat is connected to top portion 106 of the seat mount via further fasteners (not shown) in this example. The seat is thus operatively connected to the mounting assembly 32 at side 42 thereof.

As seen in FIG. 5, the exercise machine 30 includes a first cable mounting assembly 120 for upper cables. The assembly includes an upper pulley assembly 122 rotatably mounted to housing 46 via a rod 124 that extends between sides 54 and 56 of the housing. The upper pulley assembly comprises a number of adjacent pulleys having a common rotating drum in this example. The rod and pulley assembly are mounted adjacent to the top 34 of the mounting assembly 32 and align adjacent to side 44 of the mounting assembly 32. The pulley assembly 122 is cylindrical in shape and includes a plurality of spaced-apart annular grooves, as shown by groove 126.

The first cable mounting assembly 120 for upper cables includes a lower pulley assembly 128 rotatably mounted to housing 46 via a rod 130. The lower pulley assembly comprises a number of adjacent pulleys rotating on a common drum. Rod 130 extends between sides 54 and 56 of the housing. Pulley assembly 128 and rod 130 are mounted adjacent to the bottom 36 of the mounting assembly 32. Pulley assembly 128 includes a plurality of spaced-apart annular grooves, as shown by groove 132. The first cable mounting assembly 120 for upper cables includes a roller 134 rotatably connected to the housing 46. The roller is interposed between pulley assemblies 122 and 128 and is adjacent to pulley assembly 122 in this example.

Figure 4:
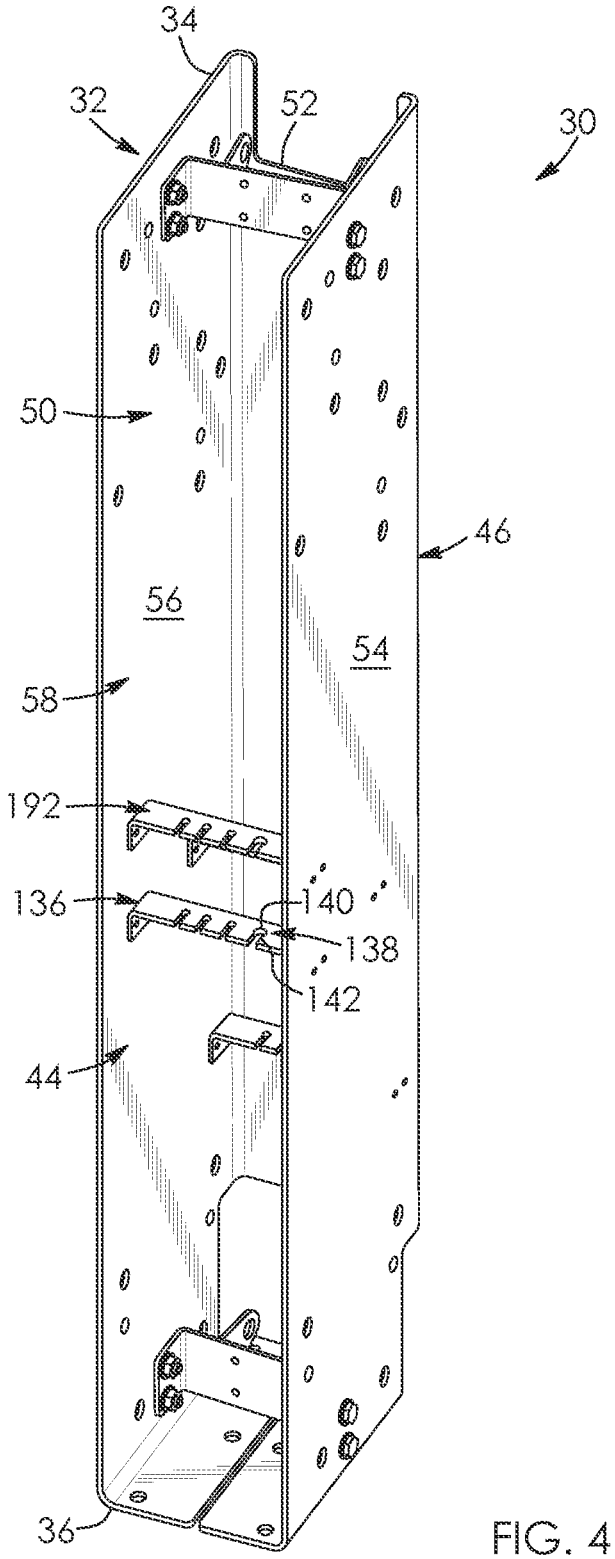
FIG. 4 is a rear, side perspective view of an upright housing of the mounting assembly of FIG. 2.

As best seen in FIG. 4, the first cable mounting assembly 120 for upper cables has a cable mount 136 that connects to and extends between sides 54 and 56 of housing 46. The cable mount is a u-shaped bracket in this example and includes a plurality of spaced-apart slots extending therethrough, as shown by slot 138. Each slot has an enlarged circular portion 140 and a slotted portion 142 extending radially outwards from the circular portion. The slotted portions 142 extend towards and in the direction of side 44 of the mounting assembly 32 in this example.

Referring back to FIG. 5, the exercise machine 30 includes a first plurality of spaced-apart elastic exercise resistance cables, as shown by cable 144, connected to and associated with the first cable mounting assembly 120 for upper cables. The cables have different stretch-resistance properties to enable a user, such as user 145 seen in FIG. 9, to select a desired resistance force for her workout. For example, the cables may have resistance levels of 2 pounds, 5 pounds, 10 pounds, and 20 pounds at 50% stretching of the cable, though this is not strictly required and other configurations are possible.

Each cable has a proximal end portion and a distal end portion that is spaced-apart from its proximal end portion. There are connectors, in this example hooks, connected to the distal end portions in this example, as shown in FIG. 5 for cable 144 by hook 152 connected to end portion 150. End portions 150 may selectively connect to handles 154 shown in FIG. 9 via looped portion 156. Proximal end portions 146 of the cables include knobs in the form of cable knots 149, in this example, or may include hooks 148.

Referring to FIG. 4, the slotted portions 142 of the slots 138 are shaped to receive respective ones of the cables 144 seen in FIG. 5 at locations on the cables adjacent to knobs 149 or hooks 148. Each cable is pushed through a slotted portion 142 until it is received by circular portion 140 of slot 138, with the cable's respective hook 148 abutting the cable mount 136. In this manner, the proximal end portions 146 of the cables 144 connect to the mounting assembly 32. Instead of hooks 148, other protrusions larger than the circular portions can be used to a similar effect.

As seen in FIG. 5, each cable 144 next extends around a respective groove 132 of lower pulley assembly 128, then extends around roller 134 on a side of the roller adjacent to side 44 of assembly 32, and then extends around a respective groove 126 of upper pulley assembly 122 such that the distal end portions 150 of the cables 144 extend outwards from the pulley assembly 122 and in the direction of side 44 of the assembly 32.

Figure 9:
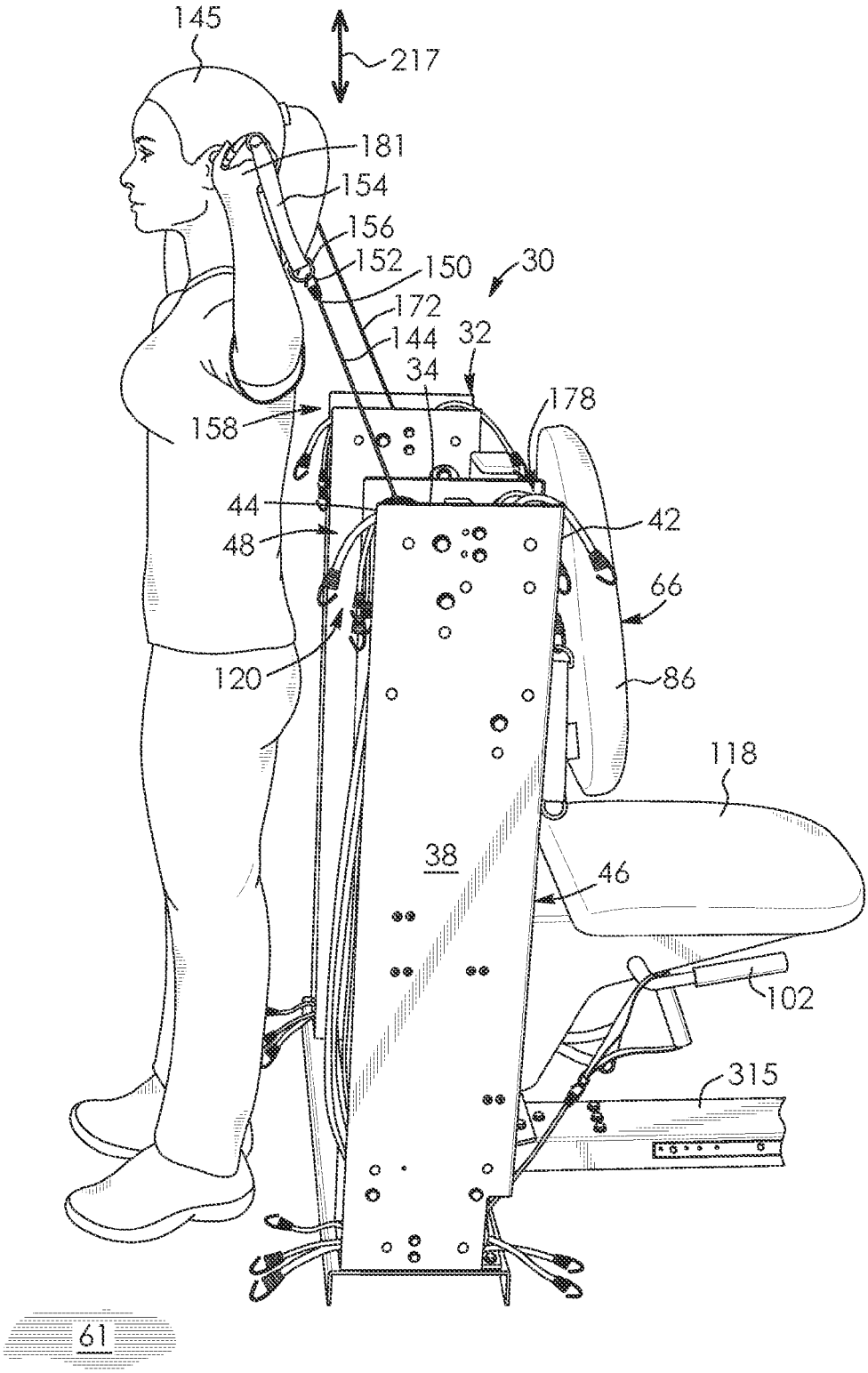
FIG. 9 is a side perspective view of part of the exercise machine of FIG. 1, with the user standing and performing shoulder exercises using cables extending from upper pulley assemblies, the pulley assemblies facing a second side of the upright mounting assembly.

The exercise machine 30 includes a pair of gripping handles, as shown by handle 154 in FIG. 9. Each handle has a looped portion 156 shaped to selectively connect to one or more of the hooks 152 on the distal end portions 150 of the cables 144.

As seen in FIG. 5, the exercise machine 30 includes a second cable mounting assembly 158 for upper cables. The assembly includes an upper pulley assembly 160 rotatably mounted to housing 48 via a mounting rod 162, the pulley assembly having spaced-apart annular grooves 163. The pulley assembly comprises a number of adjacent pulleys rotating on a common drum. The rod and pulley assembly are mounted adjacent to the top 34 of the mounting assembly 32 and align adjacent to side 44 of the mounting assembly 32. The second cable mounting assembly 158 for upper cables includes a lower pulley assembly 164 rotatably mounted to housing 48 via a rod 166, the pulley assembly having spaced-apart annular grooves 165. The pulley assembly 164 comprises a number of adjacent pulleys rotating on a common drum. Pulley assembly 164 and rod 166 are mounted adjacent to the bottom 36 of the mounting assembly 32. The second cable mounting assembly 158 for upper cables includes a roller 168 rotatably connected to the housing 48 and interposed between pulley assemblies 160 and 164.

The second cable mounting assembly 158 for upper cables has a cable mount 170 that connects to and extends between the sides of housing 48. The exercise machine 30 includes a second plurality of upper spaced-apart elastic exercise resistance cables, as shown by cable 172, connected to and associated with the second cable mounting assembly 158 for upper cables, and which extend outwards from the pulley assembly 160 for connecting to handle 154 seen in FIG. 9. The second cable mounting assembly 158 for upper cables and the second plurality of upper elastic exercise resistance cables 172 are substantially the same in parts and functions as the first cable mounting assembly 120 for upper cables and the first plurality of upper elastic exercise resistance cables 144 with the exception that they are located within housing 48. They will therefore not be described in further detail.

The exercise machine 30 includes a third cable mounting assembly 174 for upper cables and a third plurality of upper spaced-apart elastic exercise resistance cables 175 associated therewith. The assembly has an upper pulley assembly 176 rotatably mounted to housing 48 adjacent to the top 34 of the mounting assembly 32. The pulley assembly comprises a number of adjacent pulleys, as seen by pulley 173, rotating on a common drum. Pulley assembly 176 is adjacent to side 42 of the mounting assembly. The cables 175 extend around and outwards from pulley assembly 176 in the direction of side 42 for connecting to a handle, such as handle 154 seen in FIG. 9. The third cable mounting assembly 174 for upper cables and the third plurality of upper elastic exercise resistance cables 175 are substantially the same in parts and functions as the second cable mounting assembly 158 for upper cables and the second plurality of upper elastic exercise resistance cables 172 with the exception that they face and align with side 42 of the mounting assembly 32. They will therefore not be described in further detail.

The exercise machine 30 includes a fourth cable mounting assembly 178 for upper cables and a fourth plurality of upper spaced-apart elastic exercise resistance cables 179 associated therewith. The assembly has an upper pulley assembly 180 rotatably mounted to housing 46 adjacent to the top 34 of the mounting assembly 32. The pulley assembly comprises a number of adjacent pulleys rotating a common drum. The pulley assembly is adjacent to side 42 of the mounting assembly. The cables 179 extend around and outwards from pulley assembly 180 in the direction of side 42 for connecting to a handle, such as handle 154 seen in FIG. 9. The fourth cable mounting assembly 178 for upper cables and the fourth plurality of upper elastic exercise resistance cables 179 are substantially the same in parts and functions as the first cable mounting assembly 120 for upper cables and the first plurality of upper elastic exercise resistance cables 144 with the exception that they face and align with side 42 of the mounting assembly 32. They will therefore not be described in further detail.

The exercise machine 30 includes a first cable mounting assembly 182 for lower cables. The assembly includes a lower pulley assembly 184 rotatably mounted to housing 46 via a rod 185, the pulley assembly having spaced-apart annular grooves 187. The pulley assembly comprises a number of adjacent pulleys rotating a common drum. The rod and pulley assembly are mounted adjacent to the bottom 36 of the mounting assembly 32 and are adjacent to side 44 of the mounting assembly. Pulley assembly 184 is positioned adjacent to and below pulley assembly 128 in this example. The first cable mounting assembly 182 for lower cables includes an upper pulley assembly 188 rotatably mounted to housing 46 via a rod 190. Pulley assembly 188 and rod 190 are mounted adjacent to the top 34 of the mounting assembly 32 and below pulley assembly 122 in this example. Pulley assembly 188 is more spaced-apart from side 44 compared to pulley assembly 122.

The first cable mounting assembly 182 for lower cables has a cable mount 192 that connects to and extends between the sides 54 and 56 of housing 46. The exercise machine 30 includes a first plurality of lower spaced-apart elastic exercise resistance cables, as shown by cable 194, connected to and associated with the first cable mounting assembly 182 for lower cables. The cables extend outwards from pulley assembly 184 for connecting to a handle, such as handle 154 seen in FIG. 9. Cables 194 extend across roller 134 in a manner spaced-apart from cables 144. The first cable mounting assembly 182 for lower cables and the first plurality of lower elastic exercise resistance cables 194 are otherwise substantially the same in parts and functions as the first cable mounting assembly 120 for upper cables and the first plurality of upper elastic exercise resistance cables 144. They will therefore not be described in further detail.

The exercise machine 30 includes a second cable mounting assembly 196 for lower cables, the assembly 196 having a lower pulley assembly 197, and a second plurality of lower elastic exercise resistance cables 198 positioned within housing 48. The pulley assembly comprises a number of adjacent pulleys rotating on a common drum. The cables extend around and outwards from pulley assembly 197 towards bottom 36 of assembly 32 and side 44 thereof. As seen in FIG. 1, the exercise machine 30 includes a third cable mounting assembly 200 for lower cables and a third plurality of lower elastic exercise resistance cables 202 positioned within housing 48, facing side 42 and extending around and outwards from a lower pulley assembly 203 towards bottom 36 of assembly 32 and side 42 thereof. The exercise machine 30 includes a fourth cable mounting assembly 204 for lower cables and a fourth plurality of lower elastic exercise resistance cables 206 positioned within housing 46, facing side 42 and extending around and outwards from a lower pulley assembly 208 towards bottom 36 of assembly 32 and side 42 thereof. The pulley assemblies each comprise a number of adjacent pulleys rotating a common drum such as drum 207 seen in FIG. 1 for assembly 208. Each of the lower cable mounting assemblies and lower pluralities of elastic exercise resistance cables are substantially the same in parts and functions as assembly 182 and cables 194 shown in FIG. 5 and therefore will not be described in further detail.

As seen in FIG. 2, each of the housings has four apertures or openings including an opening 189 adjacent to the top 34 and side 42 of the mounting assembly 32, an opening 191 adjacent to the top and side 44 of the mounting assembly, an opening 193 adjacent to the bottom 36 and side 42 of the mounting assembly and an opening 195 adjacent to the bottom and side 44 of the mounting assembly, as seen in FIG. 5. Respective ones of the cables extends outwards from these openings.

In operation, the cables may be selectively stretched and extended outwards to provide a workout for the user. Some of a large variety of exercises enabled by the exercise machine 30 are shown in FIGS. 6 to 11.

Figure 6:
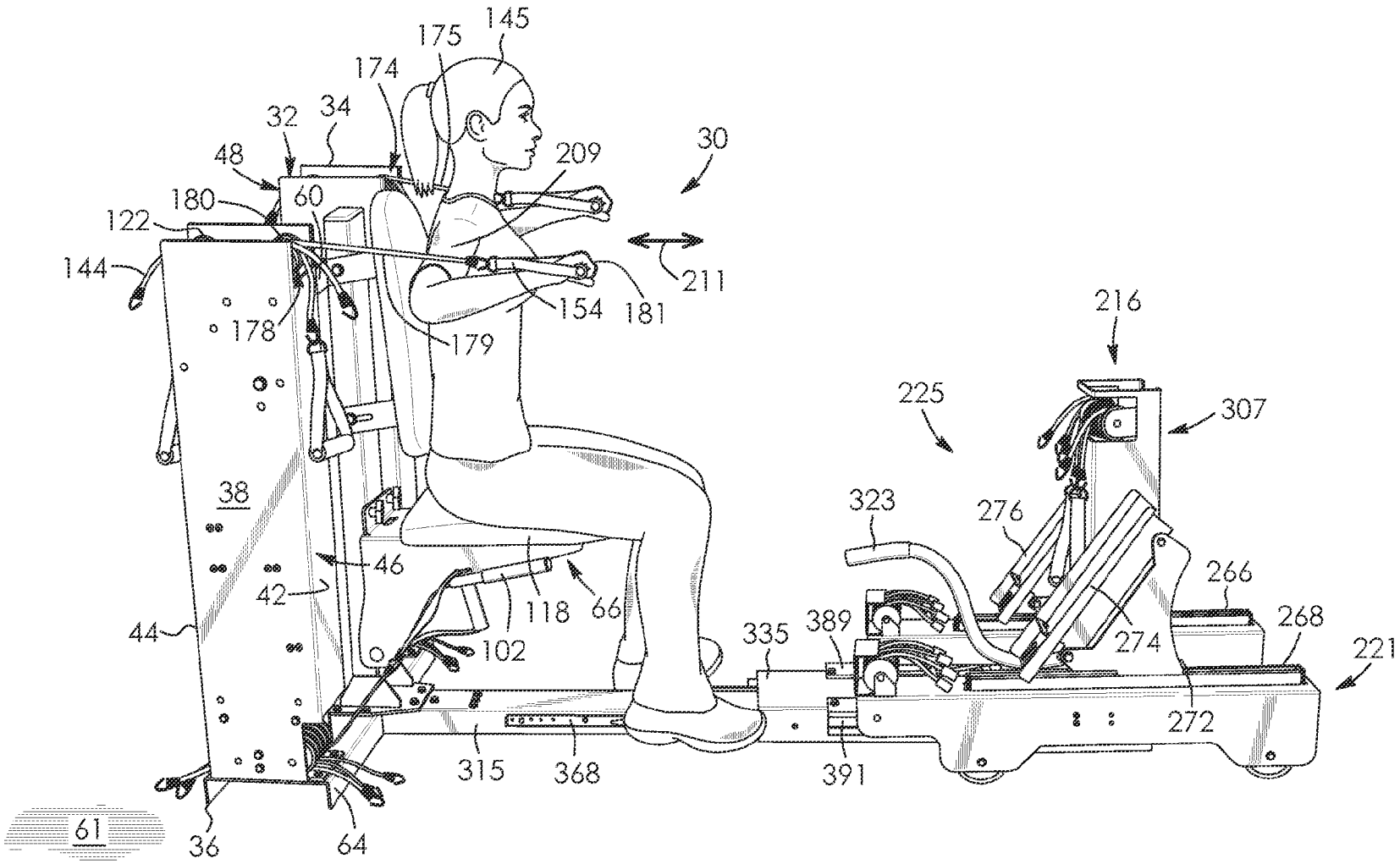
FIG. 6 is a side perspective view of the exercise machine of FIG. 1, with a user performing a chest press using cables extending from upper pulley assemblies, the pulley assemblies facing a first side of the upright mounting assembly.

The machine 30 enables the user 145 to perform chest presses, as seen in FIG. 6. In this case, the user 145 sits on seat 118 and faces forward. Handles 154 connect to cables 175 and 179 of the third cable mounting assembly 174 for upper cables and fourth cable mounting assembly 178 for upper cables and are selectively extended outwards by the user's hands 181. The handles, aligning with the shoulders 209 of the user 145, are selectively extended outwards and away from assembly 32, as seen by arrow 211.

Figure 7:
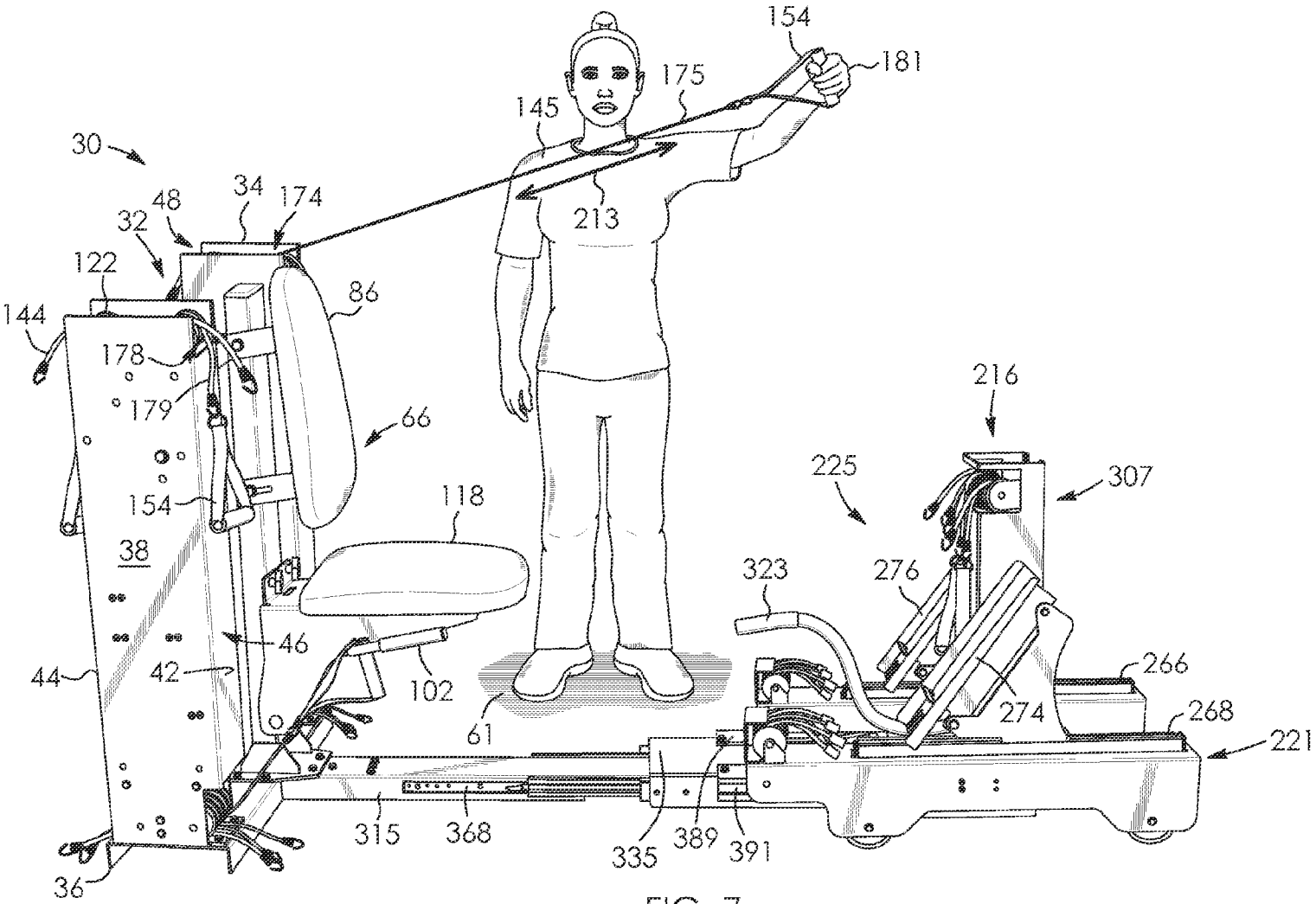
FIG. 7 is a side perspective view of the exercise machine of FIG. 1, with the user standing and performing shoulder exercises with one of the upper pulley assemblies, the pulley assemblies facing the first side of the upright mounting assembly.

The machine enables the user to perform a variety of shoulder exercises as, for example, seen in FIG. 7. In this case, handle 154 connects to cable 175 associated with the third cable mounting assembly 174 for upper cables. The user 145 stands, grips handle 154 with her hand 181 and selectively stretches the cable outwards from the assembly 32 at an upward angle away from assembly 32. This is shown by arrow 213.

Figure 8:
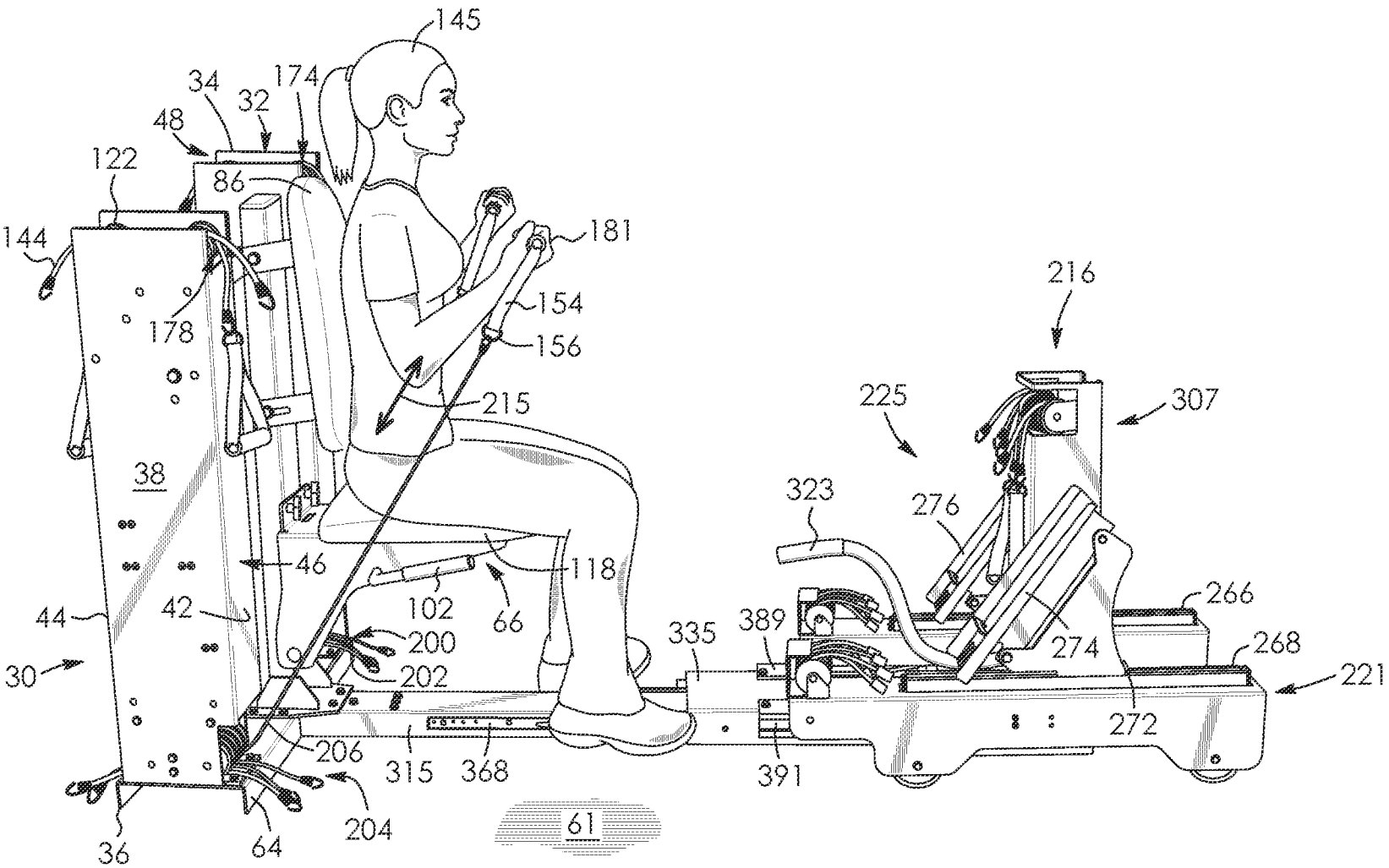
FIG. 8 is a side perspective view of the exercise machine of FIG. 1 with the user sitting down and performing bicep curls using cables extending from lower pulley assemblies, the pulley assemblies facing the first side of the upright mounting assembly.

Referring to FIG. 8, the machine 30 enables the user 145 to perform bicep curls. In this case, the user 145 is in a seated position, sitting on seat 118. Handles 154 connect to cables 206 associated with the third cable mounting assembly 200 for lower cables and cables associated with fourth cable mounting assembly 204 for lower cables. The handles 154 are gripped by the user's hands 181 and the cables are selectively stretched and extended outwards, as shown by arrow 215.

As seen in FIG. 9, further shoulder presses may be performed via cables 144 and 172 associated with upper cable mounting assemblies 120 and 158. The user 145 is in a standing position and faces away from assembly 32. Handles 154 are selectively extended upwards via hands 181, as shown by arrow 217, thereby stretching the cables 144 and 172 and exercising one's muscles thereby.

Figure 10:
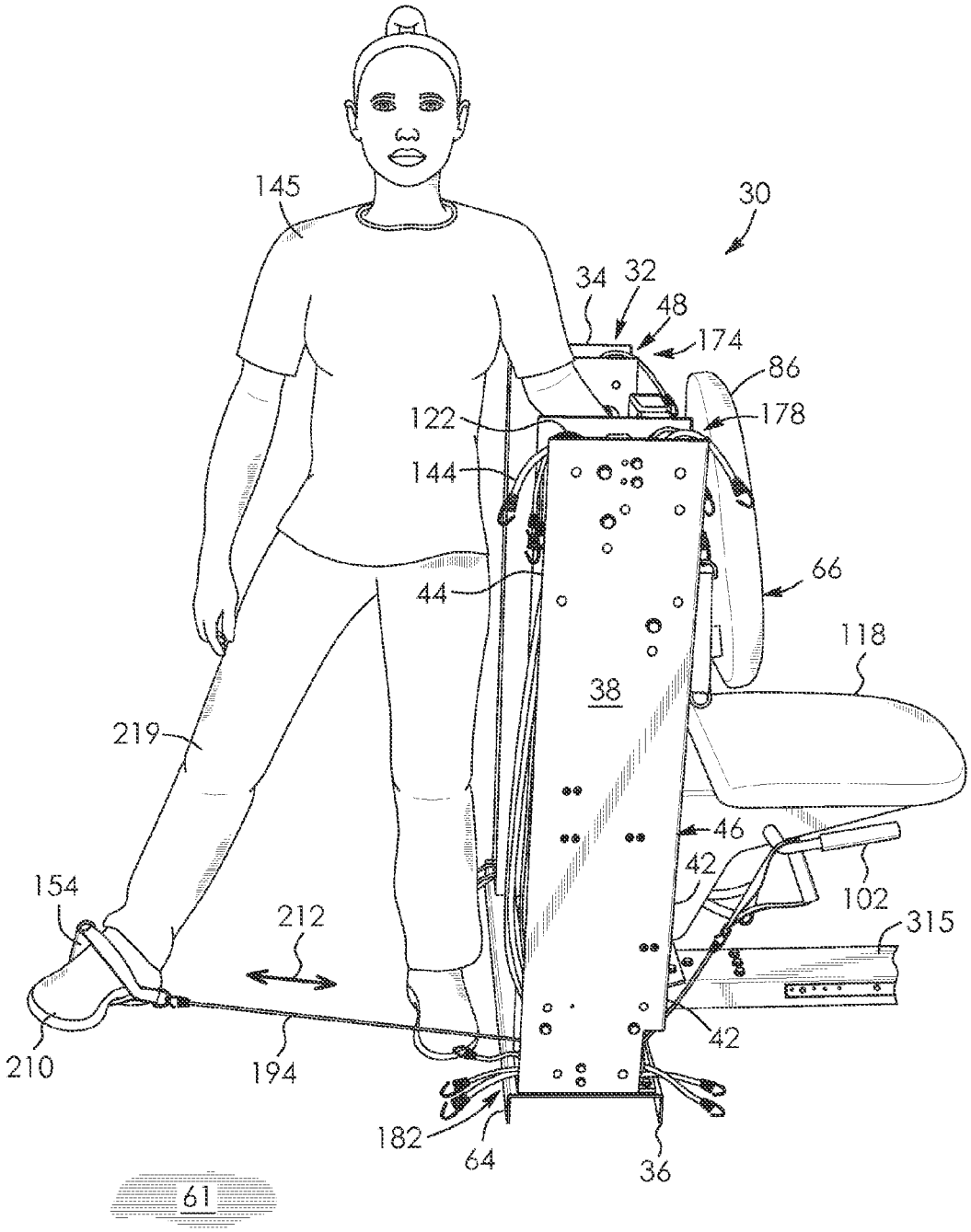
FIG. 10 is a side perspective view of part of the exercise machine of FIG. 1, with the user standing and performing leg exercises using a cable extending from a lower pulley assembly, the pulley assembly facing the second side of the upright mounting assembly.

Hip exercises, such as abduction exercises, may be performed via machine 30 by connecting handle 154 to one of the lower cable mounting assemblies facing side 44, in this example assembly 182 as seen in FIG. 10. The user's foot 210 is positioned through the handle and the corresponding leg 219 is extended outwards from the machine 30, as seen by arrow 212, stretching cable 194. The user 145 may use crossbar 60, seen in FIG. 2, as a hand-gripped support while performing this exercise.

Figure 11:
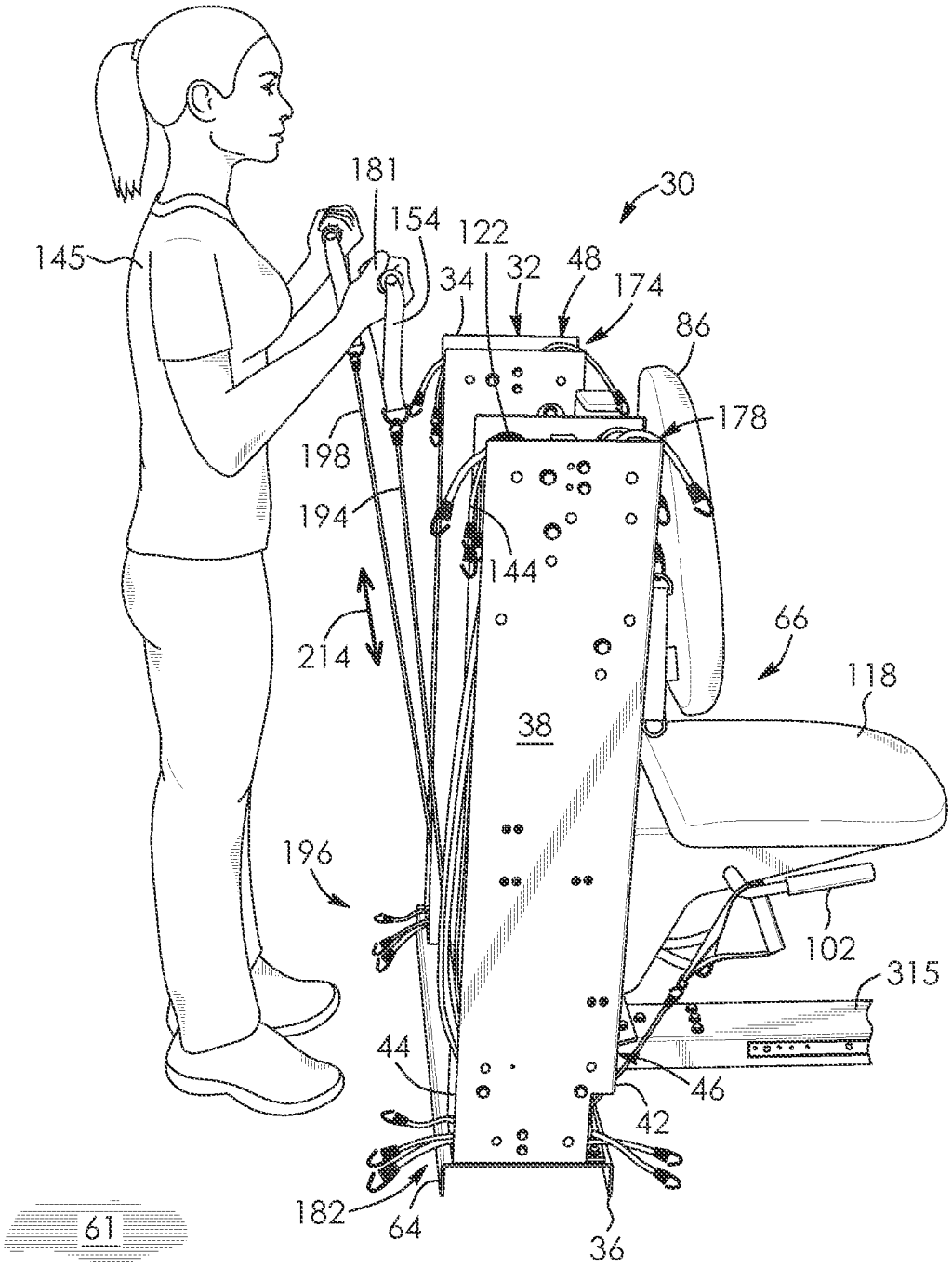
FIG. 11 is a side perspective view of part of the exercise machine of FIG. 10, with the user standing and performing bicep curls using cables extending from the lower pulley assemblies, the pulley assemblies facing the second side of the upright mounting assembly.

Referring to FIG. 11, further bicep curl exercises may be performed by machine 30 by connecting handles 154 to cables 194 and 198 associated with lower cable mounting assemblies 182 and 196. The user 145 stands up, faces the machine 30, grips the handles with her hands 181, and selectively bends her arms upwards, as seen by arrow 214, stretching the cables thereby.

As seen in FIG. 17, the exercise machine 30 includes a moveable carriage 216. The carriage comprises an elongate, horizontally-extending mounting assembly 221, best seen in FIG. 18, which is part of a leg press module 225, and an elongate, upright, vertically-extending mounting assembly 307 connected thereto and extending therefrom as seen in FIG. 17.

Figure 18:
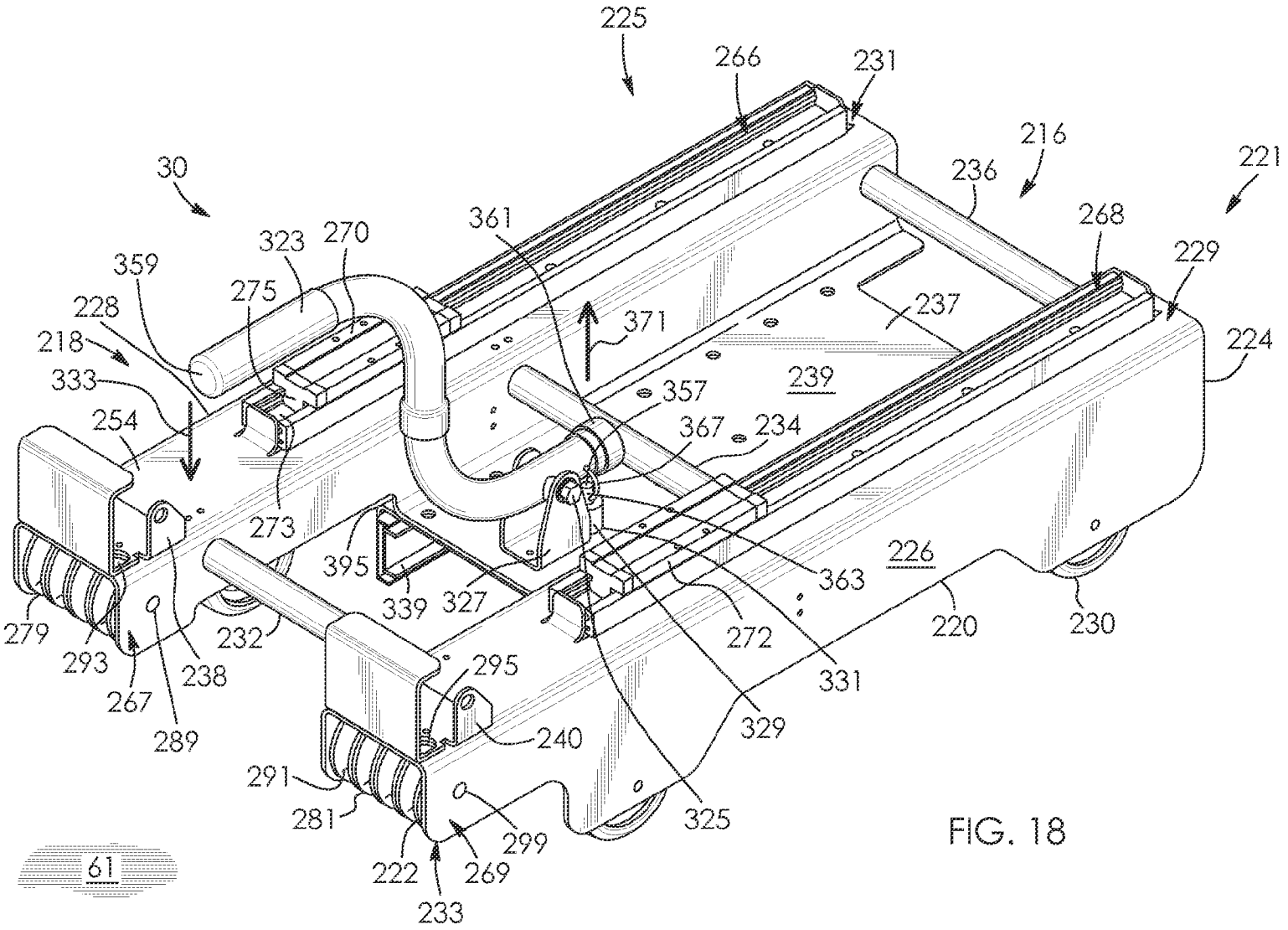
FIG. 18 is a top, side perspective view of the moveable carriage of FIG. 12.

The horizontally-extending mounting assembly 221 has a top 218, a bottom 220 opposite the top, a first end 222, a second end 224 that is spaced-apart from the first end and a pair of spaced-apart sides 226 and 228. Ends 222 and 224 extend between sides 226 and 228. Sides 226 and 228 extend between bottom 220 and top 218. As seen in FIG. 18, the horizontally-extending mounting assembly 221 includes a pair of spaced-apart elongate housings, in this example in the form of brackets 229 and 231 which are u-shaped in cross-section with their open ends facing bottom 220, as seen by end 233 for bracket 229. Bracket 229 aligns with side 226 of the horizontally-extending mounting assembly 221 and bracket 231 aligns with side 228 of the assembly 221.

As seen in FIG. 18, the carriage 216 includes a plurality of outer wheels, as shown by wheel 230. The wheels are rotatably connected to the brackets 229 and 231 and extend from bottom 220 of the horizontally-extending mounting assembly 221. The leg press module 225 comprises a plurality of spaced-apart crossbars 232, 234 and 236 in this example, as seen in FIG. 18, which extend between and couple brackets 229 and 231 together. Crossbars 232 and 236 are positioned adjacent to ends 222 and 224, respectively, and crossbar 234 is positioned between ends 222 and 224 of the horizontally-extending mounting assembly 221. The mounting assembly 221 includes a mounting plate 237 that extends between brackets 229 and 231 and which extends from end 224 towards end 222. The plate has a top 239 facing crossbar 234 and a bottom 241, seen in FIG. 19, which is opposite to the top.

Figure 16:
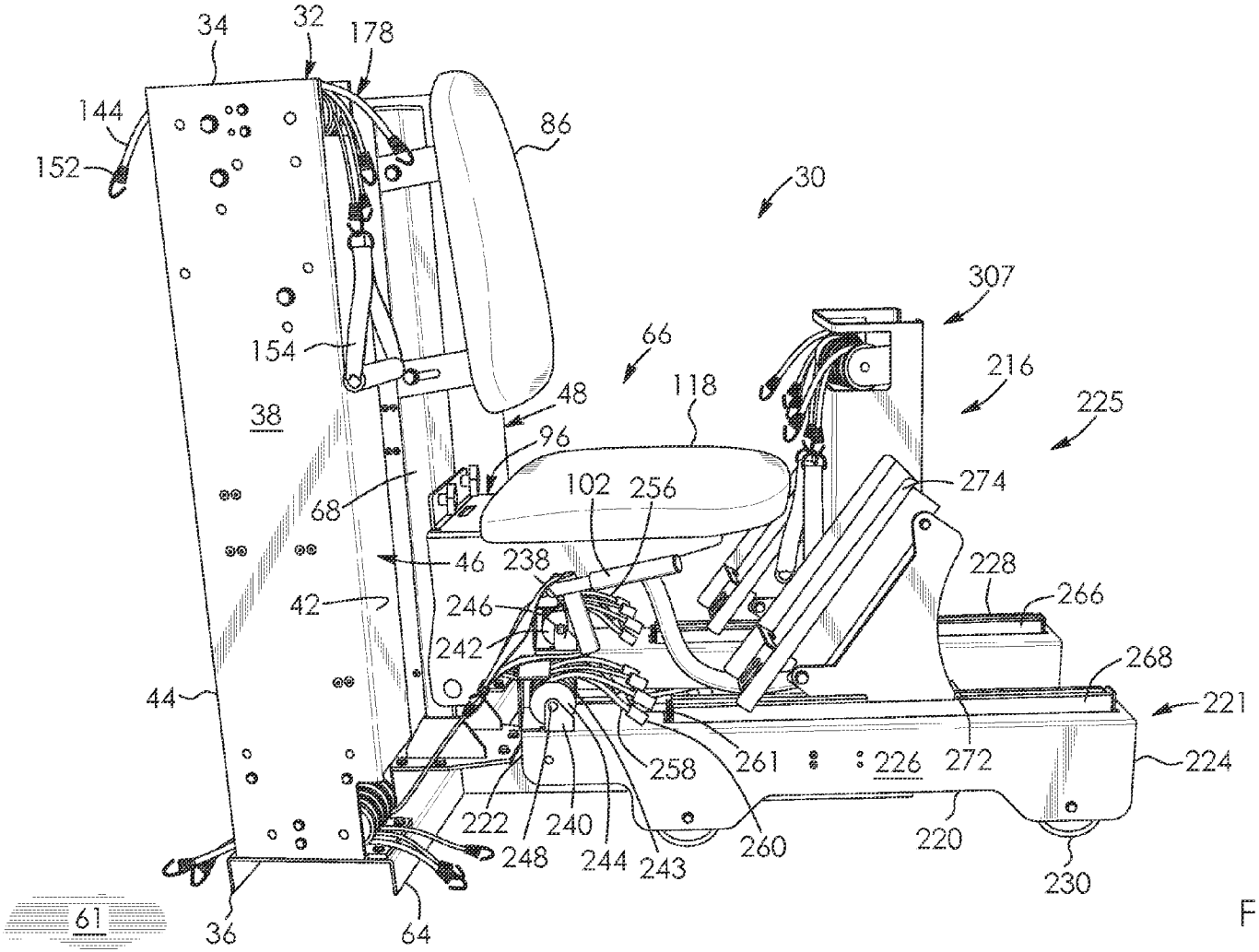
FIG. 16 is a side perspective view of the exercise machine of FIG. 1 in a retracted position.

The horizontally-extending mounting assembly 221 includes a pair of top pulley mounts 238 and 240 connected to the top 218 of the assembly on the brackets 229 and 231 at end 222 of the assembly in this example. The leg press module 225 comprises a pair of lower pulleys assemblies 242 and 244, as seen in FIG. 16, that rotatably connect to mounts 238 and 240 via pivot rods 246 and 248. Each pulley assembly comprises a number of adjacent pulleys having a common rotating drum in this example. Each of the pulley assemblies has a plurality of spaced-apart annular grooves, as shown in FIG. 17 by groove 243 for pulley assembly 244.

As seen in FIG. 18, the horizontally-extending mounting assembly 221 includes a pair of bottom pulley mounts 267 and 269 by the bottom 220 of the assembly 221. Each of the pulley mounts 267 and 269 is in the form of the spaced-apart sides of brackets 231 and 229 located at end 222 of the assembly 221. The leg press module 225 comprises a further pair of lower pulley assemblies 279 and 281 that rotatably connect to mounts 267 and 269 via pivot rods 289 and 299. Each pulley assembly comprises a number of adjacent pulleys. Each of the pulley assemblies has a plurality of spaced-apart annular grooves, as shown in by groove 291 for pulley assembly 281.

Figure 19:
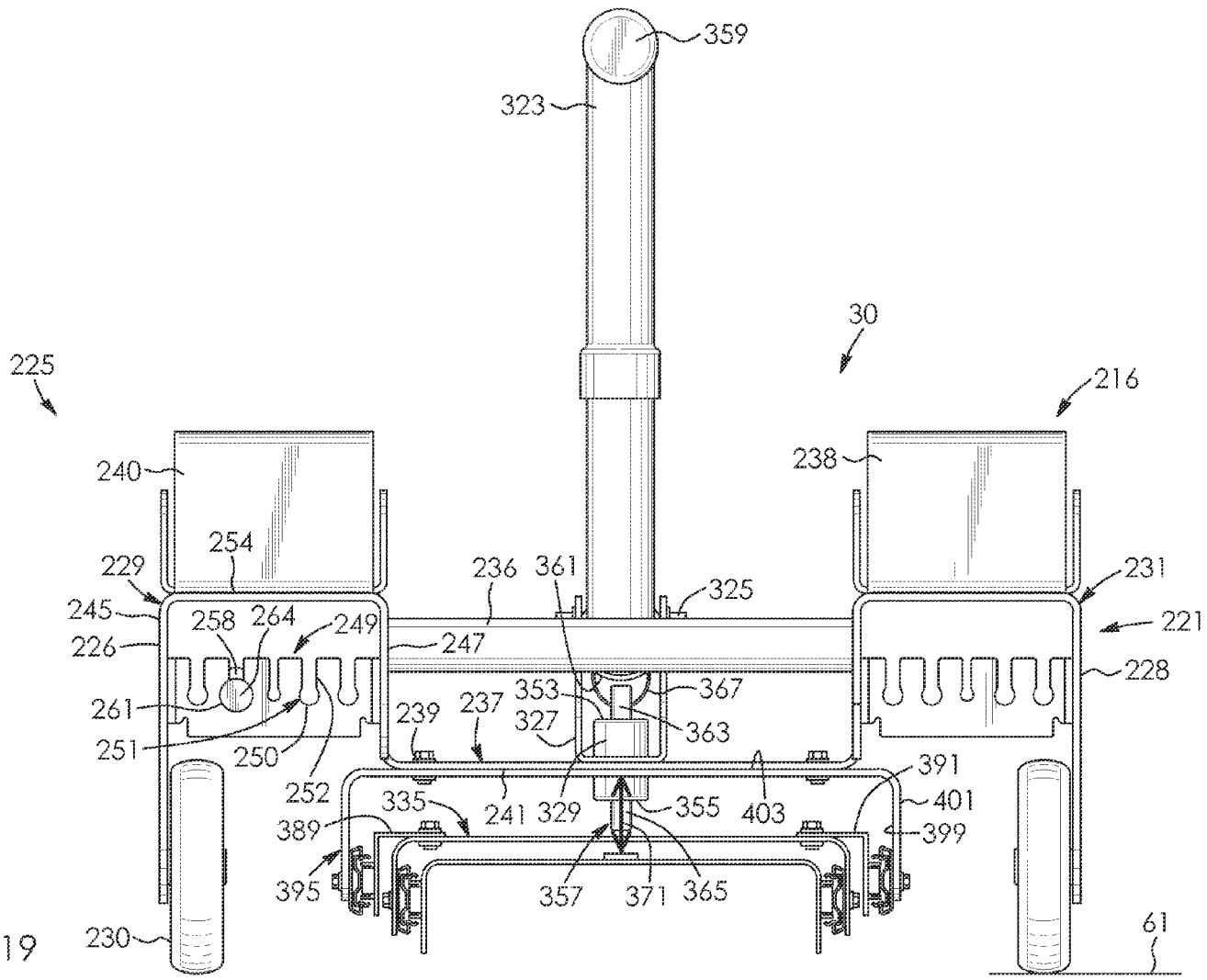
FIG. 19 is an end view of the moveable carriage of FIG. 18 including wheels rotatably mounted thereon.

Referring to FIG. 19, each of brackets 229 and 231 has a cable mount that connects to and extends between the opposite sides thereof, as seen by cable mount 249 extending between sides 245 and 247 of bracket 229. Each cable mount includes a plurality of spaced-apart slots extending therethrough, as shown by slot 251. Each slot has an enlarged circular portion 250 and a slotted portion 252 extending radially outwards from the circular portion.

Referring to FIG. 16, the leg press module 225 comprises a first and a second plurality of exercise resistance cables 256 and 258 which fit within respective ones of the grooves 243 of the pulley assemblies 242 and 244. The cables may have a plurality of different stretch resistance properties. They each have distal end portions that extend outwards from the pulley assemblies, as shown by end portions 260 for cables 258. The exercise machine 30 includes a plurality of protrusions, in this example cylindrical knobs 261 which are connectable to the distal end portions 260 of the cables 256 and 258. The cables 256 and 258 have proximal end portions that fixedly connect to respective ones of the brackets 229 and 231 via cable mounts 249, as shown by proximal end portion 264 of cable 258 as shown in FIG. 19. Slotted portions 252 are shaped to receive the cables. The proximal end portion of each cable has a knob 264 that abuts mount 249 upon the cable being inserted past slotted portion 252 to circular portion 250. The knobs 261 and cable mounts 249 with their slots may collectively be referred to as a cable connector mechanism.

The cables 256 and 258 thus extend from their fixed proximal end portions and outwards around pulley assemblies 279 and 281, seen in FIG. 18. Assemblies 279 and 281 thus redirect the cables to the cable mount 249. As seen in FIG. 18, the cables next extend through apertures 293 and 295 of brackets 229 and 231 which are located adjacent to end 222 of the assembly 221, and extend around pulley assemblies 242 and 244 seen in FIG. 16.

Referring to FIG. 18, the leg press module 225 comprises a pair of upper sliding rails 266 and 268 upon which a pair of sliders 270 and 272 slidably engage. The rails extend from end 224 of assembly 221 towards end 222 and are disposed on top 254 of the brackets 229 and 231, respectively. Rails 266 and 268 in this example each have elongate grooves 273 that engage with corresponding elongate protrusions 275 of the sliders. Rails and sliders per se are well known to those skilled in the art and thus rails 266 and 268 and sliders 270 and 272 will not be described further.

Figure 12:
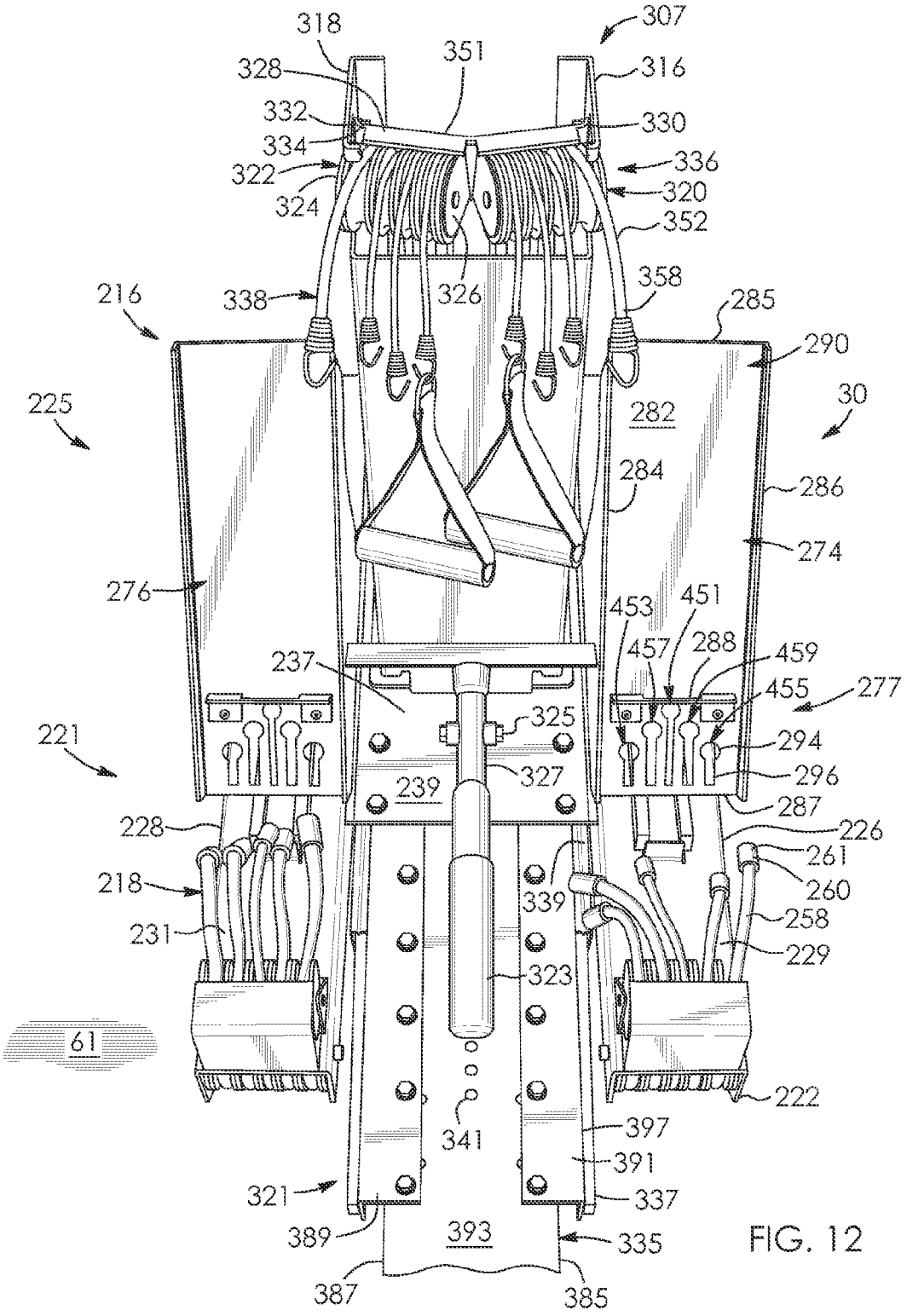
FIG. 12 is a top perspective view of a moveable carriage of the exercise machine of FIG. 1, and foot-engaging members and a further upright mounting assembly connected thereto.
Figure 13:
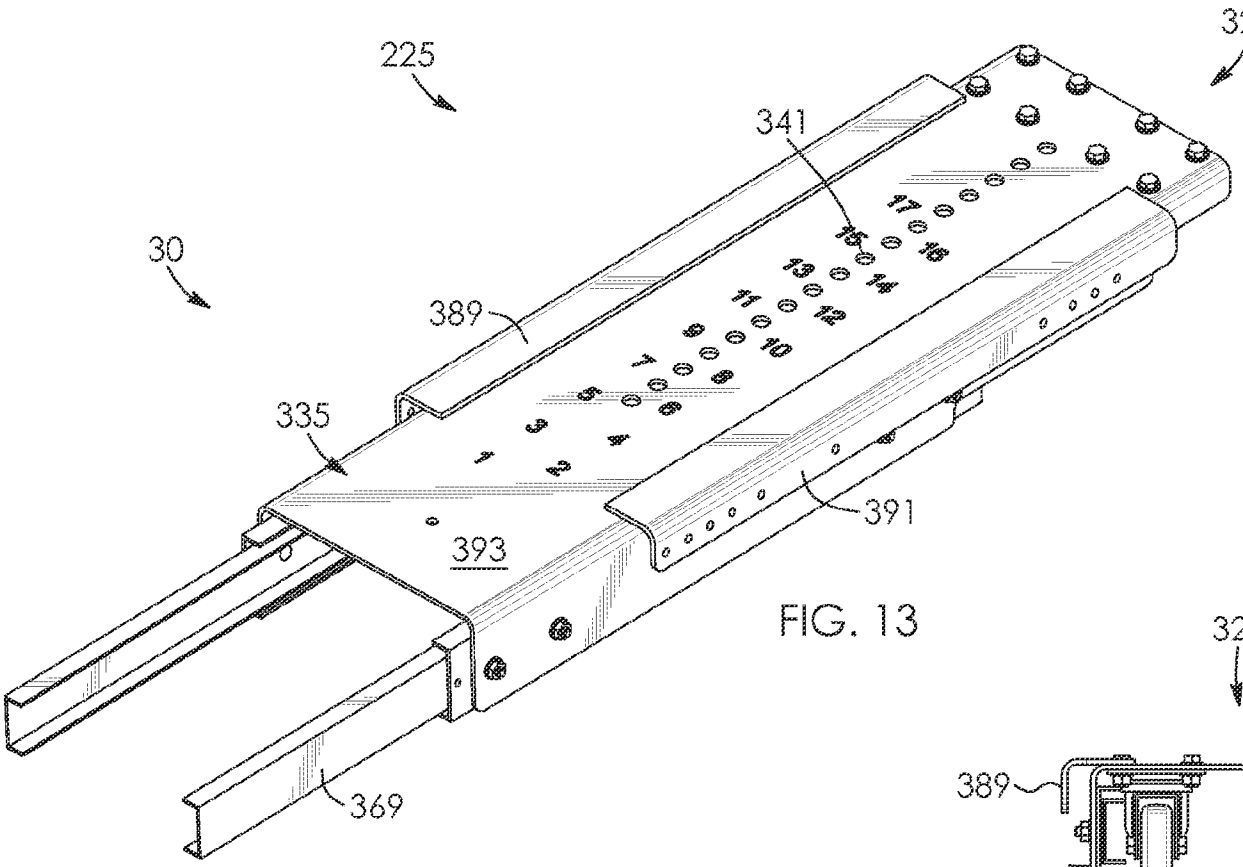
FIG. 13 is a top perspective view of a position adjustment mechanism for the exercise machine of FIG. 1.
Figure 20:
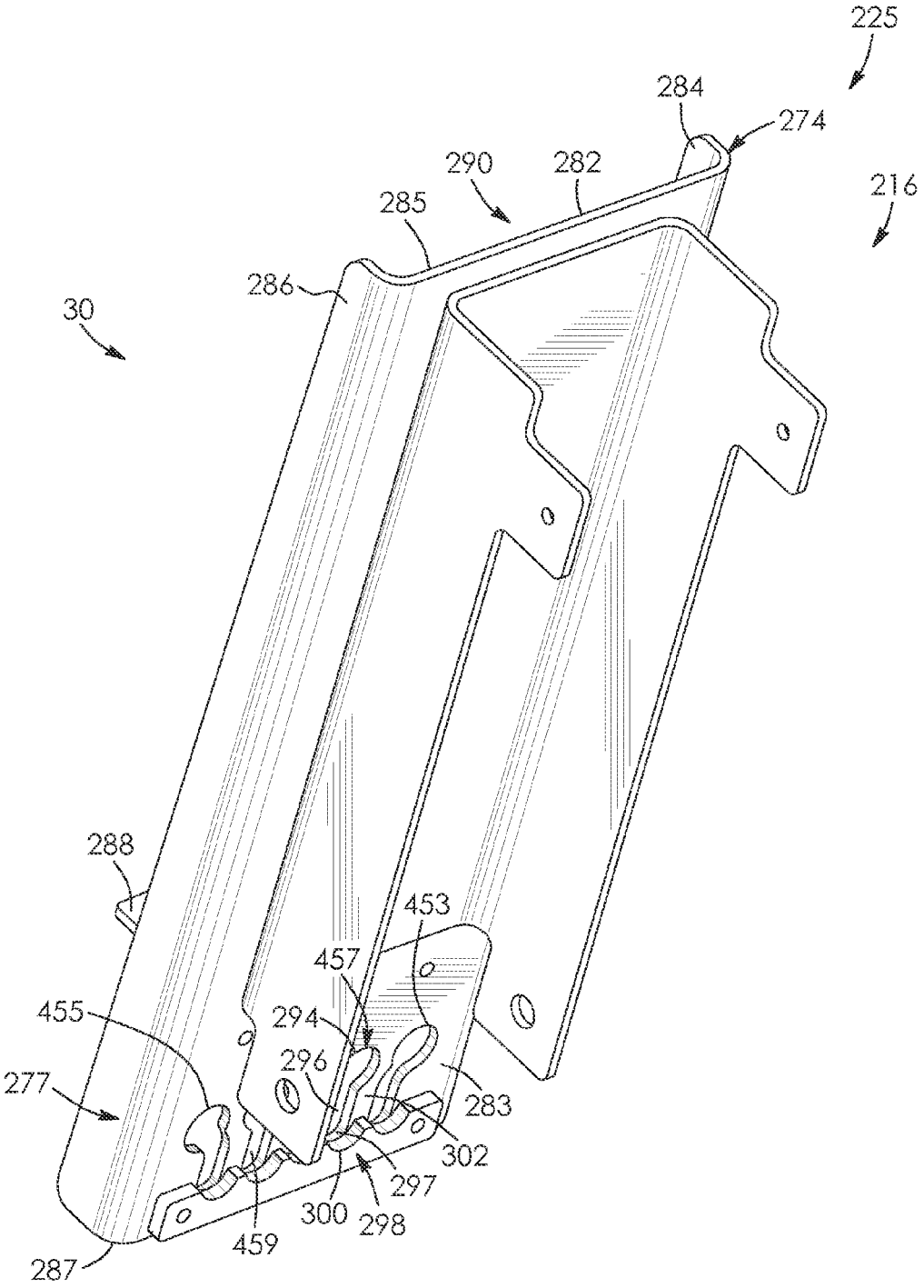
FIG. 20 is a rear perspective view of a foot-engaging member of the moveable carriage.
Figure 22:
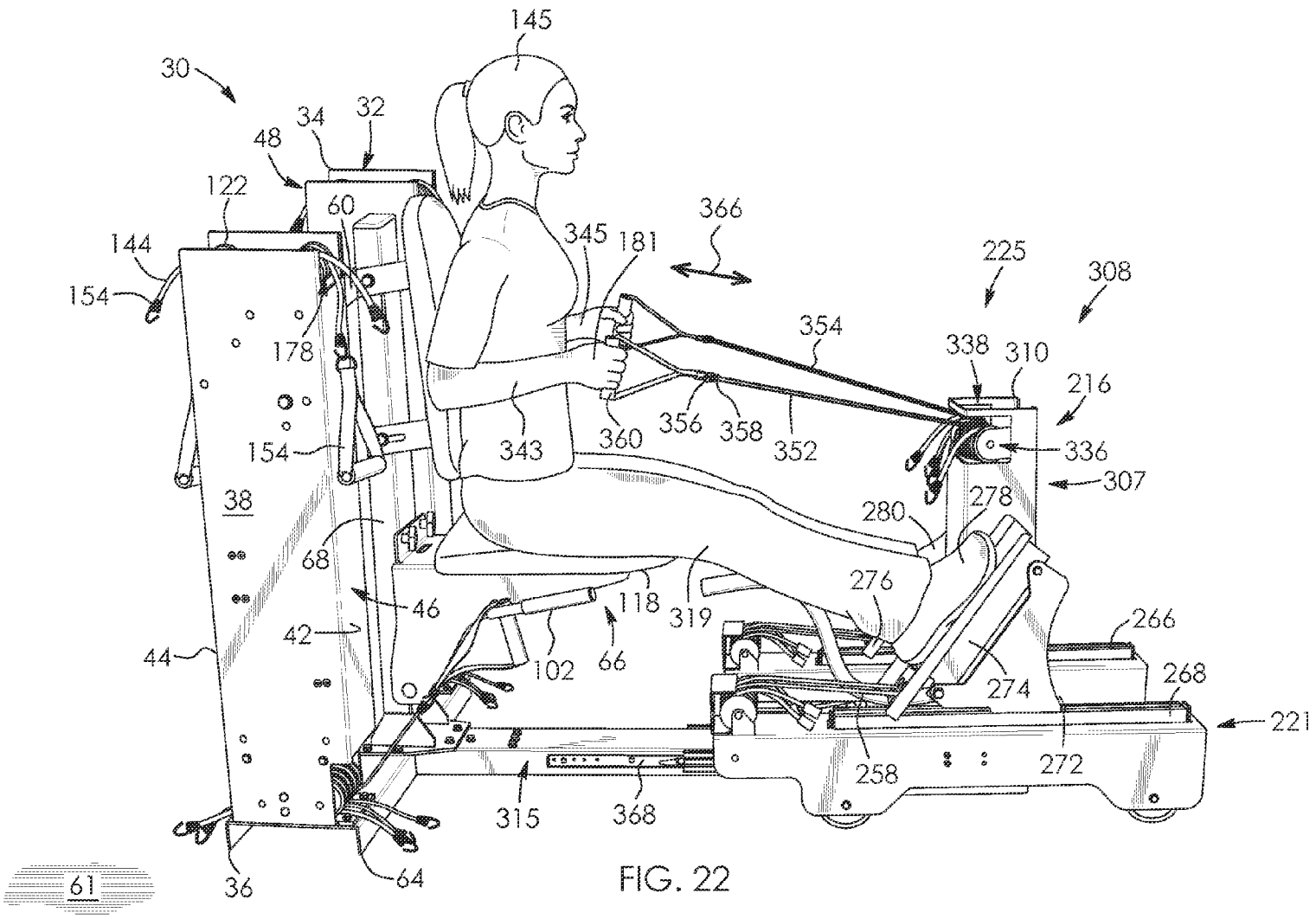
FIG. 22 is a side perspective view of the exercise machine similar to FIG. 21, with the user performing back exercises by selectively pulling rearwardly cables extending from upper pulley assemblies of the upright mounting assembly of FIG. 12.

Referring to FIG. 12, the leg press module 225 of the exercise machine 30 comprises a pair of foot-engaging members 274 and 276 operatively connected to the top 218 of the horizontally-extending mounting assembly 221 along brackets 229 and 231, respectively, as seen in FIG. 17. The foot-engaging members are shaped to receive the feet 278 and 280 of user 145 as seen in FIG. 22. As seen in FIGS. 12 and 20, each foot-engaging member, as shown by member 274, is generally in the shape of an elongate u-shaped bracket in this example. Each member 274 has a front 282, a rear 283 seen in FIG. 20 opposite the front, a pair of spaced-apart side portions 284 and 286, a top 285, a bottom 287 that is spaced-apart from the top, and a heel portion 288 extending between the side portions 284 and 286. The side and heel portions extend outwards from front 282. Front 282, side portions 284 and 286 and heel portion 288 form a partial enclosure 290 for receiving a user's foot. The heel portion 288 is positioned adjacent to bottom 287. Top 285 and bottom 287 extend between side portions 284 and 286 in this example.

Referring to FIG. 12, each foot-engaging member 274 includes a cable mount 277 positioned adjacent to its bottom 287 in this example. The cable mounts are integrally connected to and are integrally formed with the foot-engaging members in this example. Each cable mount 277 includes a plurality of spaced-apart slots including a central slot 451 which is centrally disposed between side portions 284 and 286, outer slots 453 and 455 which are adjacent to side portions 284 and 286, respectively, and intermediate slots 457 and 459 interposed between the outer and central slots, respectively. Each slot is adjacent to bottom 287 of member 274. Each slot, as seen by slot 455, has an enlarged upper end or circular portion 294 and a slotted portion 296 radially extending outwards from the circular portion towards bottom 287. Slotted portions 296 are shaped to receive the cables 258 seen in FIG. 12. The slotted portions 296 have lower ends 297, as best seen in FIG. 20, which are spaced-apart from the circular portions 294. The circular portion of central slot 451 is spaced-apart above the circular portions of the other slots in this example.

Each foot-engaging member 274 further includes a support member 298 operatively connected to the cable mount 277 at the rear 283 and bottom 287 of the foot-engaging member 274. Each support member has a plurality of spaced-apart recesses 300 positioned to align with and be in communication with respective ones of the slotted portions 296 of slots 451, 453, 455, 457 and 459. The recesses 300 are shaped to receive and support respective ones of the knobs 261, seen in FIG. 12, when the cables 258 are within the slotted portions 296 of the slots of the cable mount 277.

As seen in FIG. 17, the leg press module 225 includes a pair of u-shaped brackets 304 and 306 which connect foot-engaging members 274 and 276, respectively to sliders 272 and 270. Each bracket has a base 117 which is coupled to respective ones of the sliders 270 and 272 via fasteners 119. Each bracket also includes a pair of spaced-apart sides 121 and 123 which are triangular in shape in this example. Sides 121 and 123 extend upwards from base 117 and operatively couple to rear 283 of the respective foot-engaging member 274 adjacent to sides 284 and 286 thereof. The brackets 304 and 306 are shaped to position the foot-engaging members so that they face seat assembly 66 and are angled relative to top 218 of the horizontally-extending mounting assembly 221.

In operation and referring to FIG. 12, the user selects her desired resistance for the workout by placing one or more knobs 261 of the cables 258 into respective circular portions 294 of slots 451, 453, 455, 457 and 459. She then pushes the cables downwards within slotted portions 296 until knobs 261 abut respective ones of recesses 300, seen in FIG. 20, as well as portions 302 of the cable mount 277 adjacent to said slotted portions 296. The process may be reversed or adjusted accordingly to alter the desired workout resistance. The support members 298 seen in FIG. 20 are shaped to inhibit cables 258 from abutting and rubbing against ends 297 of slotted portions 296 of the slots 451, 453, 455, 457 and 459 and thus are shaped to inhibit wear and premature failure of the cables. Knobs 261, cable mounts 277 with their slots, and support members 298 are collectively be referred to as a cable connector mechanism.

Figure 21:
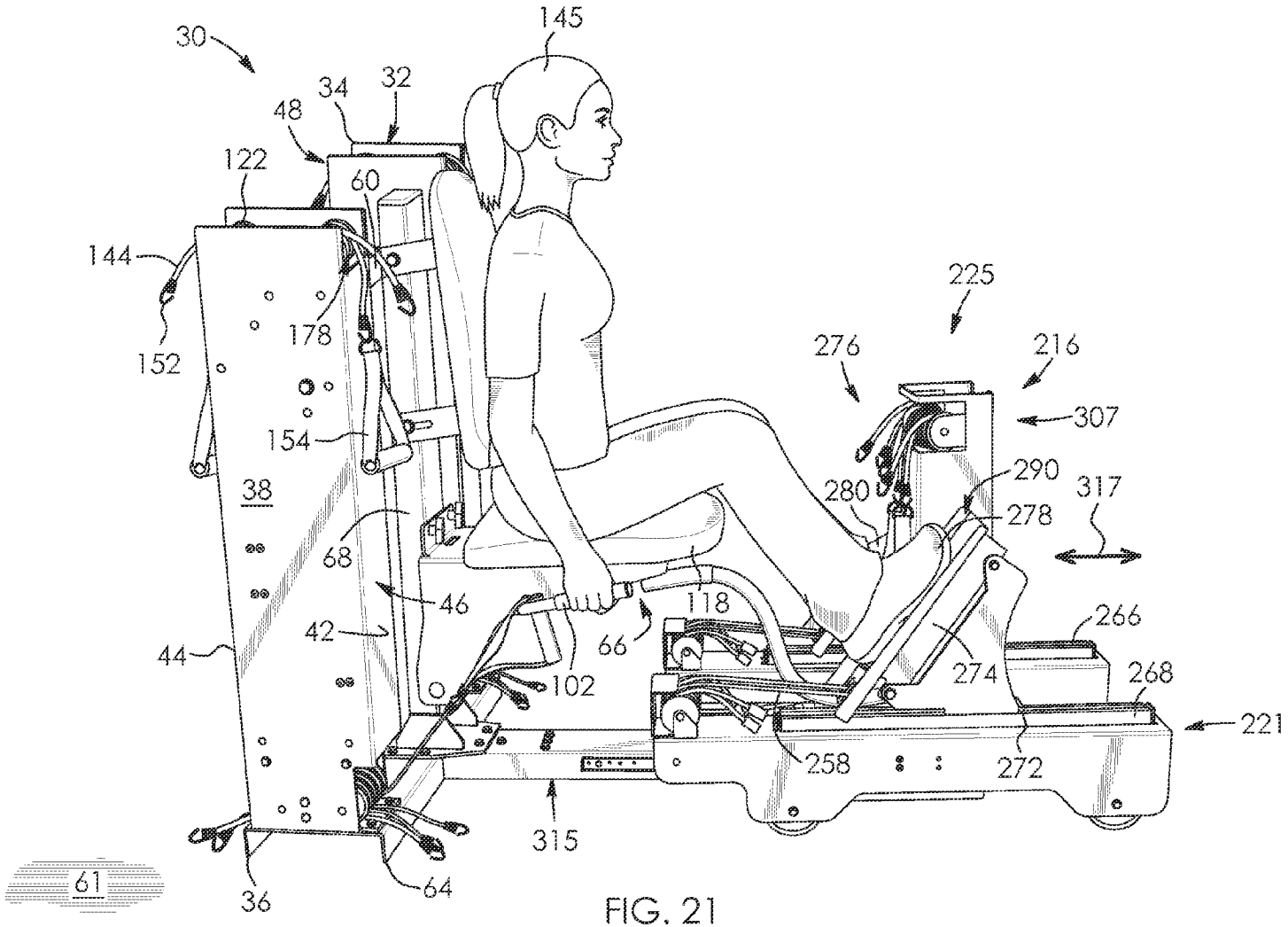
FIG. 21 is a side perspective view of the exercise machine of FIG. 1, with a user placing her feet on the foot-engaging members.

Referring to FIG. 21, the leg press module 225, with its sliders 272, enables the user 145 to place her feet 278 and 280 within enclosures 290 of the foot-engaging members 274 and 276 and push horizontally thereon, as shown by arrow 317, in order to selectively exercise her quadriceps. The sliders enable the foot-engaging members to move from a retracted position seen in FIG. 21 to an extended position seen in FIG. 22, in which the cables 258 are stretched outwards by the user's legs 319.

Referring to FIG. 17, upright mounting assembly 307 of carriage 216 includes an upright housing 310 that is a vertically-extending, rectangular prism in this example. The housing has a top 312, a bottom 314 that is spaced-apart from the top, a pair of spaced-apart sides 316 and 318, a front 303 and a rear 305 opposite the front. Bottom 314 connects to top 239 of mounting plate 237 of the horizontally-extending mounting assembly 221 via fasteners 309, in this example. The sides 316 and 318, front 303 and rear 305 extend from the bottom 314 to the top 312 of the housing 310. Front 303 of the housing faces the seating assembly 66 in this example. The housing 310 is interposed between brackets 229 and 231 of horizontally-extending mounting assembly 221 and between foot-engaging members 274 and 276 in this example. It is positioned between ends 222 and 224 of horizontally-extending mounting assembly 221 in this example.

The vertically-extending mounting assembly 307 has a first mounting bracket 320 and a second mounting bracket 322 angled relative to the first mounting bracket. Each bracket has a pair of spaced-apart side members connected together by a base member, as seen by side members 324 and 326 and base member 328 for bracket 322 in FIG. 12. The vertically-extending mounting assembly 307 includes a V-shaped bracket 351 best seen in FIG. 17. Referring to FIGS. 12 and 17, bracket 351 has distal flanged ends 330 and 332 that connect to sides 316 and 318 of housing 310 via fasteners 334, in this example. Brackets 320 and 322 are fastened to respective angled portions of v-shaped bracket 351 and positioned adjacent to top 312 of the housing 310. Bracket 351 causes brackets 320 and 322 to be angled outwards. Brackets 320 and 322 are thus positioned to face housings 46 and 48, respectively, seen in FIG. 1.

Referring to FIG. 17, the exercise machine 30 includes a fifth cable mounting assembly 336 for upper cables and a sixth cable mounting assembly 338 for upper cables. The assemblies have upper pulley assemblies 340 and 342 rotatably mounted to brackets 320 and 322, respectively. Each of the pulley assemblies comprises a number of adjacent pulleys connected together via common drums in this example. Bracket 351 is shaped to angle the pulley assemblies outwardly towards the arms 343 and 345 of the user 145, as seen in FIG. 22. In one example, brackets 320 and 322 are thus outwardly angled relative to each other by an angle $\alpha$ seen in FIG. 17 that is substantially equal to 15 degrees, though this is not strictly required and the degree of angular separation may be different in other embodiments.

Still referring to FIG. 17, the assemblies 336 and 338 include a pair of lower pulley assemblies 344 and 346, respectively. Each of the pulley assemblies 340, 342, 344 and 346 comprises a number of adjacent pulleys and has a plurality of spaced-apart annular grooves, as shown by groove 348 for pulley assemblies 342. Pulley assemblies 344 and 346 are positioned adjacent to bottom 314 of the housing 310 and rotatably connect to the housing via a pivot rod (not shown) that extends between sides 316 and 318 of the housing. The assemblies 336 and 338 include a cable mount 349 that extends between the sides of the housing 310. The cable mount is positioned between the upper and lower pulley assemblies. The cable mount 349 has a plurality of spaced-apart slots 350 with circular portions and slotted portions extending radially outwards therefrom in a manner substantially similar to slots 451, 453, 455, 457 and 459 for cable mount 277 shown in FIG. 12. This will therefore not be described in further detail.

The exercise machine 30 includes a fifth plurality of upper spaced-apart elastic exercise resistance cables, as shown by cable 352, connected to and associated with the fifth cable mounting assembly 336 for upper cables. The exercise machine includes a sixth plurality of upper spaced-apart elastic exercise resistance cables, as shown by cable 354, connected to and associated with the sixth cable mounting assembly 338 for upper cables. Each cable has a distal end portion with a connector, in this example a hook, as shown by hook 356 on distal end portion 358 of cable 352. The hooks are shaped for connecting with handles, as shown by handle 360 in FIG. 22. Referring back to FIG. 17, each cable has a proximal end portion 362 connected to the cable mount 349 within respective ones of the slots 350 via protrusions or knobs 361.

The cables 352 and 354 thus connect to the cable mount 349, extend around the lower pulley assemblies 344 and 346, respectively, extend around the upper pulley assemblies 340 and 342, respectively, and extend outwards therefrom. The cables have distal end portions 358 that extend outwards from housing 310 and extend towards the seat assembly 66 in this example.

In operation and as seen in FIG. 22, housing 310, assemblies 336 and 338 and cables 352 and 354 enable back exercises to be performed. Upon selecting a desired cable resistance, the user 145, while seated on seat 118, holds handles 360 with her hands 181 and pulls the handles rearwards, as seen by arrow 366, stretching the cables thereby. The user's legs 319 may be extended during this time.

As seen in FIG. 12, the exercise machine 30 includes a position adjustment mechanism 321. Referring to FIG. 18, the mechanism includes a locking member in the form of an arcuate-shaped handle 323 that is pivotally mounted to the top 239 of mounting plate 237 via a pivot pin 325 and u-shaped bracket 327 to which the pin is mounted. The handle has a first or gripping end 359 and a second or actuating end 361 spaced-apart from the first end. The first end of the handle 323 is spaced-apart from bracket 327. The handle pivotally connects to bracket 327 at a location adjacent to actuating end 361. Thus, the handle functions as a lever, with movement of first end 359 of the handle 323 providing mechanical leverage for facilitating upward and downward movement of second end 361 of the handle.

The machine 30 includes a pin housing 329, best seen in FIG. 19. The pin housing is hollow and generally cylindrical in shape in this example. The housing 329 extends through mounting plate 237 via aperture 331 seen in FIG. 18 and is welded to the mounting plate in this example. As seen in FIG. 19, a spring-loaded pin 357 extends through the housing 329 and is spring-biased to extend downwards relative to the housing. The pin has a pair of spaced-apart ends 363 and 365 that extend outwards from opposite upper and lower ends 353 and 355 of the housing 329 as seen in FIG. 19. End 363 of the pin 357 is positioned adjacent to the second end 361 of the handle 323. End 363 of the pin operatively connects to actuating end 361 of the handle in this example via a pair of elongate members, in this example cable 367. End 365 of the pin is positioned downwards from the housing 329. The pin is spring-biased so that its end 365 is biased downwards from housing 329, in this example via a compression spring within the housing which biases against the pin.

Figure 15:
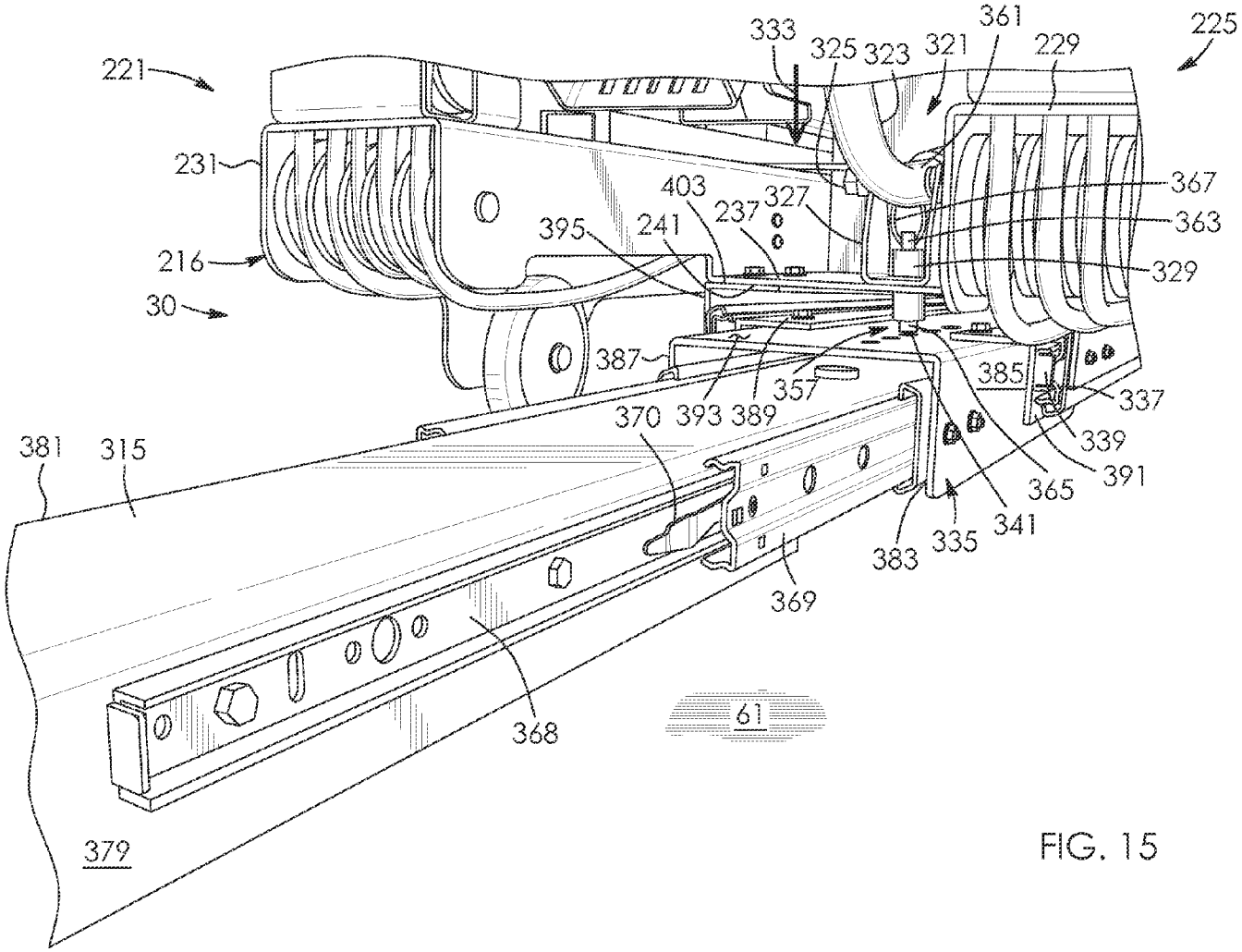
FIG. 15 is a fragmentary, perspective view of part of the position adjustment mechanism of FIG. 15 and part of the carriage of FIG. 12.

End 365 of the pin 357 selectively extends through one of apertures 341 of bracket 335 seen in FIGS. 12 and 15 after positioning of the machine 30 has been adjusted. As seen in FIG. 1, the handle 323 is shaped to curve towards the seat assembly 66 so as to bias downwards via gravity. Pushing end 359 of the handle downwards in the direction of arrow 333 seen in FIG. 18 causes end 361 of the handle to move upwards, countering the downward spring-bias of the pin 357, and causing pin 357 to raise upwards, as shown by arrow 371. In this example, spring-loaded pin 357 is an off-the-shelf product that may be purchased at Fixtureworks, which has an address of 33792 Doreka Drive, Fraser, Mich., 48026, USA. Spring-loaded pins per se, including their various parts and functionings, are well known to those skilled in the art and therefore will not be described in further detail.

Figure 14:
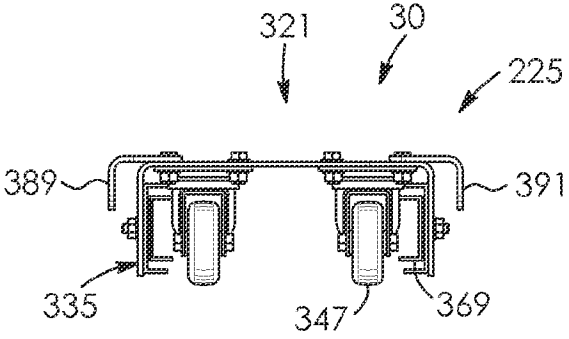
FIG. 14 is an end view of the position adjustment mechanism of FIG. 13 together with wheels rotatable mounted thereto.

As seen in FIG. 15, the position adjustment mechanism 321 includes an inner elongate bracket 335, which is u-shaped in profile. As seen in FIG. 14, the machine 30 has a plurality of spaced-apart inner wheels, as shown by wheel 347, rotatably coupled to and received within bracket 335. As seen in FIG. 15, the exercise machine 30 further includes a plurality of sliding rail brackets 368 and 369 that operatively connect assembly 32 to carriage 216. As seen in FIG. 1, the mounting assembly 32 has a linking member 315 that couples to and extends outwards from base 64. As seen in FIG. 15, bracket 335 is channeled to at least partially receive linking member 315. Rail brackets 368 connect to spaced-apart outer sides 379 and 381 of the linking member. Rail brackets 369 operatively connect to inner surfaces 383 of sides 385 and 387 of elongate bracket 335 seen in FIG. 15. Rails brackets 368 are slidably received by rails brackets 369. The sliding rail brackets are shaped for selectively moving the carriage 216 from a stored position, seen in FIGS. 16 and 17, in which the carriage 216 is positioned adjacent to the mounting assembly 32, to an extended position, seen in FIG. 22, in which the carriage is spaced-apart from the mounting assembly. As seen in FIG. 14, wheels 347 are mounted between rail brackets 369 in this example.

As seen in FIG. 15, the sliding rail brackets 368 and 369 have resilient latches 370. The latches are used to selectively disengage brackets 368 from brackets 369. Disengaging the sliding rail brackets is done by pressing latches 370 when assembling the machine or to remove the brackets from the machine, or to remove the carriage 216 from the rest of the machine. Sliding rail brackets per se are well known to those skilled in the art and therefore will not be described in further detail.

As seen in FIG. 12, the position adjustment mechanism 321 comprises a pair of spaced-apart, elongate L-shaped brackets 389 and 391 which couple to top 393 of inner bracket 335 adjacent to sides 385 and 387 thereof, respectively. As seen in FIG. 19, the position adjustment mechanism includes an outer bracket 395 that is u-shaped in this example and which is shaped to receive and extend around L-shaped brackets 389 and 391 seen in FIG. 12. The L-shaped brackets are slidably, operatively mounted to outer bracket 395, and thus connected to brackets 229 and 231 via sliding rails 337 and 339. As seen in FIG. 12, sliding rails 337 couple to outer sides 397 of L-shaped brackets 389 and 391. As seen in FIG. 15, sliding rails 339 are shaped to receive sliding rails 337 seen in FIG. 12. The sliding rails 339 of FIG. 15 are coupled to inner surfaces 399 of sides 401 of outer bracket 395. Sliding rails per se are well known to those skilled in the art and therefore will not be described in further detail. As seen in FIG. 19, outer bracket 395 has a top 403 coupled to bottom 241 of mounting plate 237 in this example.

Referring to FIG. 12, inner bracket 335 has a plurality of apertures 341 extending through top 393 thereof and through which pin 357 via its end 365 selectively extends, as seen in FIG. 19. As seen in FIG. 12, carriage 216 is thus selectively position adjustable via rails 337 and 339 to account for different body types and exercises. This adjustment is made by lowering end 359 of handle 323 and moving the position of the carriage as desired relative to mounting assembly 32 seen in FIG. 1. End 359 of the handle is then let go or raised, enabling pin 357 to spring-bias downwards so as to lock end 365 of the pin, seen in FIG. 15, within one of the apertures 341 seen in FIGS. 12 and 15. Handle 323 and bracket 335 act as a locking mechanism for selectively locking the position of the carriage 216 relative to the mounting assembly 32.

Referring to FIG. 1, the exercise machine 30 as herein described, using the leg press/back row section 372 of the machine, enables the user to perform leg presses, toe presses, back row exercises using various grips, internal rotation exercises, dorsi-flexion stretches, and various leg exercises for cardiovascular/muscular endurance. The machine, using the upper body training station (seated) section 374 of the machine, enables the user to perform chest presses, shoulder presses, tricep extensions, bicep curls, wrist curls, front raises, lateral raises, shrugs, external rotation exercises, proprioceptive neuromuscular facilitation (PNF) upper body exercises, abdominal crunches, seated marching, and upper body stretching. The rear of the machine, section 376, enables the user to perform body-weight squats, calf raises (calf blocks), step-ups (body-weight or resistance), hamstring exercises, adduction and abduction exercises, curls, shrugs, marching, balance stances (in tandem etc.), coordinated stepping and lower body stretching.

Upper pulley assemblies 122, 160, 176 and 180 of mounting assembly 32 seen in FIG. 5 may be referred to collectively as upper pulley assemblies. Lower pulley assemblies 184, 197, 203 and 208 seen in FIGS. 1 and 5 may be referred to collectively as lower pulley assemblies of the mounting assembly. The plurality of cables for each pulley system may be referred to collectively as the cables of the exercise machine.

FIGS. 23 to 52 show an exercise machine 30.1 according to a second aspect. Like parts have like numbers and functions as the exercise machine 30 shown in FIGS. 1 to 22 with the addition of decimal extension "0.1". Exercise machine 30.1 is substantially similar to exercise machine 30 shown in FIGS. 1 to 22 with the following exceptions.

Figure 23:
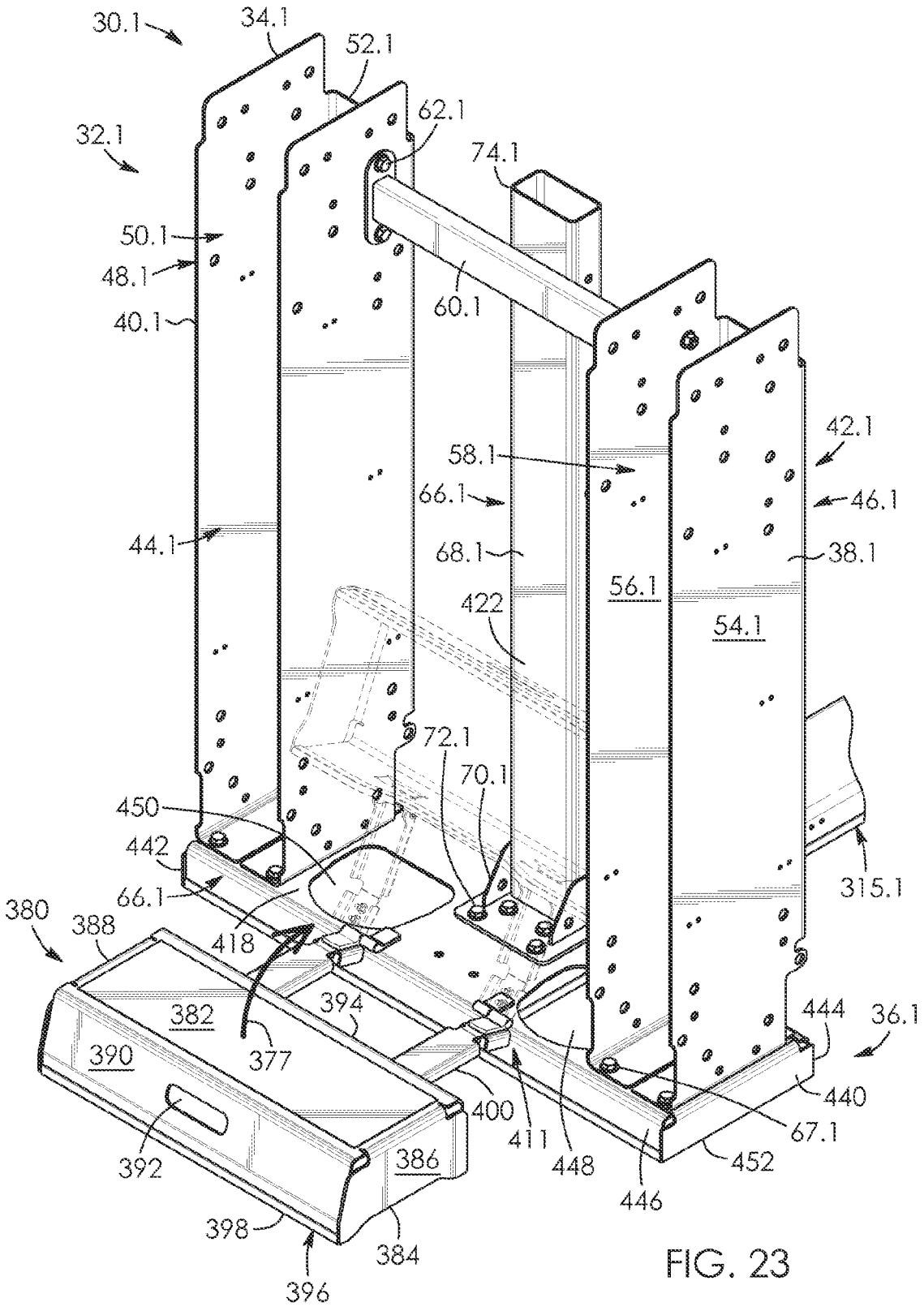
FIG. 23 is a rear, side perspective view of part of a mounting assembly, a seat assembly and a step block assembly of an exercise machine according to a second aspect, the step block assembly being shown in deployed and stored positions, the step assembly being shown in partially in ghost in the stored position.
Figure 24:
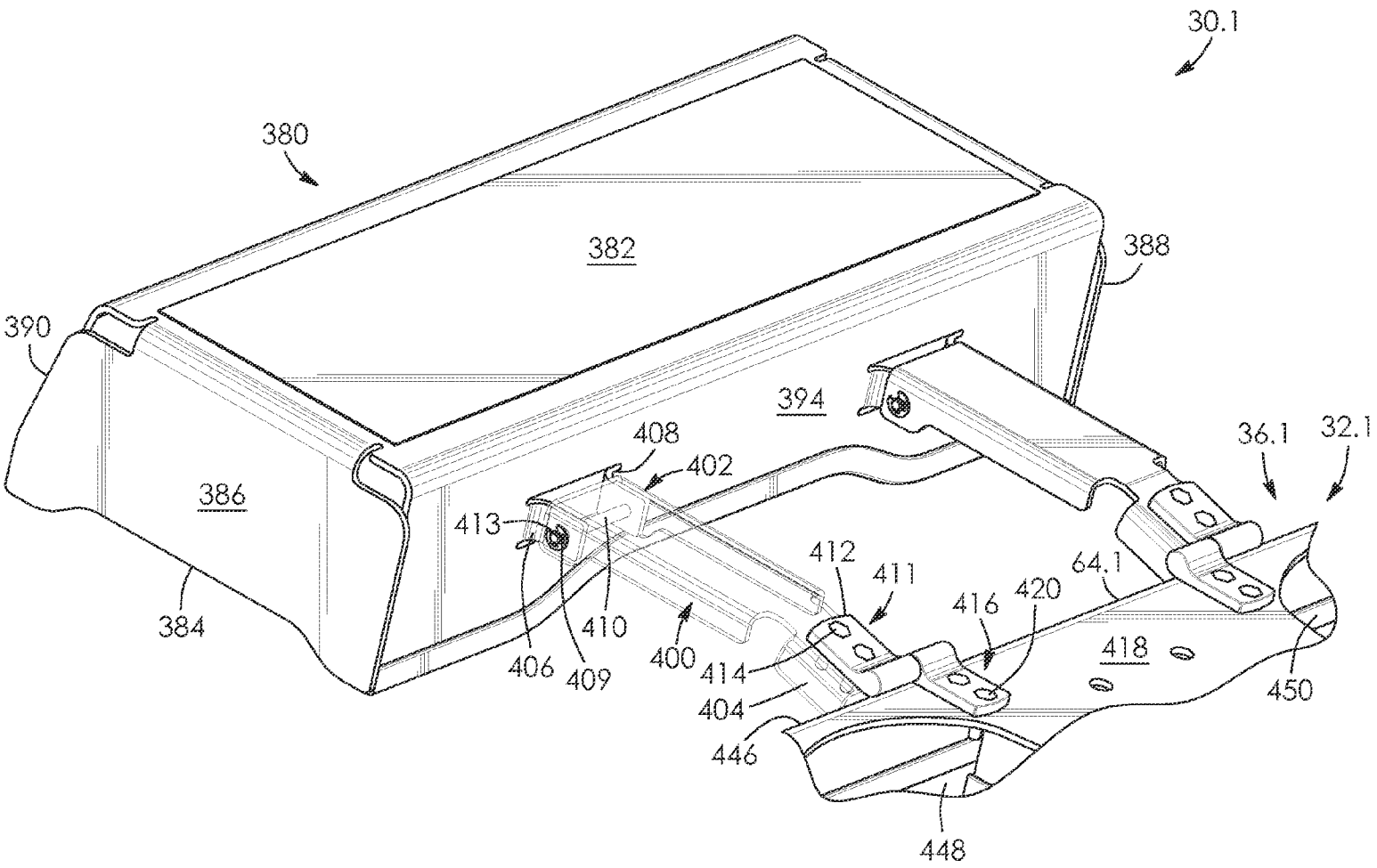
FIG. 24 is a top perspective view of the step block assembly of FIG. 23 in a deployed position.

As seen in FIGS. 23 and 24, exercise machine 30.1 includes an exercise step assembly 380 operatively connected to mounting assembly 32.1 at side 44.1 thereof. The step assembly is centrally disposed between housings 46.1 and 48.1 in this case. In this example, the step assembly is hollow and is substantially in the shape of a rectangular prism. The step assembly has a top 382 upon which a user may stand, an open bottom 384 opposite the top, a pair of spaced-apart sides 386 and 388, a front 390 through which an aperture 392 extends and a rear 394 opposite the front. The top, bottom, front and rear of the step assembly 380 extend between its sides. Sides 386 and 388, top 382 and bottom 384 extend between front 390 and rear 394 of the step assembly. Aperture 392 is shaped to receive a user's fingers therethrough. The assembly 380 includes trim, in this example vinyl edge trim extending along peripheral portions thereof at bottom 384 adjacent to front 390 and rear 394 thereof, as shown by trim 396 at peripheral portion 398 for front 390. FIG. 23 shows the step assembly 380 in solid lines in its deployed position where the assembly extends in a substantially horizontal direction.

As seen in FIG. 24, the step assembly 380 pivotally connects to the bottom 36.1 of the mounting assembly 32.1 in this example via a pair of spaced-apart brackets that are u-shaped in profile in this example, as seen by bracket 400. Each bracket has a first end 402 and a second end 404 which is opposite the first end. In this example, the step assembly has two pairs of spaced-apart tabs which extend from rear 394 thereof towards the mounting assembly 32.1. Brackets 400 extend about the tabs. Pivot rods extend between the tabs, as seen by tabs 406 and 408 and rod 410 for bracket 400. Ends 402 of the brackets pivotally connect to the rear 394 of the step assembly 380 via rods 410. Fasteners, in this example c-clips 409 connect to opposite ends 413 of the rods to hold the rods and brackets in place. Each bracket pivotally couples to the rear 394 of the assembly 380.

Ends 404 of the brackets 400 couple to the base 64.1 of the mounting assembly 32.1 in this example via constant torque hinges 411, first portions 412 of which couple to ends 404 of the brackets via fasteners 414 and second portions 416 of which couple to top 418 of the base, adjacent to the rear 446 of the base, via fasteners 420. The constant torques hinges are configured to require a substantially constant and equal amount of torque to move the step assembly 380 upwards or downwards regardless of its given position. Constant torque hinges, including their various parts and functionings, are known by those skilled in the art and therefore will not be described in further detail.

The step assembly 380 is moveable in the direction shown by arrow of numeral 377 from the deployed position shown in solid lines in FIG. 23 to a raised, stored position shown in ghost lines in FIG. 23 in which the assembly extends in a substantially vertical direction. In the stored position, sides 386 and 388 of the assembly are positioned adjacent to housings 46.1 and 48.1, respectively, and top 382 of the assembly abuts support bar 68.1 at a portion 422 thereof interposed between ends 70.1 and 74.1 thereof. The step assembly 380 aligns with and is adjacent to housings 46.1 and 48.1 and support 68.1 in the stored position.

Figure 25:
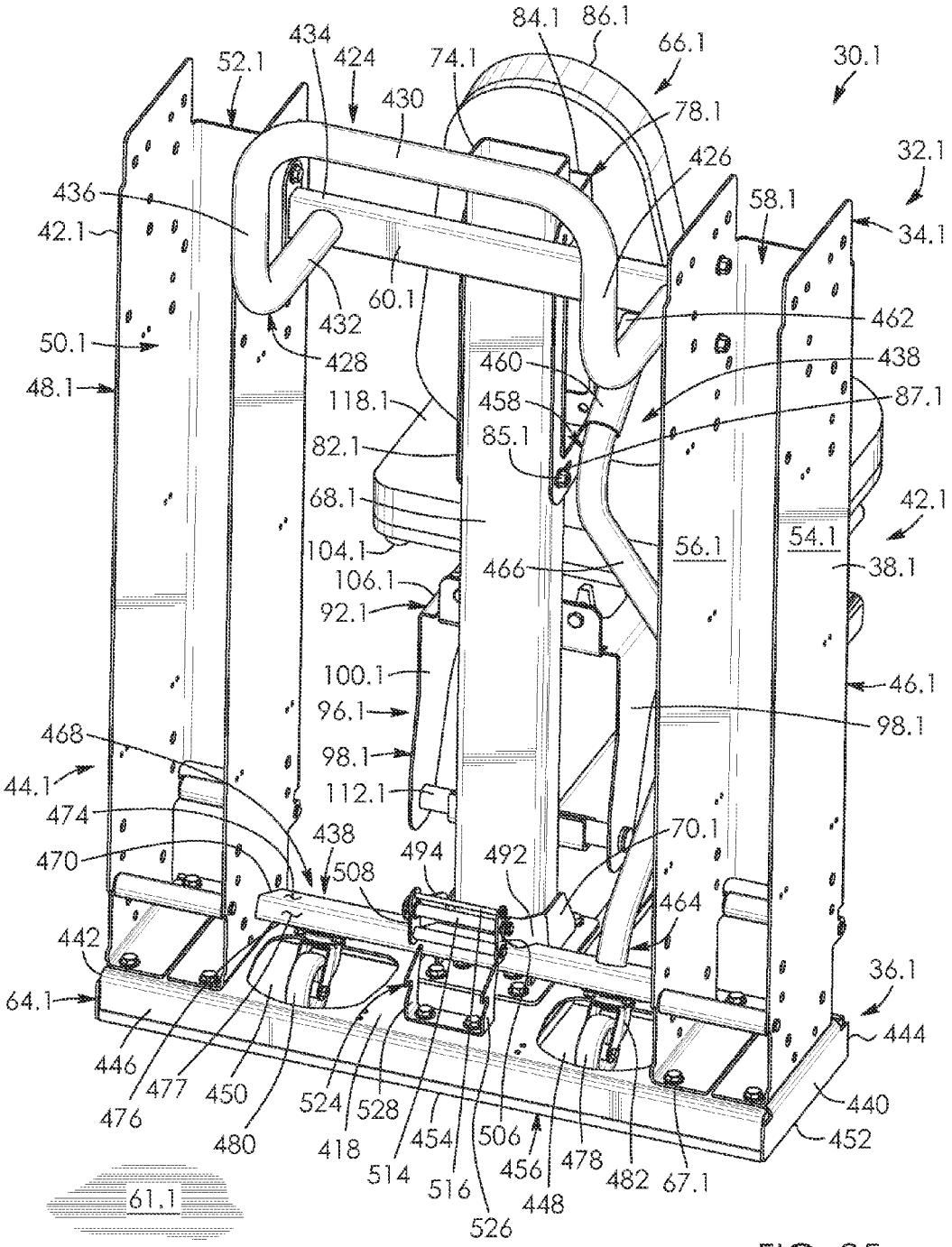
FIG. 25 is a rear, side perspective view of the part of the mounting assembly, a seat assembly and a caster system of the exercise machine of FIG. 23, the machine abutting the floor and the caster system having a lever arm with a handle in a first, forward position.
Figure 26:
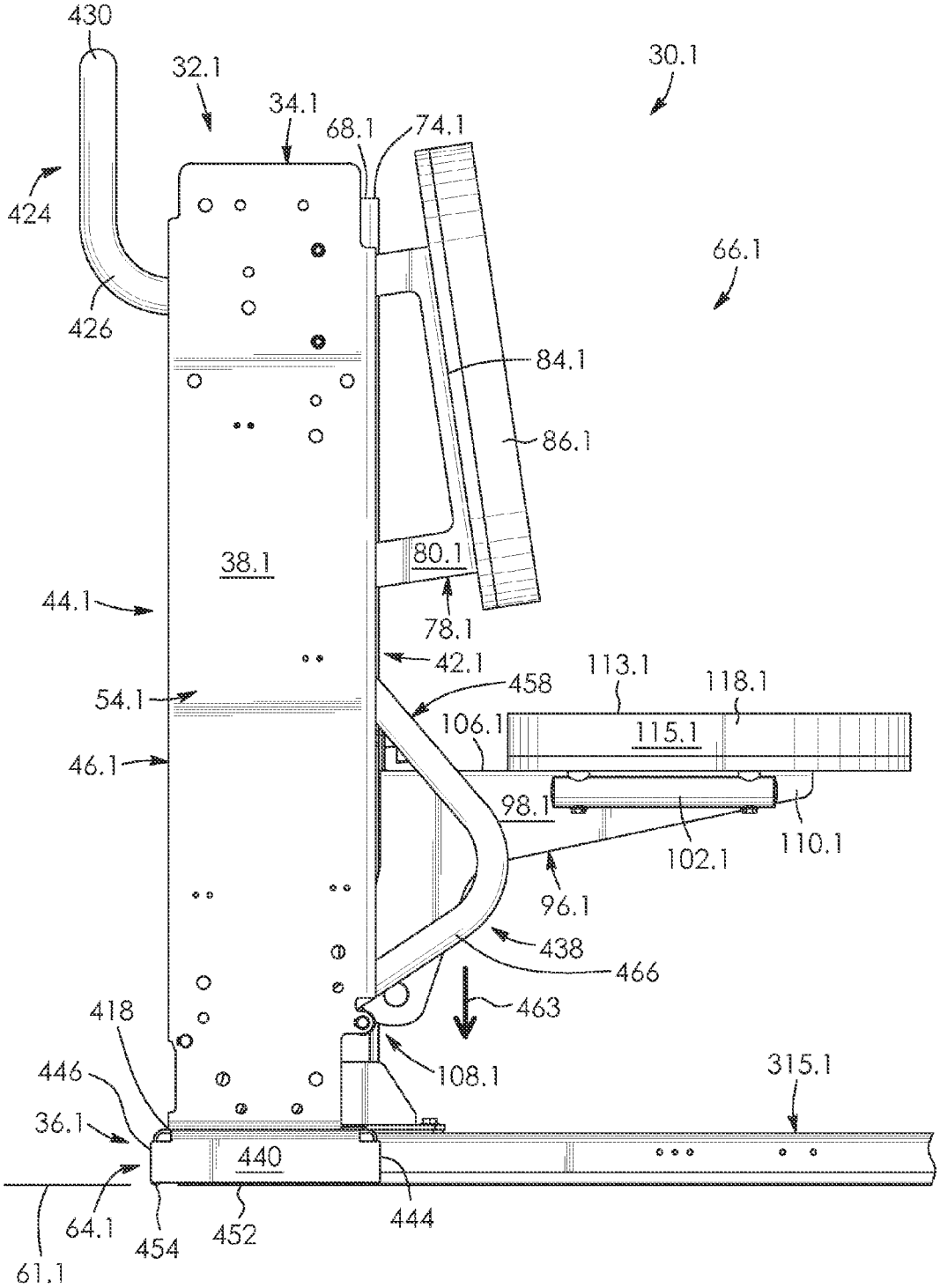
FIG. 26 is a side elevation view thereof.

As seen in FIG. 25, exercise machine 30.1 further comprises a handle bar 424 coupled to mounting assembly 32.1 at side 44.1 thereof. The handle bar may assist with certain exercises, such as balance exercises, abduction/adduction exercises, and squats, and it will be used to move the machine around. The bar is interposed and extends between housings 46.1 and 48.1. The bar in this example has a pair of spaced-apart L-shaped portions 426 and 428 that are coupled together via an elongate connector portion 430. Each L-shaped portion has a horizontally-extending part which connects to and extends from a respective one of the ends of crossbar 60.1 and a vertically-extending part coupled thereto connects to the connector portion 430. This is seen by horizontally-extending part 432 coupling to end 434 of crossbar 60.1 and vertically-extending part 436 coupled to and extending outwards from part 432 for L-shaped portion 426 of bar 424. Bar 424 is thus L-shaped in side profile as seen in FIG. 26 and inversely u-shaped in front profile as seen in FIG. 25 in this example. The bar may be used as a grip when performing exercises such as those seen in FIG. 10 for example.

As seen in FIGS. 25 to 34, machine 30.1 has a caster system 438 for selectively raising and moving the mounting assembly 32.1 and seating assembly 66.1 of the machine.

The system 438 is operatively connected to the base 64.1 of the mounting assembly, as seen in FIG. 25. The base is hollow and generally in the shape of a rectangular prism in this example. As seen in FIG. 25, base 64.1 has a pair of spaced-apart sides 440 and 442 which align with outer sides 54.1 of housings 46.1 and 48.1, respectively. The base 64.1 has a front 444, a rear 446 opposite thereof, and a closed top 418. A pair of spaced-apart apertures 448 and 450 extend through the top in this example. There is an open bottom 452 opposite the top. The sides, front, rear, top and bottom of the base are rectangular in this example. Front 444, rear 446, top 418 and bottom 452 extend between sides 440 and 442 in this example. Apertures 448 and 450 are interposed between and adjacent to inner sides 56.1 of housings 46.1 and 48.1, respectively, and extend between the front 444 and rear 446 of base 64.1. Trim, in this example vinyl edge trim extends along peripheral portions of the base at the front and rear of the base at the bottom 452 thereof, as seen by strip 454 at peripheral portion 456 of rear 446 in FIG. 28.

As seen in FIG. 25, the caster system 438 has a lever arm 458 with a handle 460 at a first end portion 462 thereof. The lever arm has a second end portion 464 opposite the first end portion and a counterbalancing, bent portion, in this example a v-shaped portion 466 interposed and extending between the first and second end portions of the arm.

Figure 27:
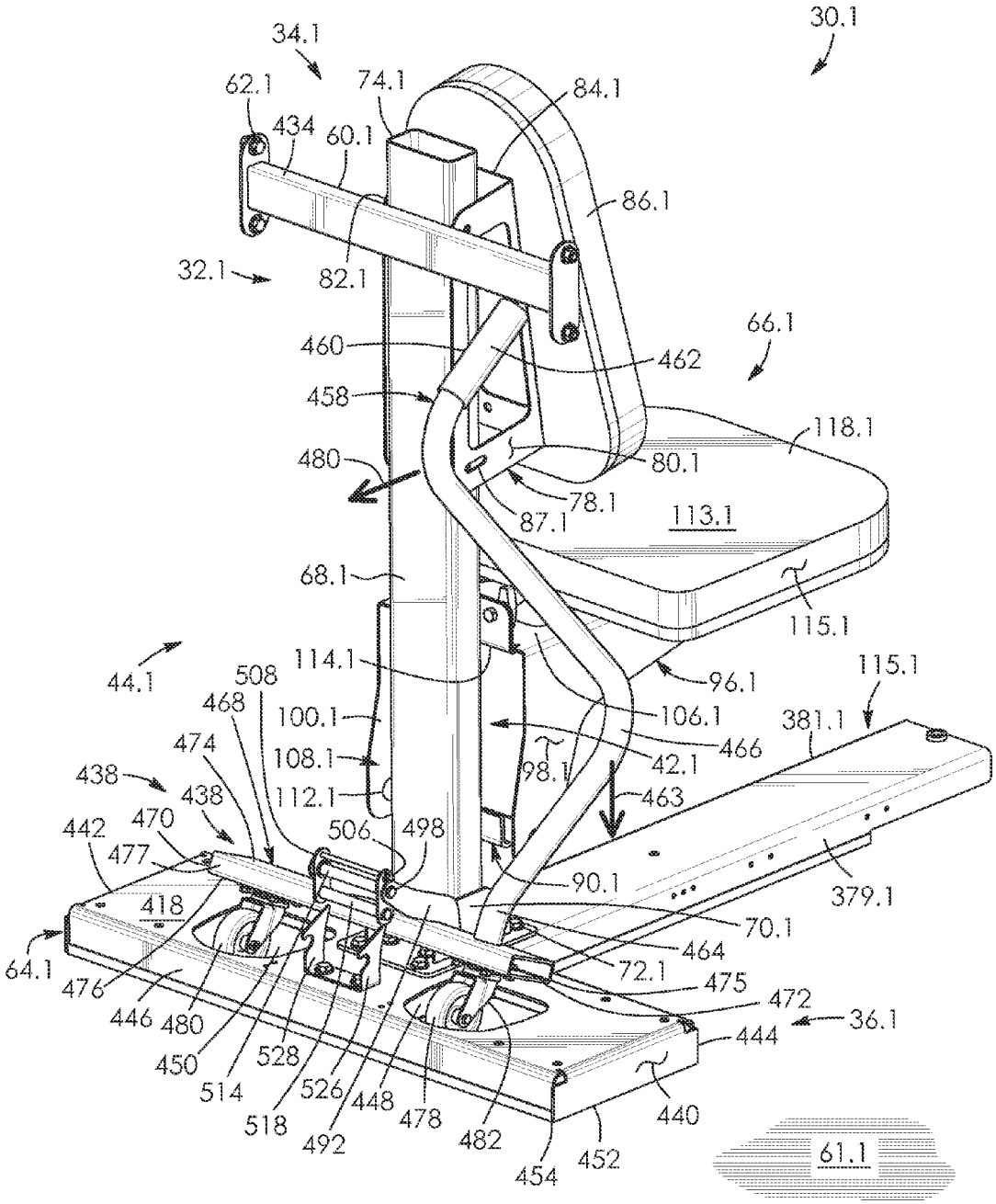
FIG. 27 is a rear, side perspective view thereof, with the housings of the mounting assembly being removed and not shown.

As seen in FIG. 27, the lever arm 458 has a protrusion, in this example an elongate support member 468 for casters. The support member is made of rectangular tubing in this example and extends perpendicularly outwards therefrom. The support member is located adjacent to and extends from the second end portion 464 of the arm in this example. The support member has a first end 470, a second end 472 opposite thereof, a top 474, a bottom 476 opposite the top, a front 475 and a rear 477 opposite the front. The top, bottom, front and rear of the support member 468 extend between its ends 470 and 472. The support member 468 extends between and is interposed between housings 46.1 and 48.1, with ends 470 and 472 being adjacent to inner sides 56.1 of housings 46.1 and 48.1, respectively. Front 475 of the support member 468 faces the support bar 68.1 at least in part and rear 477 faces outwards from the support bar.

Figure 28:
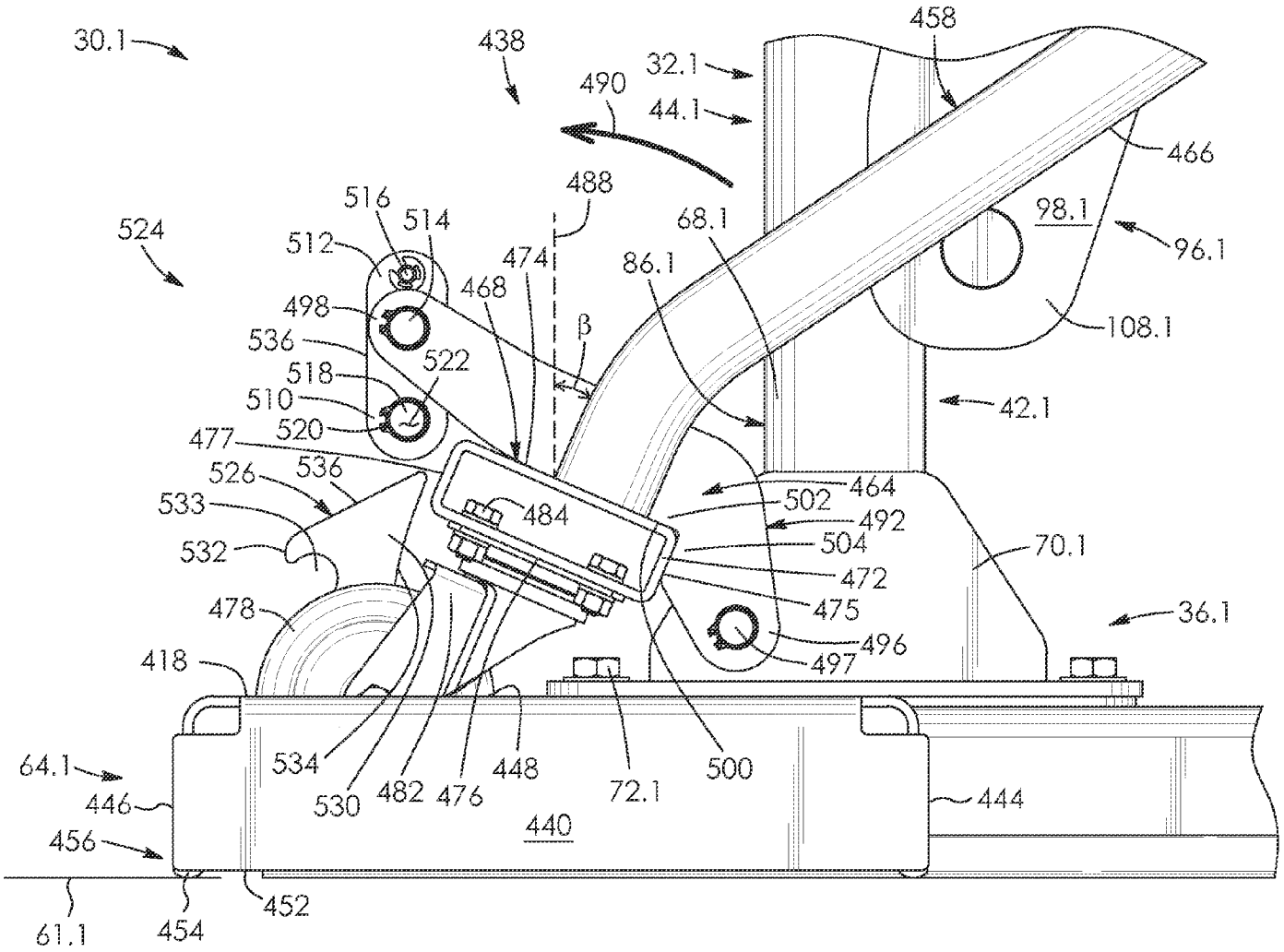
FIG. 28 is a fragmentary side elevation view thereof.

As seen in FIG. 25, the caster system 438 has a pair of wheels, in this example caster wheels 478 and 480 rotatably connected to and extending downwards from bottom 476 of support member 468 in this example via u-shaped wheel mounting bracket, as seen by bracket 482 for wheel 478. Referring to FIG. 27, the wheels operatively connect to the support member adjacent to ends 470 and 472 thereof. The wheels 478 and 480 align with and at least partially extend through apertures 448 and 450, respectively, of base 64.1. As seen in FIG. 28, the brackets 482 couple to the bottom 476 of support member 468 via a connector mechanism, in this example via bolts and nuts, as seen by bolt 484 and nut 486 threadably connected thereto. Referring back to FIG. 25, wheels 478 and 480 are thus rotatably connected to the second end portion 464 of arm 458.

Lever arm 458 has a first, forward position seen in FIGS. 25 to 28. As seen in FIG. 25, the lever arm in its forward position has end portions 462 and 464 which are interposed between and align with inner sides 56.1 of housings 46.1 and 48.1. As seen in FIG. 26, the v-shaped portion 466 of arm 458 is shaped to extend outwards from side 42.1 of the mounting assembly 32.1 and towards seat 118.1 in this example when the arm is in its forward position. The v-shaped portion of the arm functions to counterbalance the arm and biases it towards its forward position via the downward force of gravity acting thereon, as shown by arrow of numeral 463 in FIGS. 26 and 27. The v-shaped portion 466 so shaped also functions to accommodate step assembly 380 when raised to its storage position seen in ghost lines in FIG. 380. This thereby enables the lever arm to be pulled rearwards, as seen in FIG. 32, without interfering with the step assembly.

As seen in FIG. 28, the second end portion 464 of the arm is angled relative to the vertical axis 488 by angle β when the arm is in the first position. Angle β is equal to 30 degrees in this example, though this is not strictly required and angle β may be different in other examples. As seen in FIG. 27, the wheels 478 and 480 are spaced-apart from floor 61.1 and partially extend through apertures 448 when arm 458 is in its forward position in this example.

Figure 30:
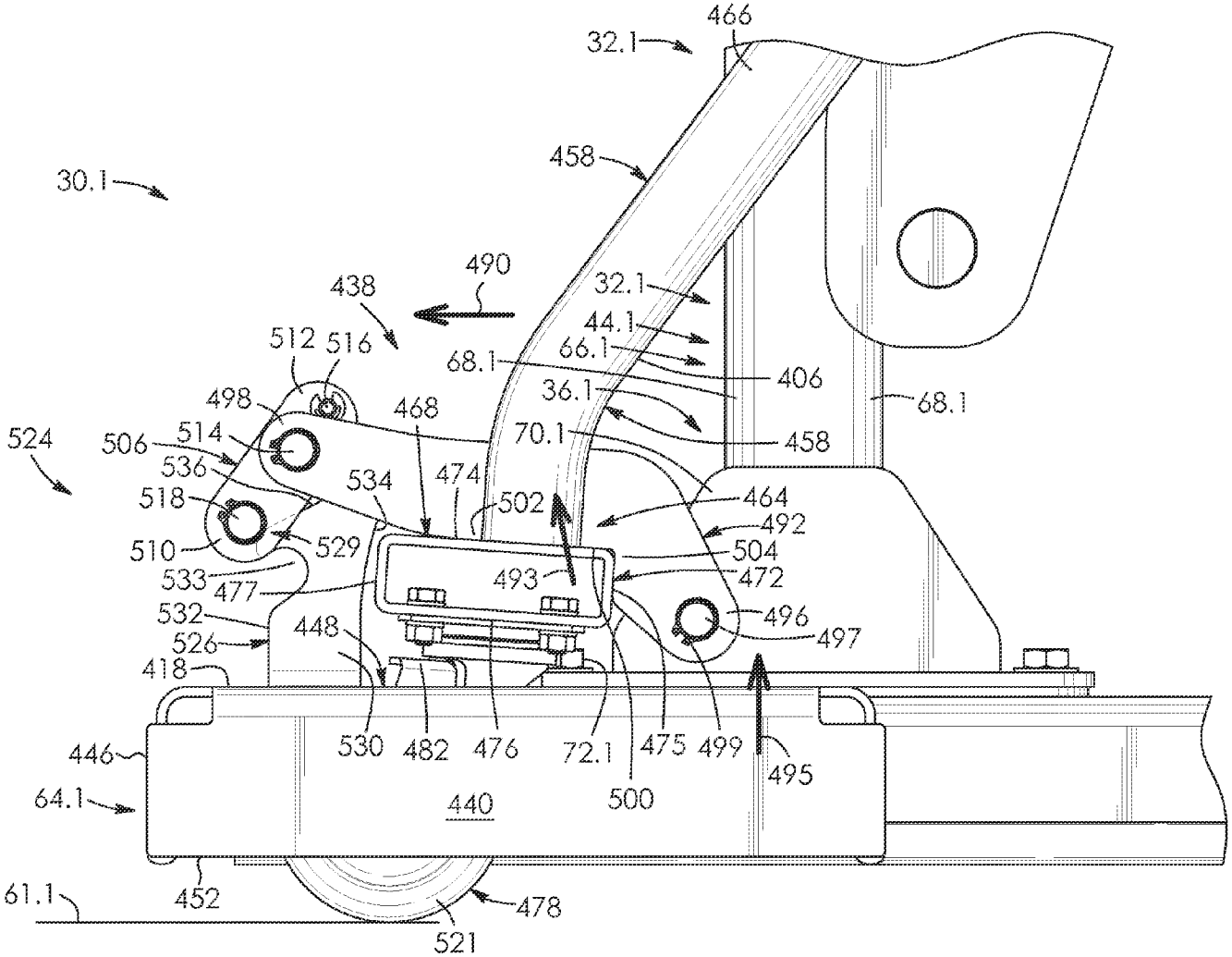
FIG. 30 is a side elevation view of the exercise machine and caster system of FIG. 29, with the lever arm being shown further moved towards the rear, the base of the mounting assembly being partially raised and the wheels more fully supporting the base of the mounting system.
Figure 31:
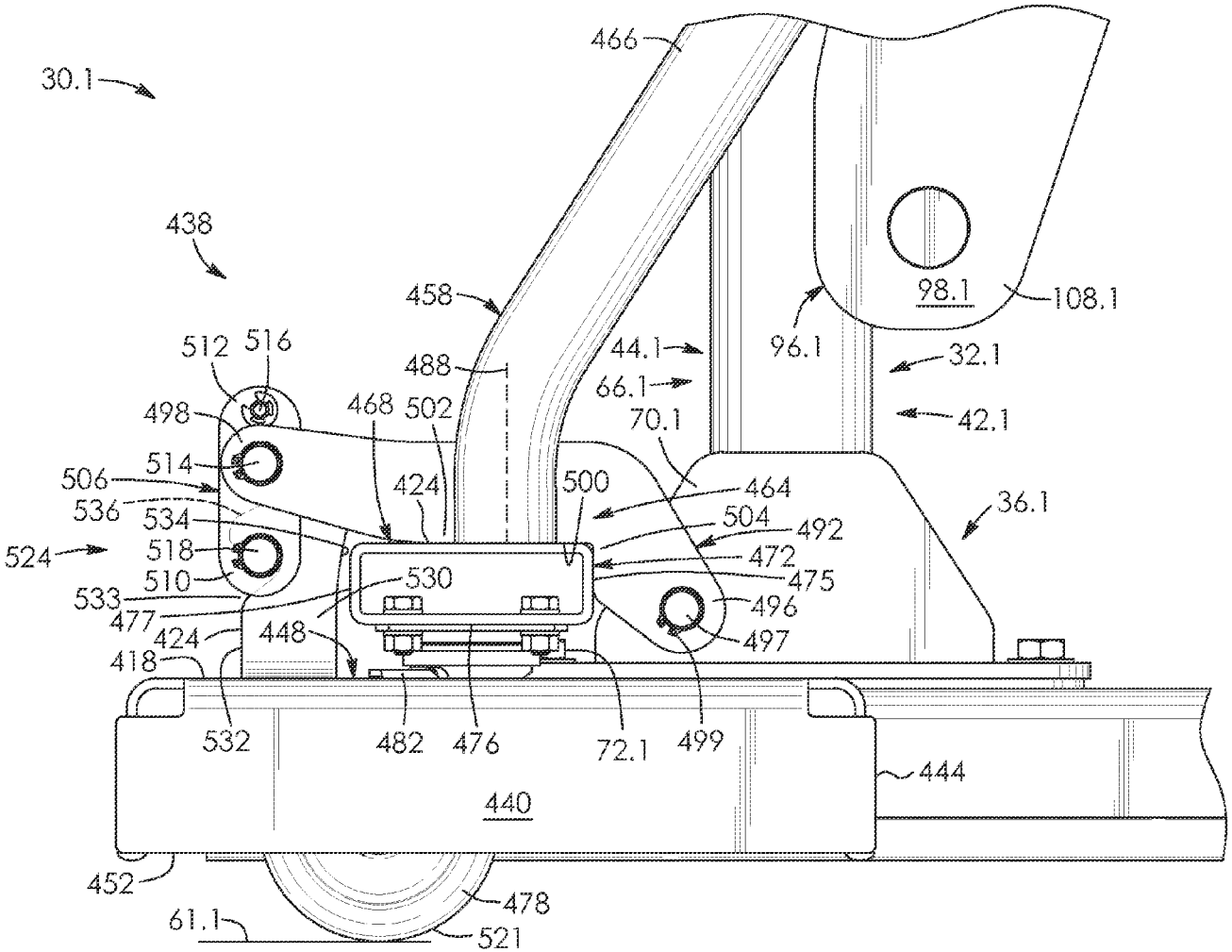
FIG. 31 is a side elevation view of the exercise machine and caster system of FIG. 30, with the lever arm shown in a second, rearward position in which a catch rod of the system is coupled to hooking members thereof and the base of the mounting assembly being shown fully raised and supported by the wheels of the caster system.
Figure 32:
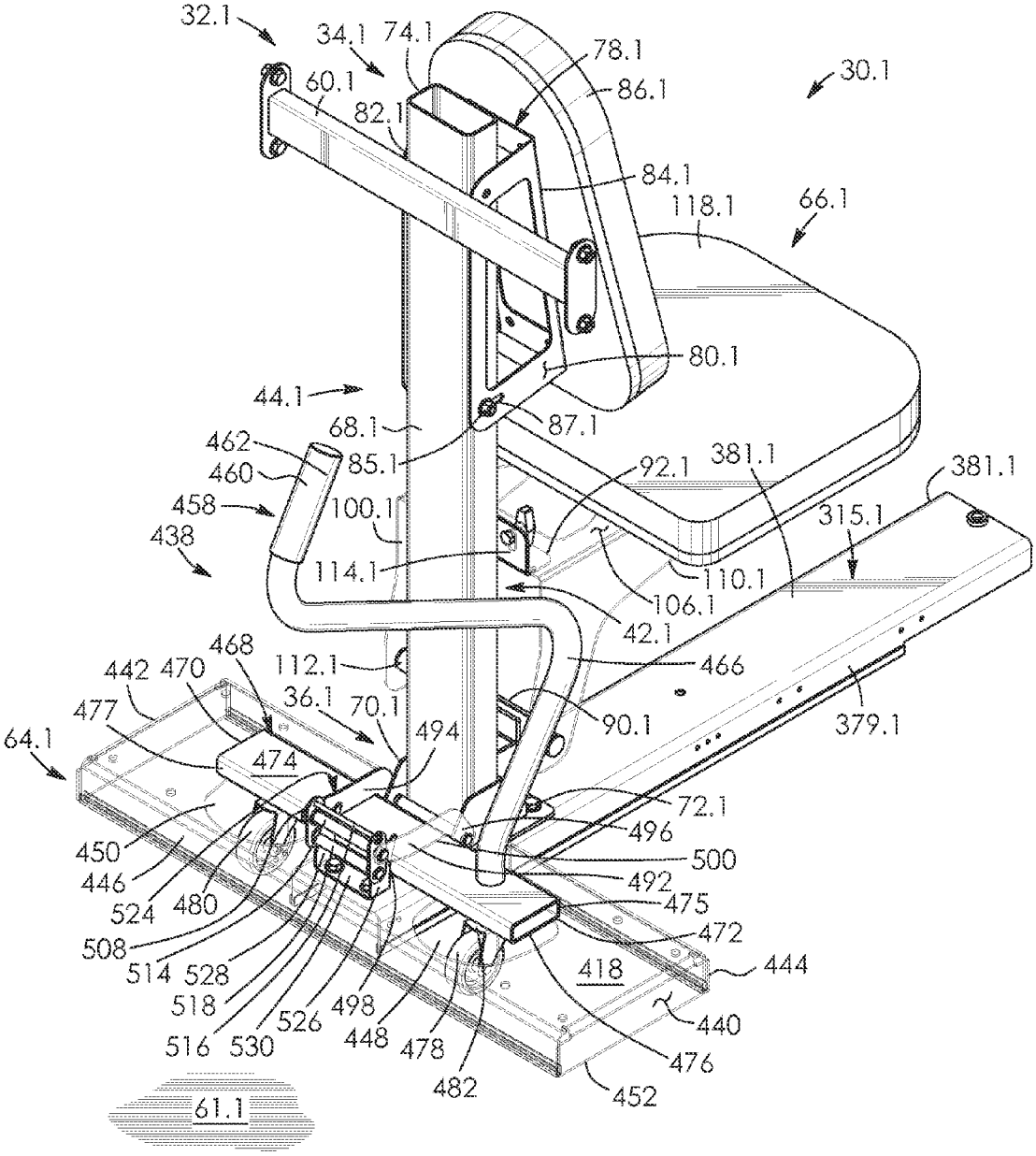
FIG. 32 is a rear, side perspective of the caster system, seat assembly and mounting assembly of FIG. 31, with the housings being removed and not shown, and the caster system being shown in the locked mode of FIG. 31.

Lever arm 458 is pivotable about the wheels from the forward position seen in FIG. 27 to a second, rearward position seen in FIGS. 31 and 32, in which first end portion 462 of the arm is moved rearward relative to base 64.1 and mounting assembly 32.1. Movement of the arm from its forward to its rearward position, as generally indicated by arrow of numeral 490 in FIGS. 28 to 30, causes the second end portion 464 of the arm to be more aligned with the vertical axis. The second end portion 464 of the arm 458 aligns in parallel with the vertical axis 488 when the arm is in its rearward position in this example and as seen in FIG. 31.

As seen in FIG. 32, the caster system 438 has a pair of spaced-apart pivot arms 492 and 494 which are operatively connected to base 64.1. In this example, each of the pivot arms is L-shaped, made of flat elongate bar, and has a first end pivotally connected to lower flanged end 70.1 of support bar 68.1 via a pivot rod, a second end opposite its first end and a recess interposed between its first and second ends. This is seen by first end 496, pivot rod 497, second end 498 and recess 500 for pivot arm 492 in FIG. 34. The pivot rod is held in place via a pair of retaining members at distal ends thereof, in this example retaining rings as shown by retaining ring 499 coupled to end 501 in FIG. 33. As seen in FIG. 28, recesses 500 of the arms are shaped to receive at least part of the top 474 and front 475 of the support member 468, with lower portions 502 and 504 of the arms that are adjacent to the recesses 500 abutting, extending along and being supported by the top and front of the support member. Support member 468 holds ends 498 of pivot arms 492 in elevated positions relative to base 64.1 when the lever arm 458 is in the forward position seen in FIG. 28.

Figure 34:
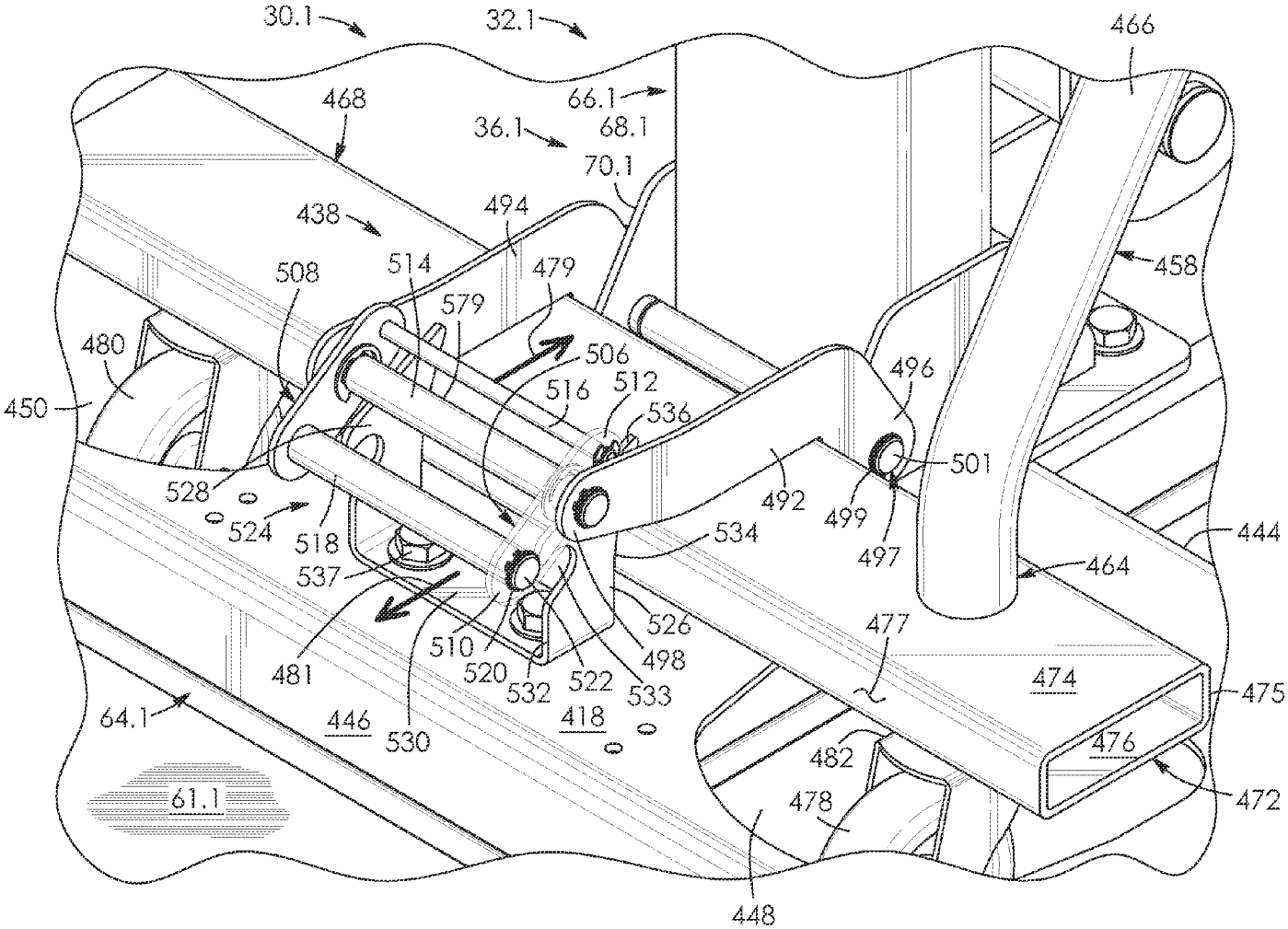
FIG. 34 is an enlarged, rear side perspective view of the machine and caster system thereof.

As seen in FIG. 34, the caster system 438 further comprises a pair of spaced-apart linking members 506 and 508 that are elongate flat bars in this example. Each of the linking members has a first end and a second end opposite the first end, as seen by first end 510 and second end 512 for linking member 506. The linking members 506 and 508 pivotally connect to the second ends 498 of the pivot arms 492 and 494 via a pivot rod 514 which extends between the linking members and pivot arms. The pivot rod extends between the first ends 510 and second ends 512 of the linking members in this example.

As seen in FIG. 34, the caster system 438 has a disengagement member, in this example an elongate rod 516 which couples to and extends between the second ends 512 of linking members 506 and 508. The caster system comprises an elongate member, in this example a catch rod 518 which couples to and extends between the first ends 510 of the linking members. Each of rods 514, 516 and 518 is retained in place in this example via a pair of respective retaining members, in this example retaining rings, connected to distal ends thereof, as seen by retaining ring 520 coupling to end 522 of rod 518 in FIG. 28.

As seen in FIG. 34, the caster system 438 has a locking mechanism 524 which includes catch rod 518. The locking mechanism further has a pair of spaced-apart hook members 526 and 528 which in this example are vertical parts of a u-shaped bracket 530 that is coupled to and extends upwards from top 418 of base 64.1 via fasteners, in this example bolts 537. Each hook member has an outer peripheral edge facing outwards from the machine 30.1, a recessed region that is circular in this example and adjacent to the outer peripheral edge, a slightly curved inward peripheral edge facing pivot arms 492 and 494 and has an upper peripheral edge which is slanted in this example extends from the inner peripheral edge downwards to the outer peripheral edge. This is seen by outer peripheral edge 532, recessed region 533, inner peripheral edge 534 and upper peripheral edge 536 of hook member 526 in FIG. 34. The outer and inner peripheral edges of the hook members extend upwards from the top 418 of base 64.1 in this example. The recessed regions 533 of the hook members are shaped to selectively receive catch rod 518 therewithin, as seen in FIGS. 31 and 32.

In operation and referring to FIG. 25, mounting assembly 32.1 is shown with its base 64.1 resting upon floor 61.1 via spaced-apart longitudinally-extending vinyl strips 454. Lever arm 458 is shown in its forward position. As seen in FIG. 27, catch rod 518 is spaced-apart above hook members 526 and 528 in the forward position of the lever arm.

Figure 29:
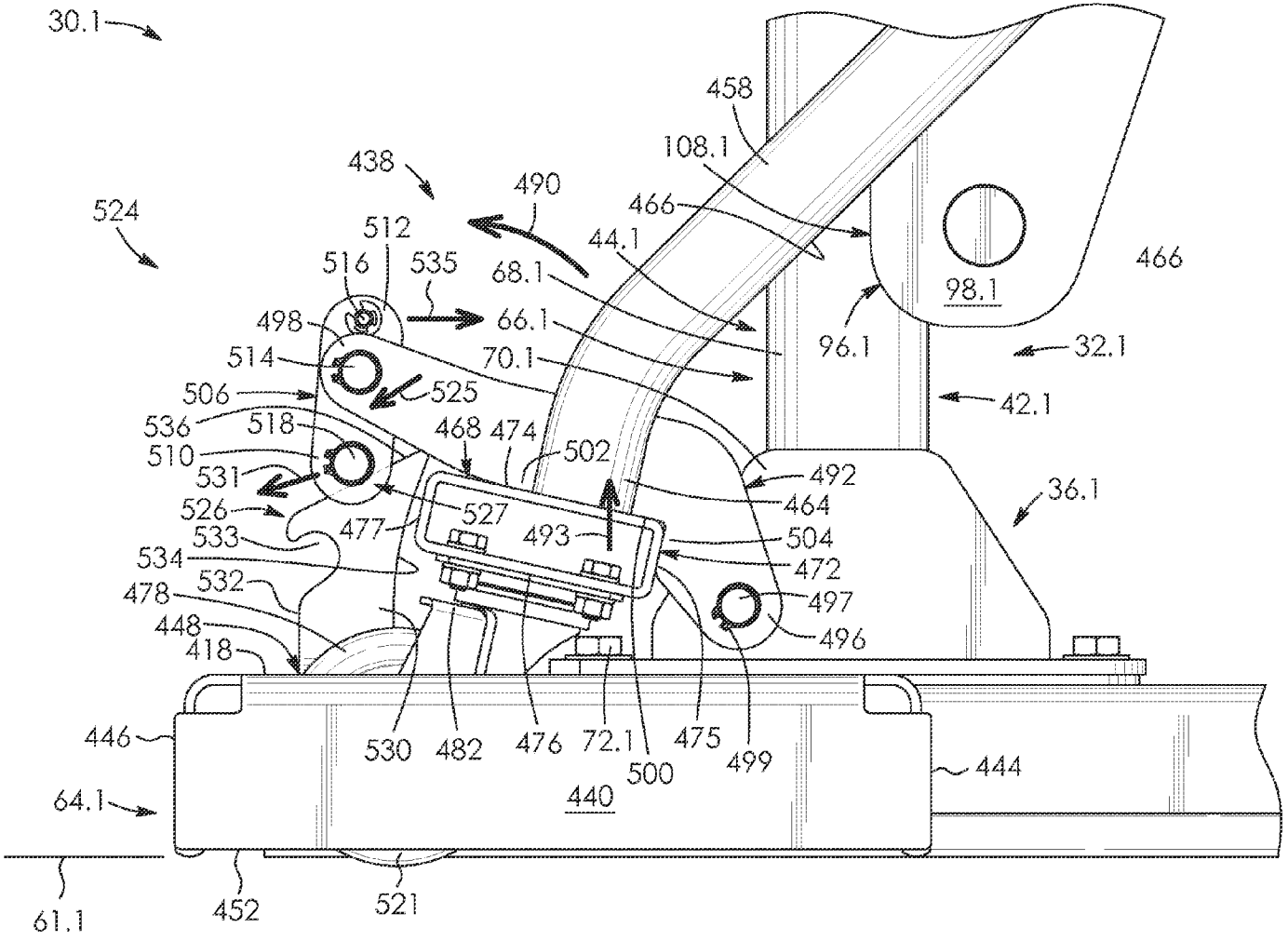
FIG. 29 is a fragmentary side elevation view of the exercise machine and caster system of FIG. 28, with the lever arm being shown moved partially towards the rear, and the caster system having wheels shown partially abutting the floor.

Handle 460 is moved rearward and away from support bar 68.1, as seen by arrow of numeral 480 in FIG. 27, in order to move the lever arm towards the rearward position and raise and move mounting assembly 32.1 of the machine 30.1. As seen in FIG. 29, this causes support member 468 and second end portion 464 of arm 458 to tilt towards horizontal and vertically extending positions, respectively. This also allows second ends 498 of pivot arms 492 to lower downwards towards floor 61.1, as seen by arrow of numeral 525, with catch rod 518 abutting upper peripheral edges 536 of hook members 526 from a location 527 interposed between the inner and outer peripheral edges 534 and 532 thereof seen in FIG. 29. As the handle of lever arm 458 continues to be moved rearwards, or to the left from the perspective of FIG. 29, this causes first ends 510 of linking members 506 to move outwards and rearwards of the machine 30.1 towards recessed regions 533 of the hook members 526, as seen by arrow of numeral 531. This is also causes second ends 512 of the linking members to move towards support bar 68.1 in this example, as seen by arrow of numeral 535. This further causes bottoms 521 of wheels 478 to abut floor 61.1. The lever arm thereafter begins to pivot about its wheels.

As the handle of lever arm 458 continues to move rearwards by the user, this further causes catch rod 518 to move along upper peripheral edges 536 of the hook members 526 at a location 529 adjacent to outer peripheral edges 532 and recessed regions 533 thereof as seen in FIG. 30. During this process, lever arm 458 continues to pivot about its wheels 478, thereby causing support member 468 to abut against and transmit an upward force against lower portions 502 and 504 of pivot arms 492, as seen by arrow of numeral 493 in FIG. 30. This thereby causes flanged ends 70.1 of support bar 68.1 and thus base 64.1 to move upwards, as seen by arrow of numeral 495, due to the connection of flanged ends 70.1 with ends 496 of the pivot arms. The bottom 452 of base 64.1 of mounting assembly 32.1 thus becomes further spaced-apart from floor 61.1.

As the handle of arm 458 continues to move rearward, catch rod 518 thereafter hooks into and is received within recessed regions 533 of the hook members 526 in the rearward position. In this position, end portion 464 of lever arm 458 substantially aligns with vertical axis 488 and top 474 of support member 468 extends in a direction substantially perpendicular to axis 488 in this example as seen in FIG. 31. The locking mechanism 524 thus selectively retains the lever arm 458 in its rearward position. In this manner, mounting assembly 32.1 is thus raised and may be selectively wheeled to another desired location along floor 61.1 via wheels 478.

Figure 33:
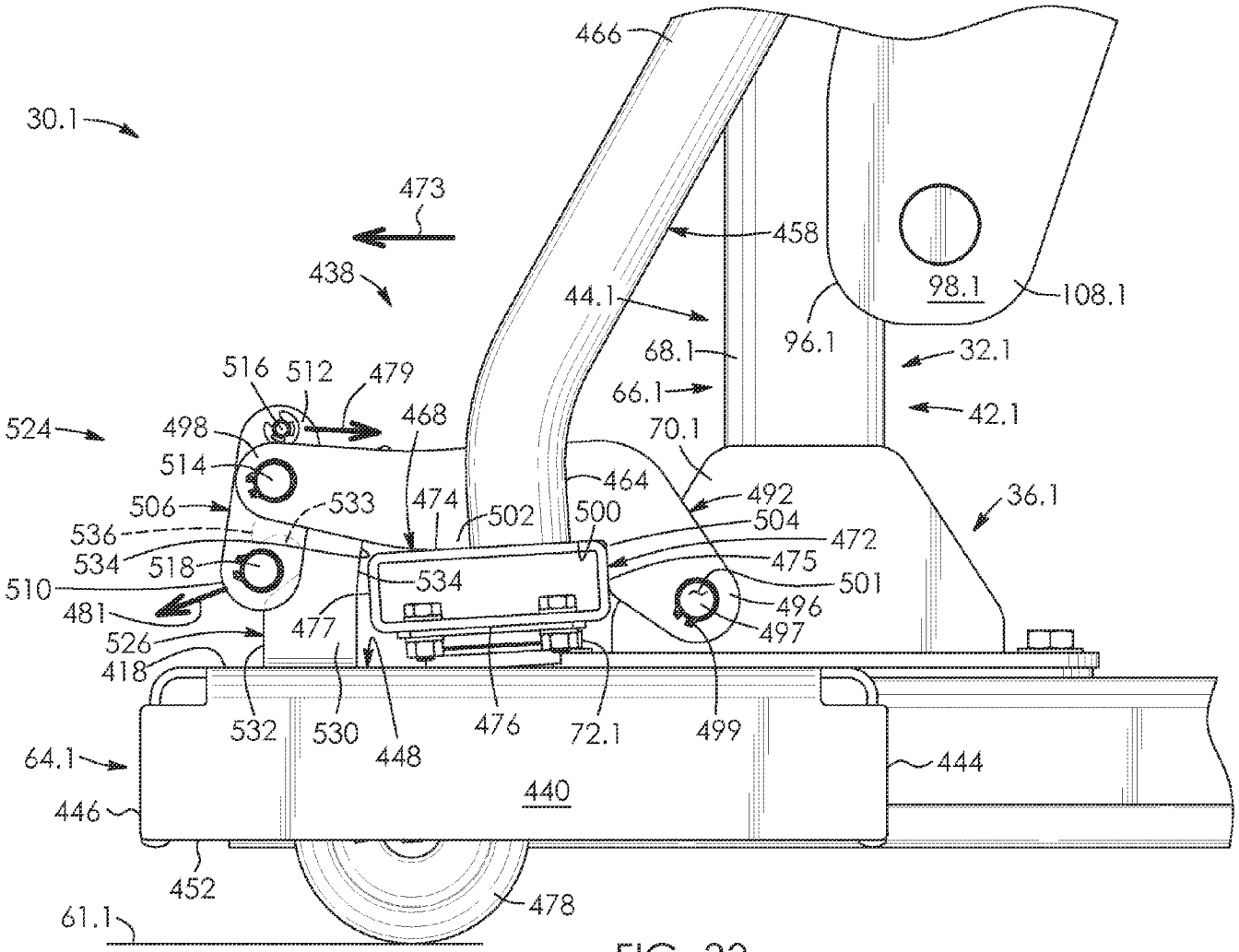
FIG. 33 is a side elevation view of the exercise machine and caster system of FIG. 31, with the lever arm in the process of moving further rearward to disengage the catch rod from the hooking members for returning the base of the mounting assembly to the floor.

When a new location for the machine 30.1 is found, the user first pulls on the handle to cause lever arm 458 to move further rearward, as seen by arrow of numeral 473 in FIG. 33. The user may next selectively actuate rod 516 towards ends 496 of the pivot arms 492 and towards support bar 68.1, as seen by arrow of numeral 479 in FIGS. 33 and 34, by gentling pushing forward on the rod via the user's foot for example, to swing the catch rod 518 out of the recessed region 533. According to one aspect, the lever arm is pulled rearward first before actuating rod 516, as otherwise the catch rod may next exit recessed region 533. These actions may function to cause ends 510 of the linking members to move rearward to and the left from the perspective of FIG. 33, as seen by arrow of numeral 481, thereby enabling catch rod 518 to dislodge from recessed regions 533 of the hook members 526. Thus, actuation of the second end of the linking member enables the elongate member to be selectively removed from the hook members. Thereafter, the handle of the lever arm 458 may be selectively moved forward towards support bar 68.1 to selectively return the arm to its forward position, substantially following the steps shown and described for FIGS. 30, 29 and 28 in reverse.

Figure 35:
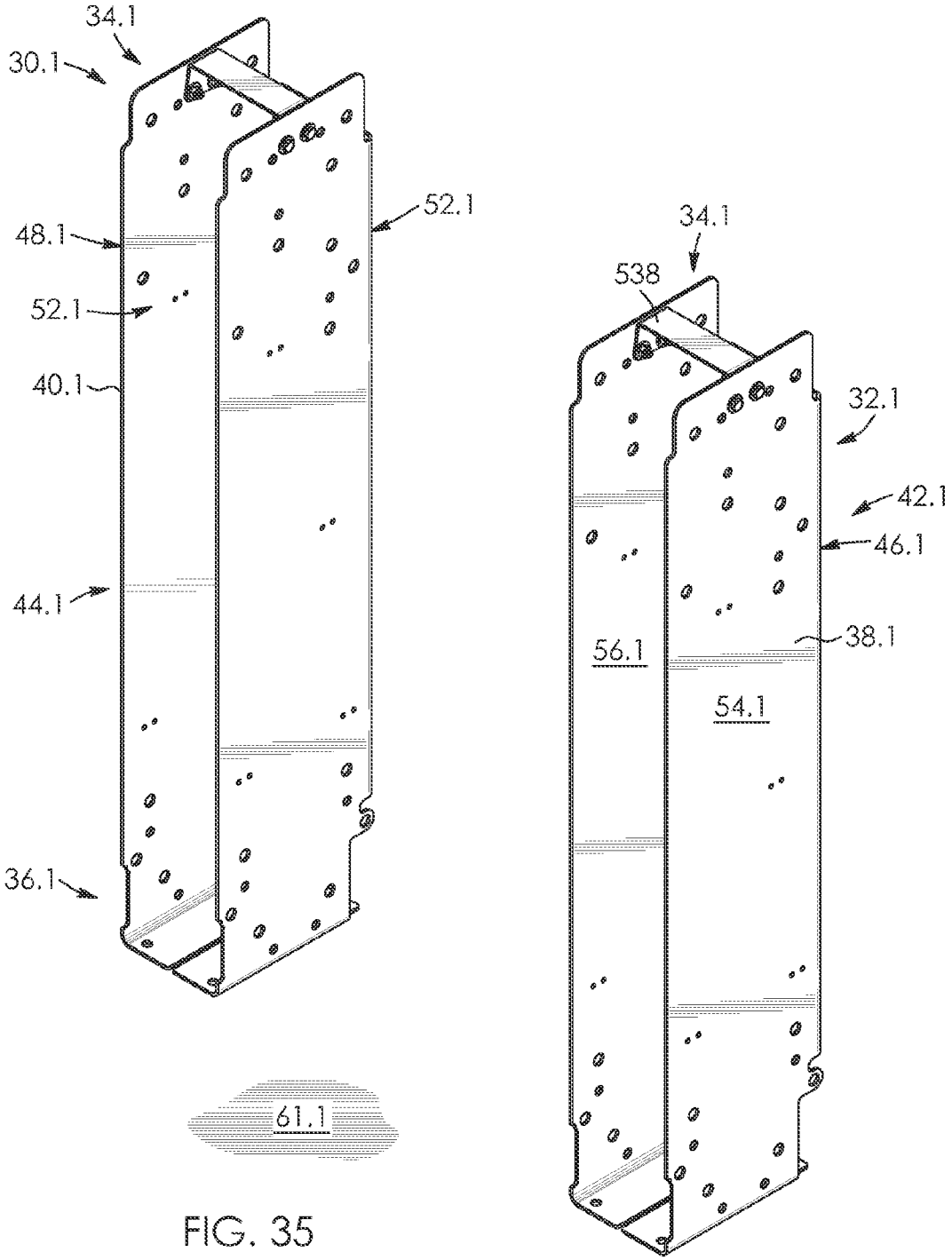
FIG. 35 is a rear, side perspective view of the inner and outer sides of the housings of the mounting assembly of the exercise machine of FIG. 23 with brackets coupling the sides together and with the rest of the mounting assembly and exercise machine being removed and not shown.

As seen in FIG. 35, the inner and outer sides of the housings are coupled together via, in this example a u-shaped bracket located at the top 34.1 of the mounting assembly 32.1, as seen by bracket 538 extending between and coupling together sides 54.1 and 56.1 of housing 46.1.

Figure 36:
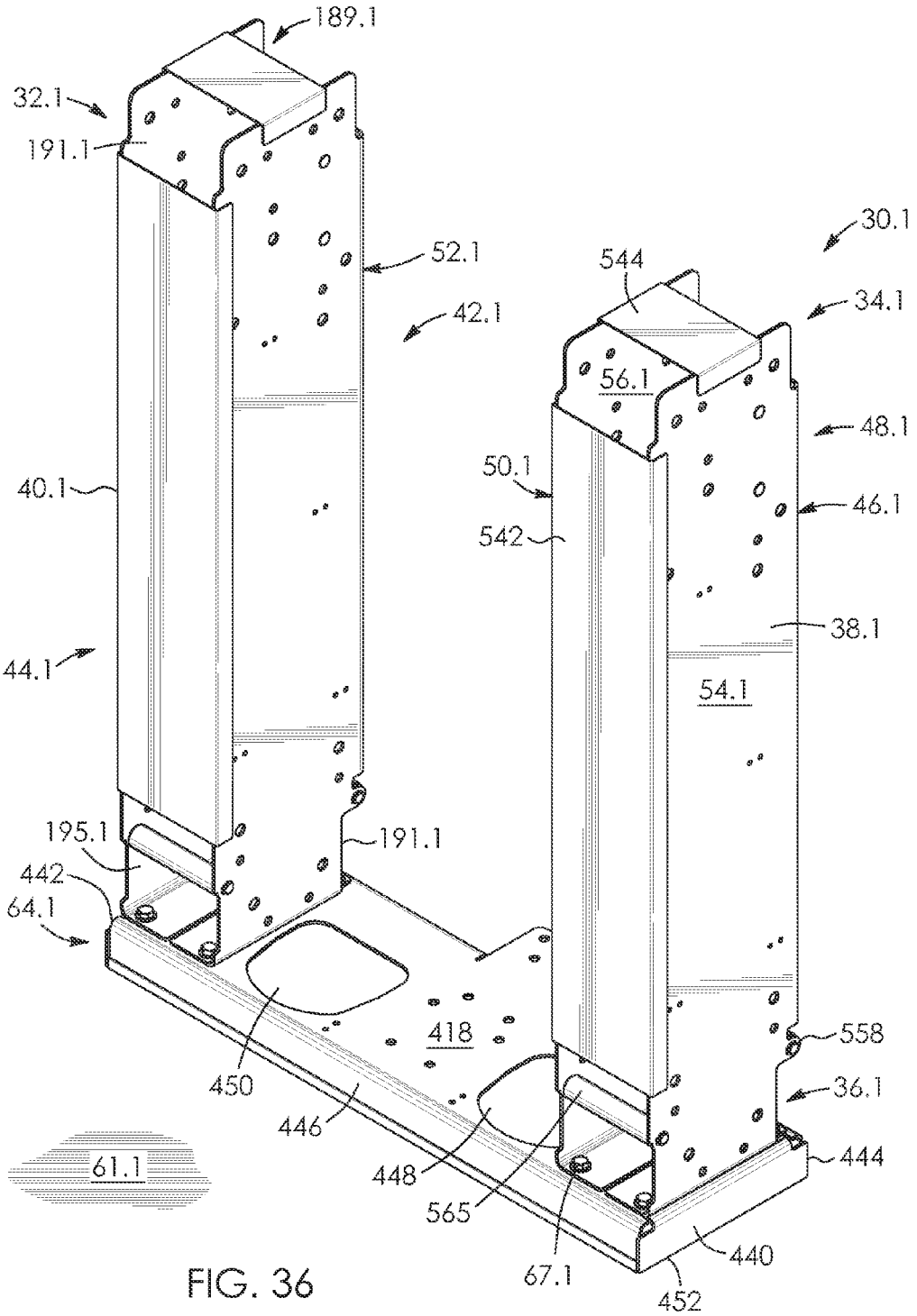
FIG. 36 is a rear, side perspective view of the housings and the base of the mounting assembly of the exercise machine of FIG. 23, with covers extending around the rear and tops of the housings and anti-wear rollers of the mounting assembly also being shown.

As seen in FIG. 36, machine 30.1 further comprises a plurality of flexible members, in this example flexible covers, including rear covers and top covers for its housings. This is seen by rear cover 542 and top cover 544 for housing 46.1. The rear covers extend between the top 34.1 and bottom 36.1 of the mounting assembly 32.1 and are shaped to selectively enclose the fronts 48.1 and rears 50.1 of the housings, respectively. The top covers 544 extend between the outer sides 54.1 and inner sides 56.1 of the housings 46.1 and are shaped to selectively partially enclose the tops of the housings.

Figure 37:
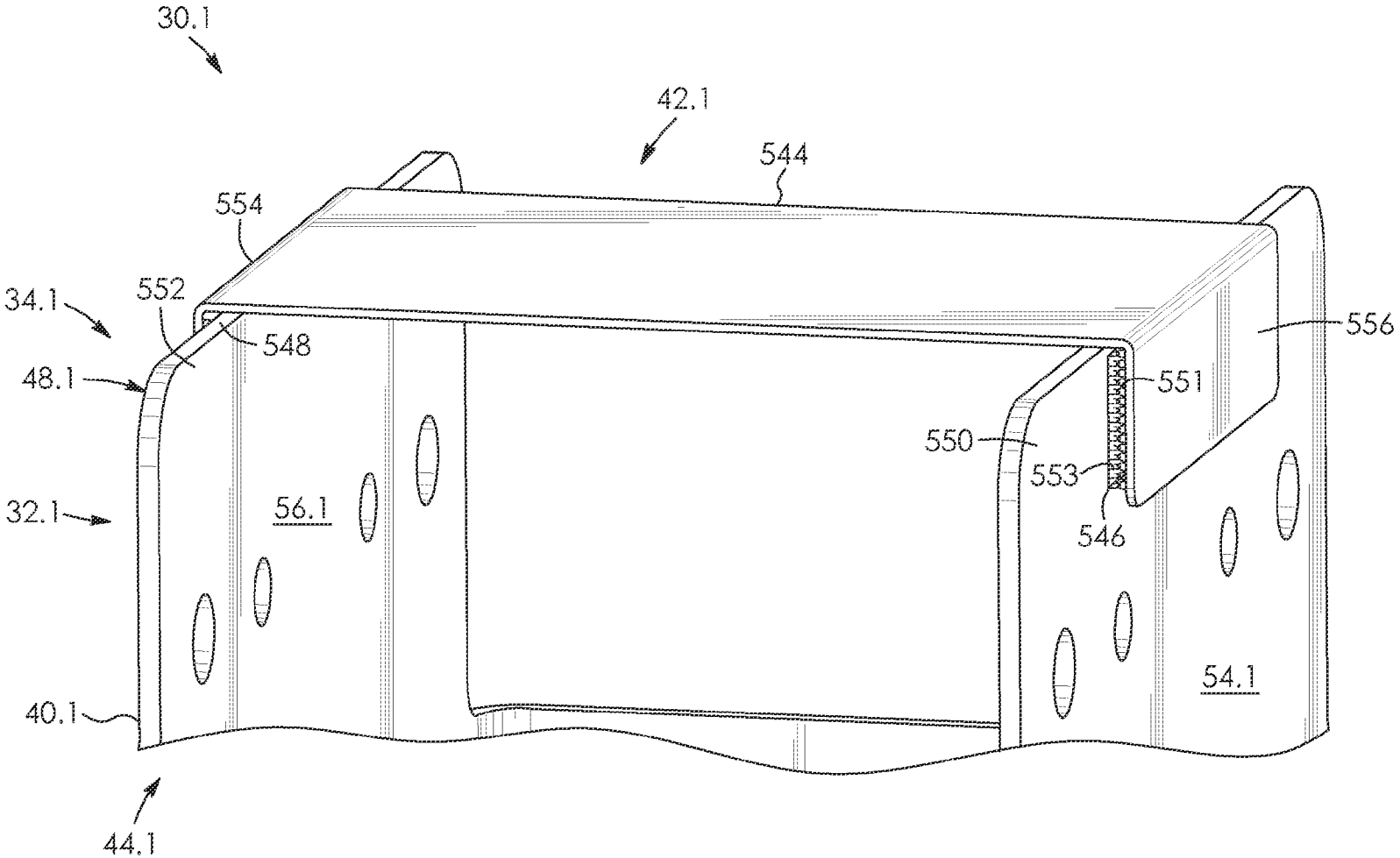
FIG. 37 is an enlarged, rear, side perspective view of one of the housings of FIG. 36 showing a top one of the covers thereof.

The machine 30.1 further comprises a plurality of loop and hook connectors configured for selectively coupling the covers 542 and 544 to the housings 46.1. In this example, a pair of strips of fabric comprising first ones of the loop and hook connectors stick to and extend along spaced-apart peripheral edges of the inner and outer sides of the housings and corresponding peripheral portions of the covers have thereon second ones of the loop and hook connectors. This is seen in FIG. 37, for example, by strips 546 and 548 coupling to and extending along upper peripheral portions 550 and 552 of the outer side 54.1 and inner side 56.1, respectively, and having hooks 553, and selectively coupling to loops 551 extending from peripheral portions 554 and 556 of top cover 544. The hooks are attached directly to the housings and the loops are sewn to the covers in this example. The covers are made of vinyl in this example, though this is not strictly required and the covers may be made of other materials in other examples.

Figure 41:
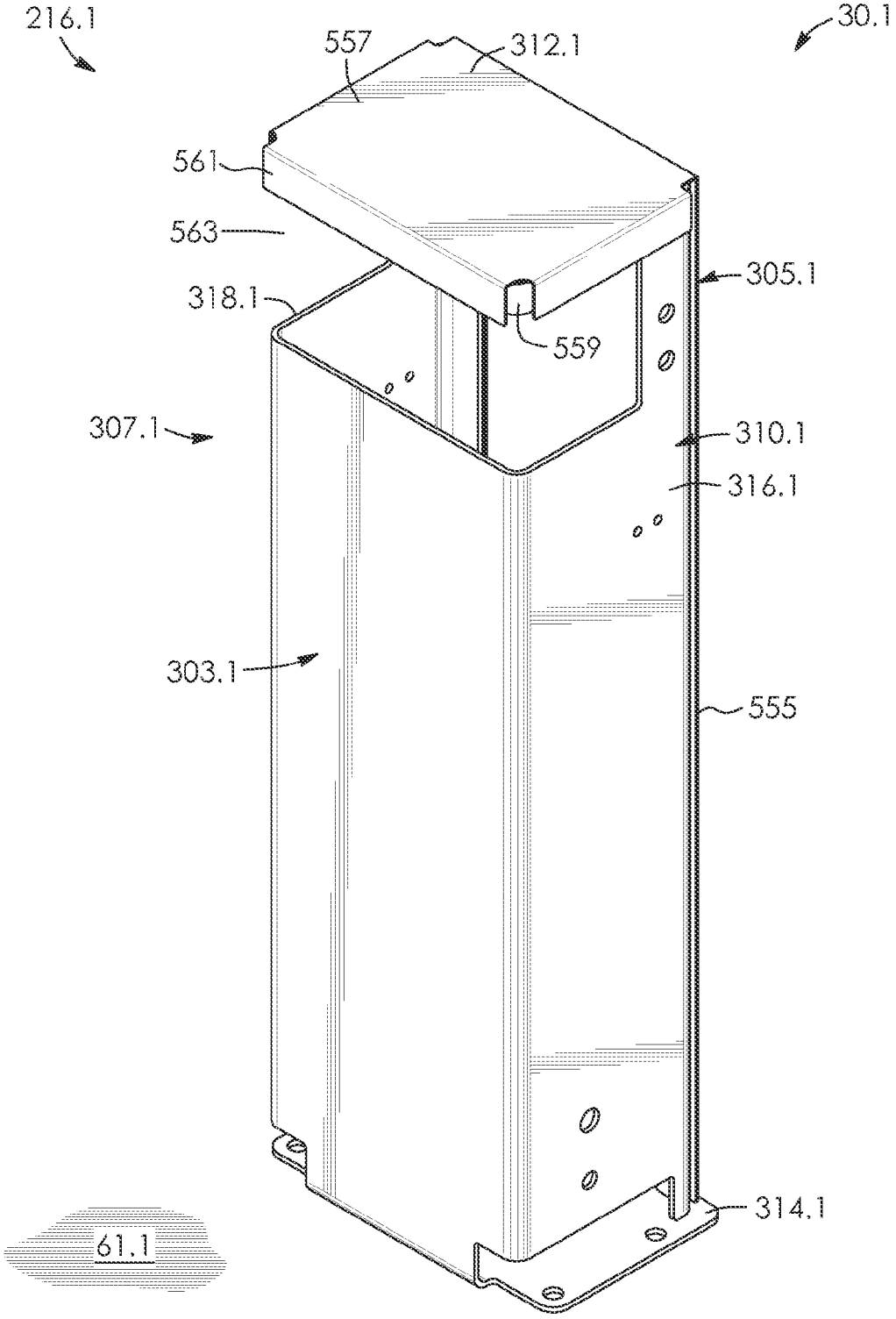
FIG. 41 is a front, side perspective view of an upright housing of the carriage of the exercise machine of FIG. 23.

As seen in FIG. 41, upright housing 310.1 has a plurality of flexible members, in this example rear cover 555 covering rear 305.1 thereof and top cover 557 covering top 312.1 thereof. Rear cover 555 extends between sides 316.1 and 318.1, bottom 314.1 and top 312.1 of the housing 310.1 and selectively couples thereon with hook and loop fasteners in a like manner as described above. Top cover 557 selectively couples to side and front peripheral portions 559 and 561 of the housing 310.1 adjacent to top, forward-facing aperture 563 of the housing via hook and loop fasteners as described similar to the above. Covers 555 and 557 are made of vinyl in this example, though this is not strictly required.

As seen in FIG. 36, machine 30.1 further comprises a plurality of anti-wear rollers, in this example a pair of rollers per housing, each of which is positioned adjacent to the bottom 36.1 of the mounting assembly 32.1 at sides 42.1 and 44.1 thereof. This is seen by rollers 558 and 565 for housing 46.1. Each of the rollers extends between the outer sides 54.1 and inner sides 56.1 of the housings 46.1. The rollers 558 and 565 are interposed between the proximal and distal end portions of the cables and function to position the cables inwards from the front and rear of the housings, respectively.

Figure 38:
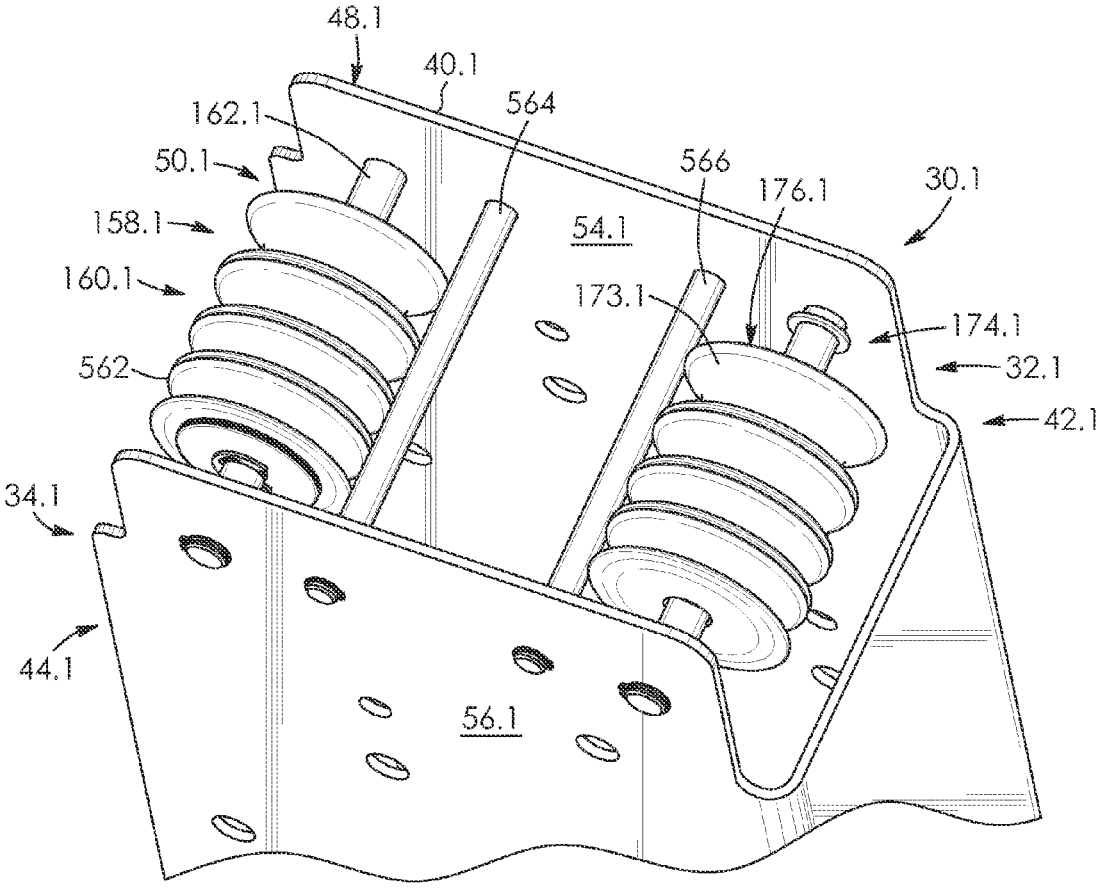
FIG. 38 is an enlarged, rear, side perspective view of said one of the housings of FIG. 37, with the top one of the covers being removed to show a pair of upper pulley assemblies of the machine and a pair of retaining rods adjacent thereto.

As seen in FIG. 38, machine 30.1 comprises a plurality of spaced-apart, individual pulleys, as shown by way of example by pulley 562, rotatably mounted to their mounting rods 162.1. Each housing 48.1 further comprises a plurality of retaining rods 564 and 566 for its respective pulley assemblies 160.1 and 176.1, with each of the rods extending between its sides 54.1 and 56.1 and being positioned adjacent to the pulleys. The retaining rods 564 and 566 function to inhibit dislodgement of the cables from the pulleys and align in parallel with the pulleys in this example.

Figure 39:
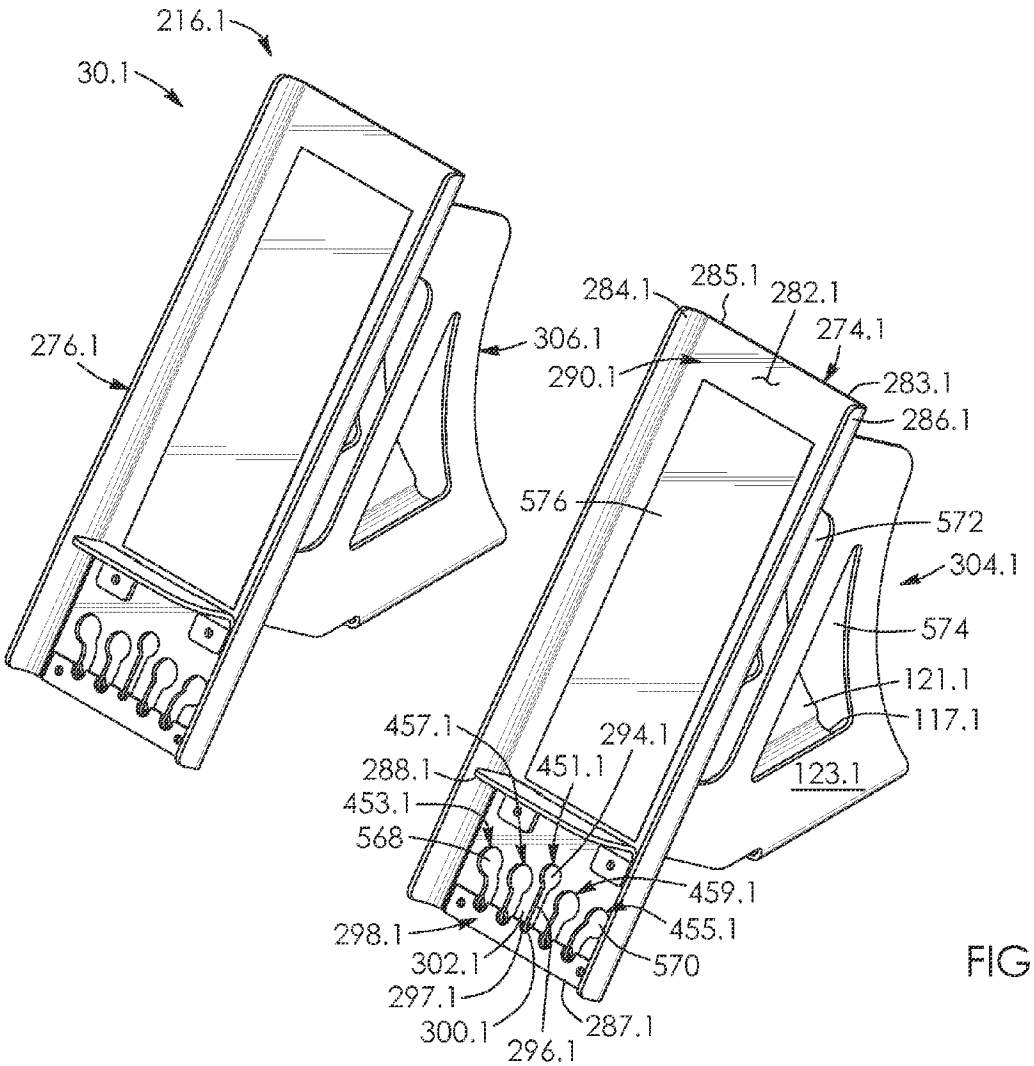
FIG. 39 is a side perspective view of a pair of foot-engaging members of the exercise machine of FIG. 23 together with brackets connected thereto.
Figure 40:
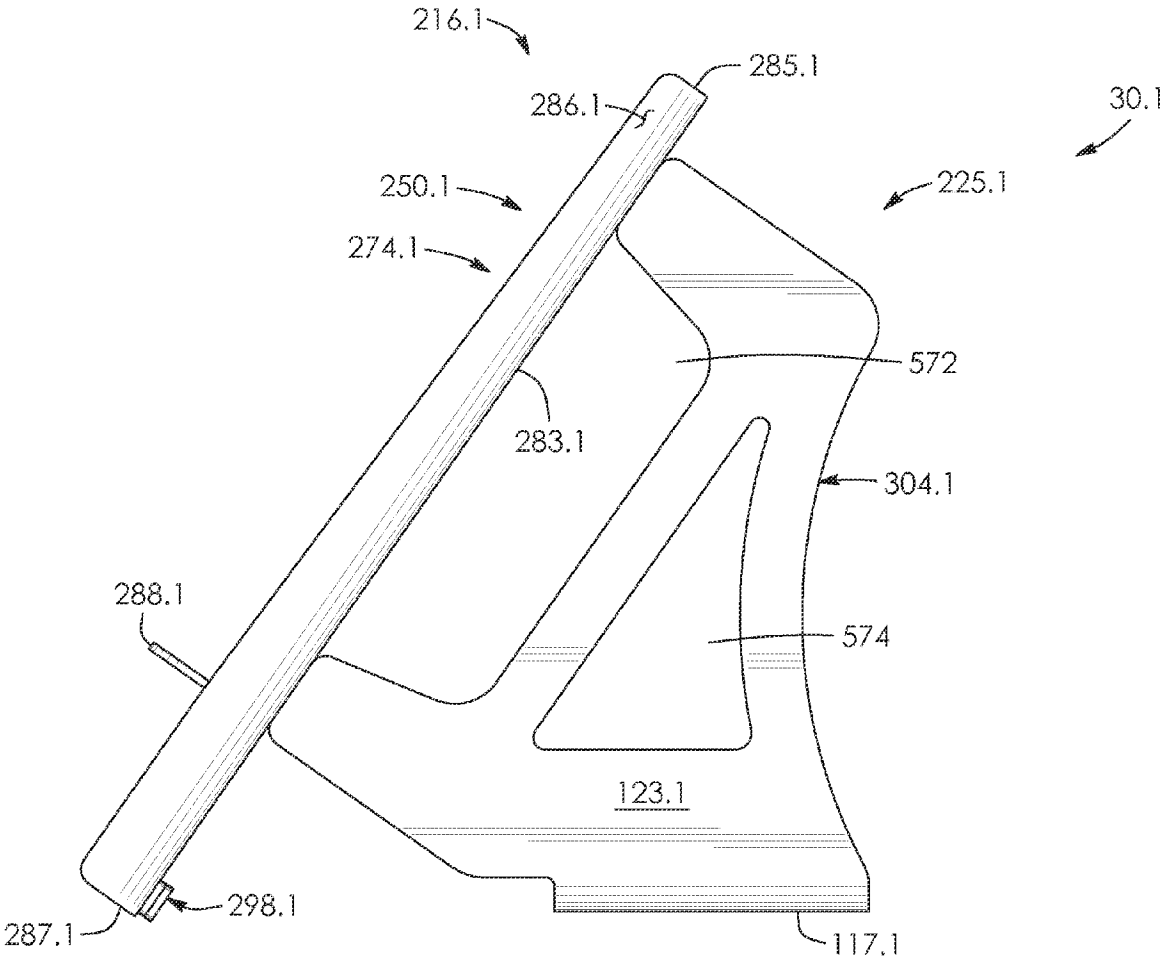
FIG. 40 is a side elevation view of one of the foot-engaging members and brackets of FIG. 39.

Referring to FIG. 39, the circular portions 468 of slots 453.1 extend adjacent to and are angled towards side portions 284.1 of the foot-engaging members 274.1 and 276.1 and the circular portions 470 of slots 455.1 extend adjacent to and are angled towards side portions 286.1 of the members. Brackets 304.1 and 306.1 have a plurality of apertures extending through their sides in this example, as seen by rectangular-shaped aperture 572 and triangular-shaped aperture 574 extending through side 121.1 of bracket 304.1 as seen in FIG. 40. Apertures 572 are positioned adjacent to rear 283.1 of member 274.1.

As seen in FIG. 39, each of the foot-engaging members 274.1 and 276.1 comprises an anti-skid mechanism, in this example in the form of anti-skid tape 576 connected to and extending along its front 282.1 within enclosure 290.1. The tape promotes gripping of the user's foot upon the fronts 282.1 of the members 274.1 and 276.1.

Figure 42:
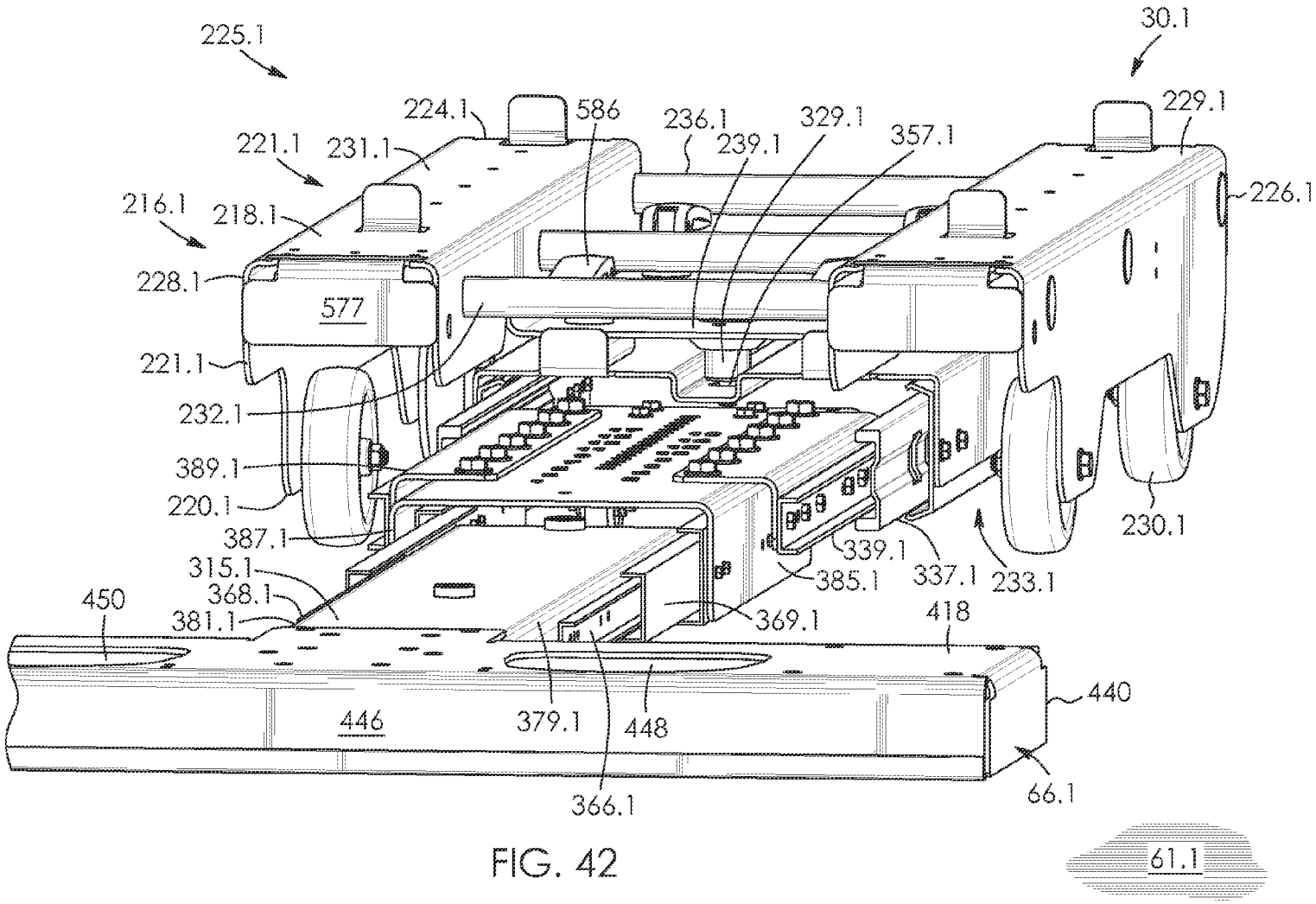
FIG. 42 is a front perspective view of the base of the mounting assembly, the linking member, a moveable carriage, a position adjustment mechanism and part of a leg press module for the exercise machine of FIG. 23, with the foot-engaging members being removed.
Figure 47:
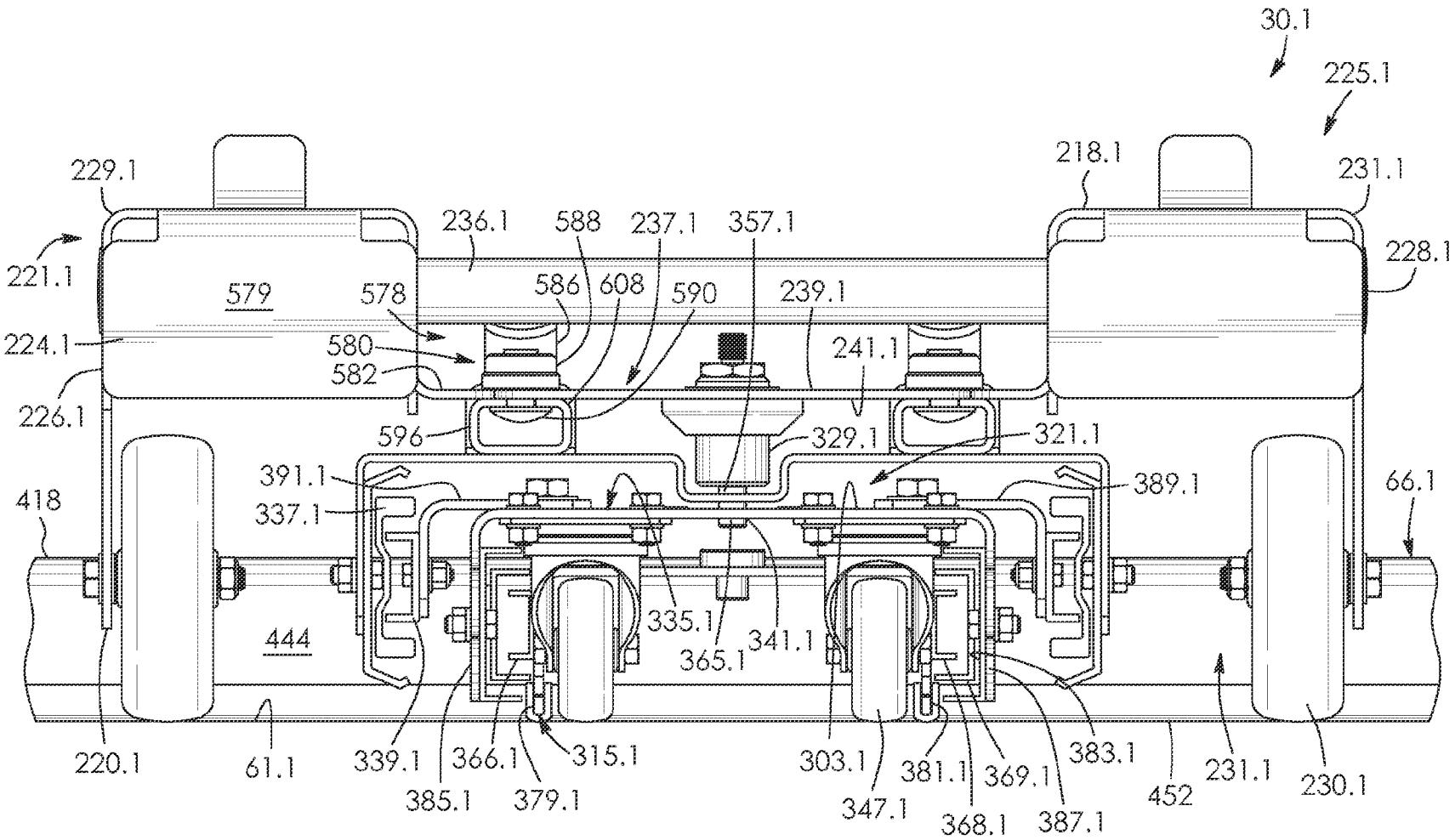
FIG. 47 is an end elevation view of the moveable carriage, position adjustment mechanism and quick-release coupling mechanism of FIG. 45.

As seen in FIG. 42, brackets 229.1 and 231.1 are closed at end 222.1 of the mounting assembly 221.1 in this example, as shown by plate member 577 extending downwards from top 218.1 for bracket 231.1. As seen in FIG. 47, brackets 229.1 and 231.1 are also closed at ends 224.1 of the mounting assembly, as shown by plate member 579 extending downwards from top 218.1 for bracket 229.1.

Figure 46:
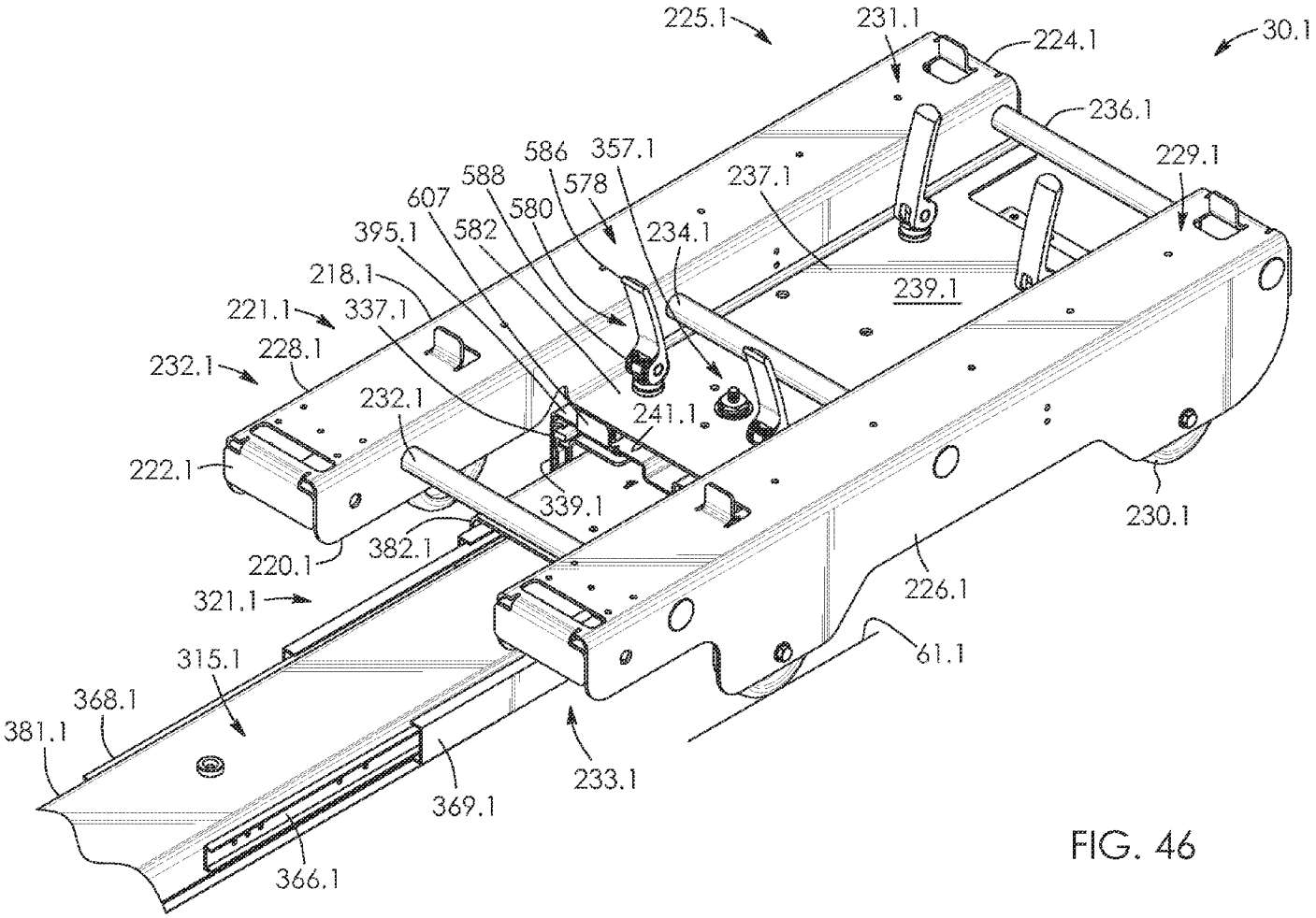
FIG. 46 is a front, top perspective view of the moveable carriage, position adjustment mechanism and quick-release coupling mechanism, with the brackets and mounting plate of the moveable carriage being shown in solid lines.

As seen in FIGS. 42 to 50, machine 30.1 comprises a quick-release coupling mechanism 578 for readily, selectively removing leg press module 225.1 from outer bracket 395.1. As seen in FIG. 46, the quick-release coupling mechanism comprises a plurality of quick-release or cam levers coupled to mounting plate 237.1 adjacent to corners thereof, as seen by cam lever 580 adjacent to corner 582 of plate 237.1. The cam levers are interposed between the foot-engaging members.

Figure 48:
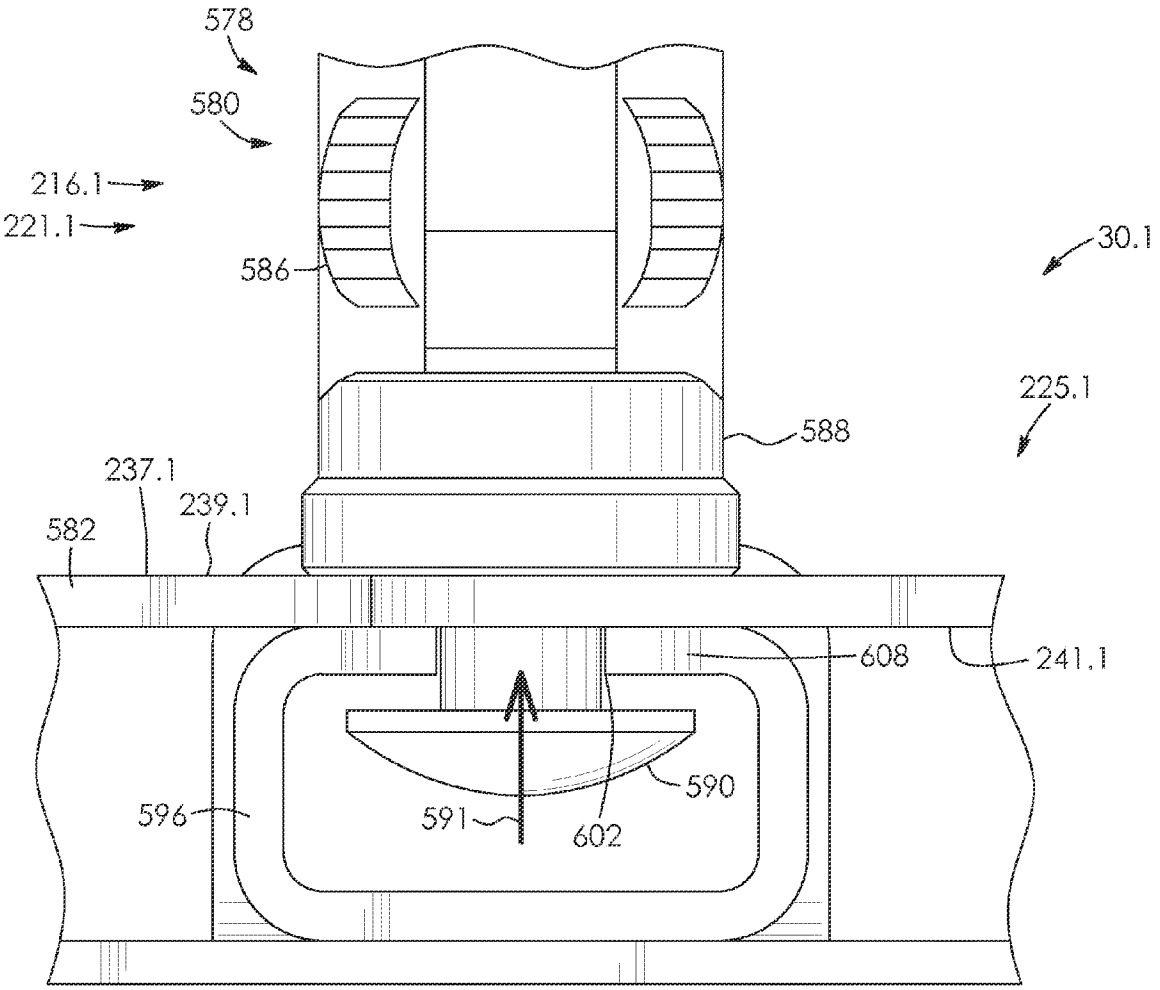
FIG. 48 is an enlarged elevation view of part of the quick-release coupling mechanism of FIG. 47, the coupling mechanism being shown in its unlocked mode.
Figure 49:
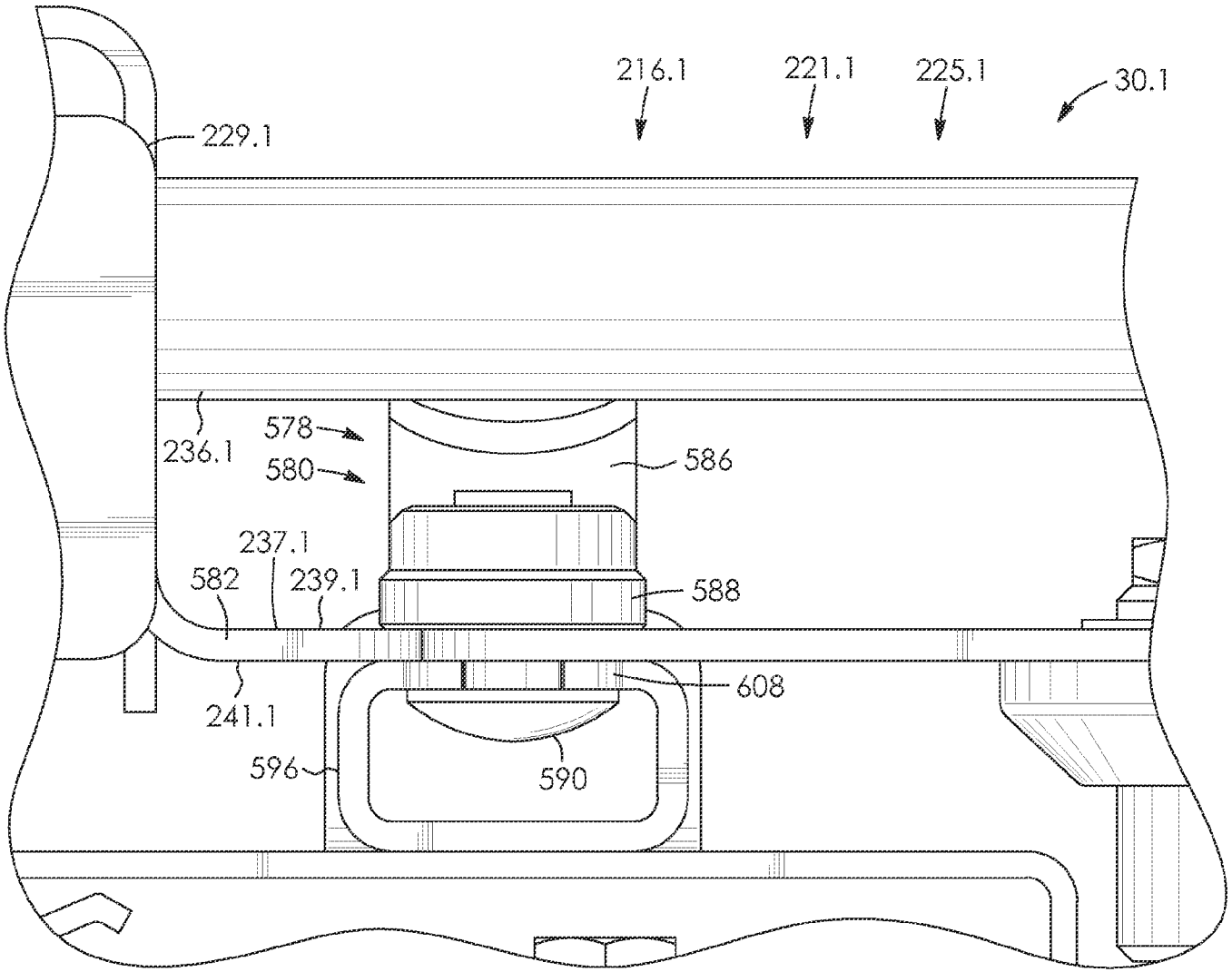
FIG. 49 is an enlarged elevation view of part of the quick-release coupling mechanism of FIG. 48, the coupling mechanism being shown in its locked mode.

Each cam lever comprises a mount 588 coupled to plate 237.1, an elongate handle 586 pivotally coupled to said mount 588 and a clamp portion, in this example in the shape of bolt heads 590, as seen in FIGS. 47 to 49, which is operatively connected to the elongate handle. Each of the handles 586 has an unlocked, vertically-extending, first position seen in FIGS. 46 and 48, in which the handles extend upwards from plate 237.1. Each of the handles is moveable from the first position to a locked, horizontally-extending, second position seen in FIGS. 42, 45, 47, 50 and 51. Moving the handles 586 from the unlocked to locked positions causes the bolt heads 590 to move upwards in a clamping manner towards mounts 584. Quick-release or cam levers per se, including their various parts and functionings, are known per se and therefore will not be described in further detail.

Figure 43:
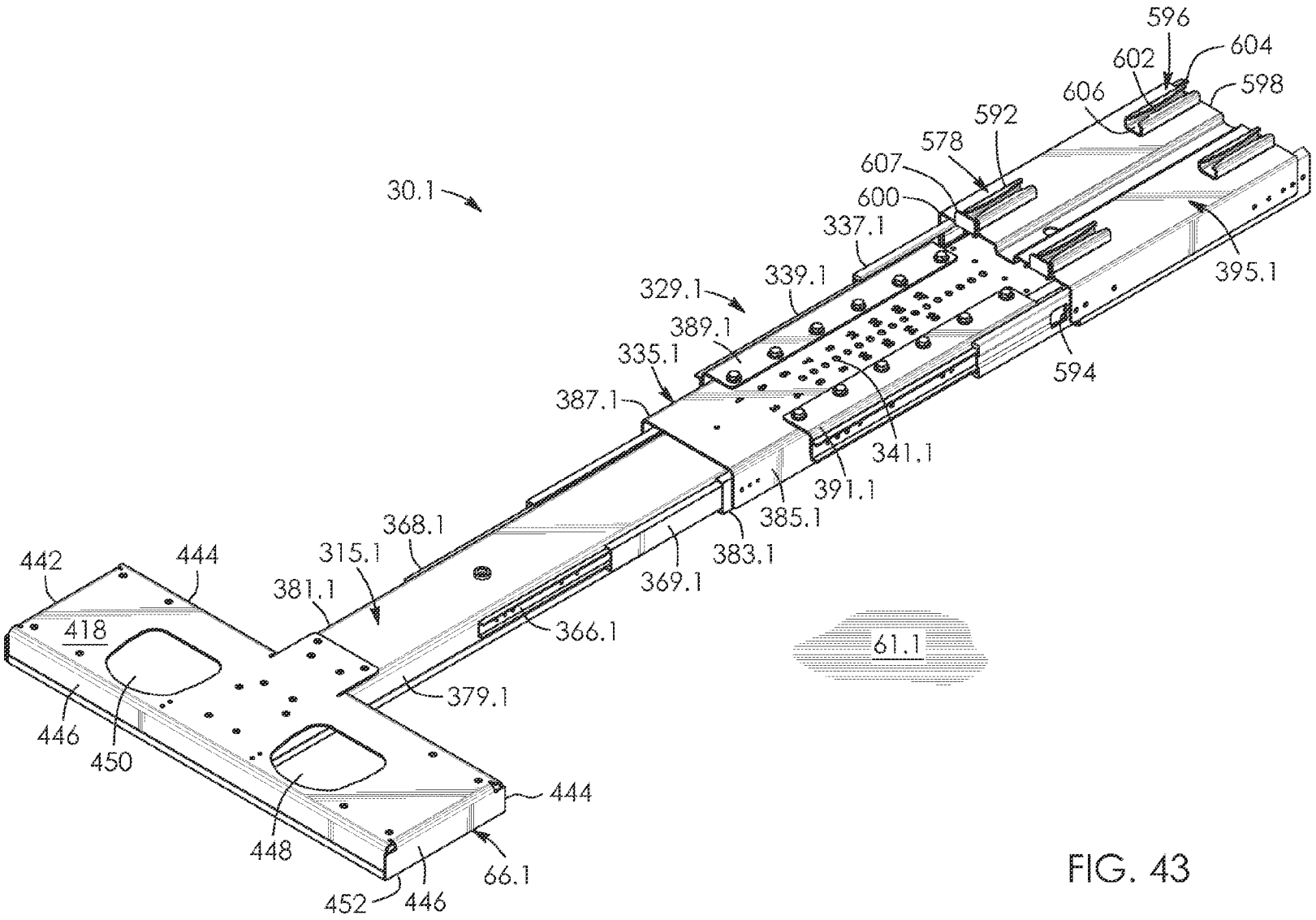
FIG. 43 is a front, top perspective view of the base of the mounting assembly, the linking member, inner and outer brackets coupled together via rail brackets, the position adjustment mechanism and part of the quick-release coupling mechanism of the exercise machine of FIG. 23, the position adjust mechanism being shown in its extended mode.

As seen in FIG. 43, the quick-release coupling mechanism 578 comprises a plurality of coupling brackets, including a first pair of coupling brackets, shown by bracket 592, adjacent to front end 594 of outer bracket 395.1, and including a second pair of coupling brackets, shown by bracket 596, adjacent to rear end 598 of the outer bracket 395.1. The coupling brackets thus operatively connect to the seat assembly 66.1 seen in FIG. 32. Referring back to FIG. 43, each of the coupling brackets is adjacent to a respective one of the corners of the outer bracket 395.1, as seen by coupling bracket 592 located adjacent to corner 600 of bracket 395.1.

Figure 44:
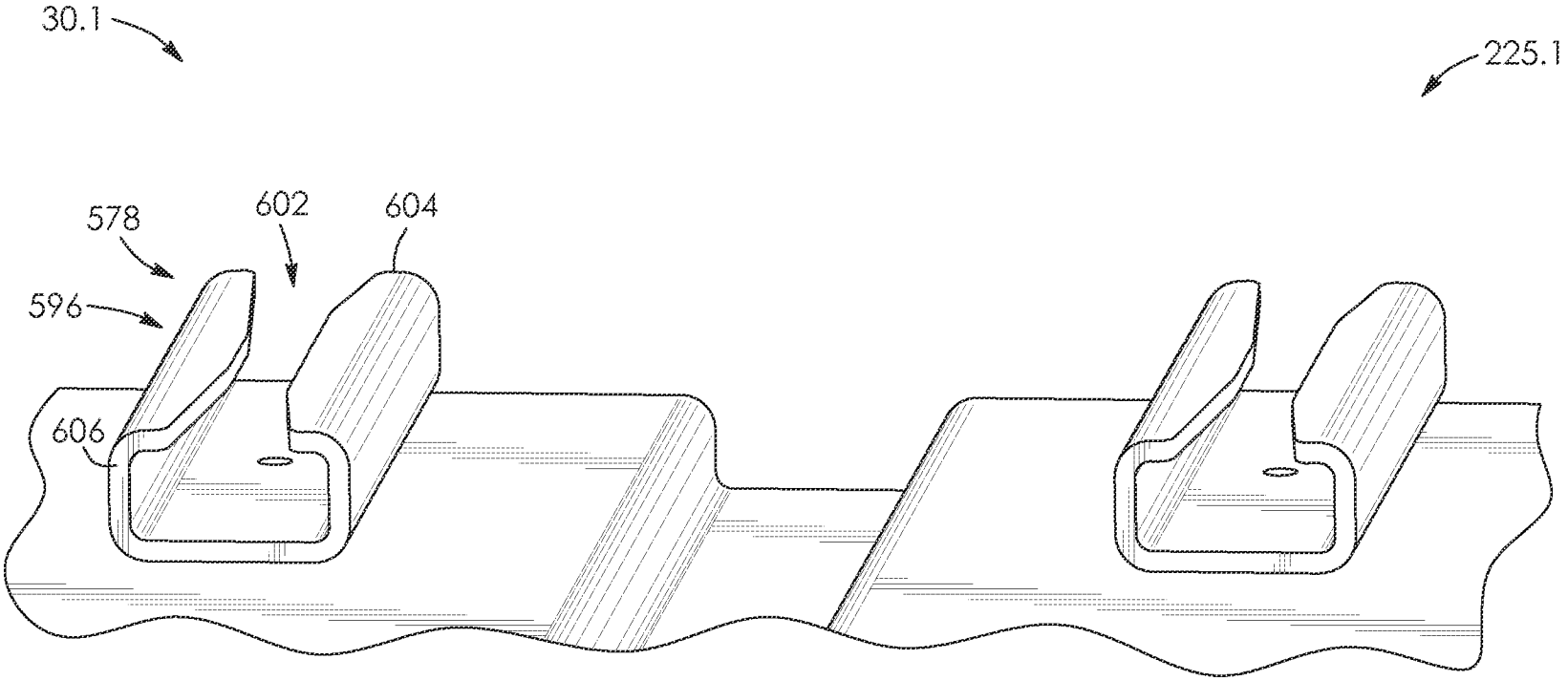
FIG. 44 is an enlarged top perspective view of the outer bracket of FIG. 43 with a pair of coupling brackets of the quick-release coupling mechanism connected thereto.
Figure 45:
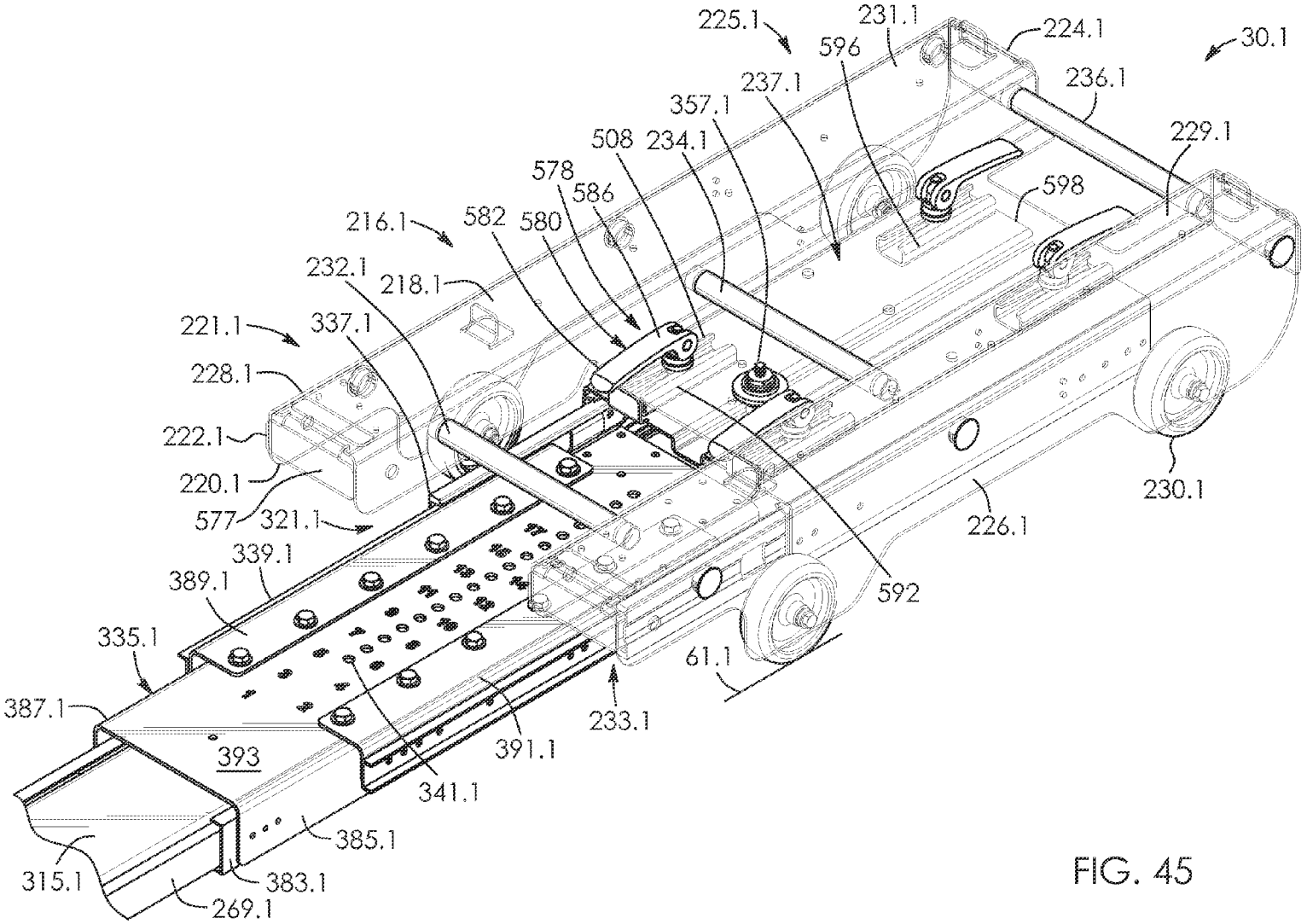
FIG. 45 is a front, top perspective view of the moveable carriage, position adjustment mechanism and quick-release coupling mechanism, with the brackets and mounting plate of the moveable carriage being shown in ghost.
Figure 53:
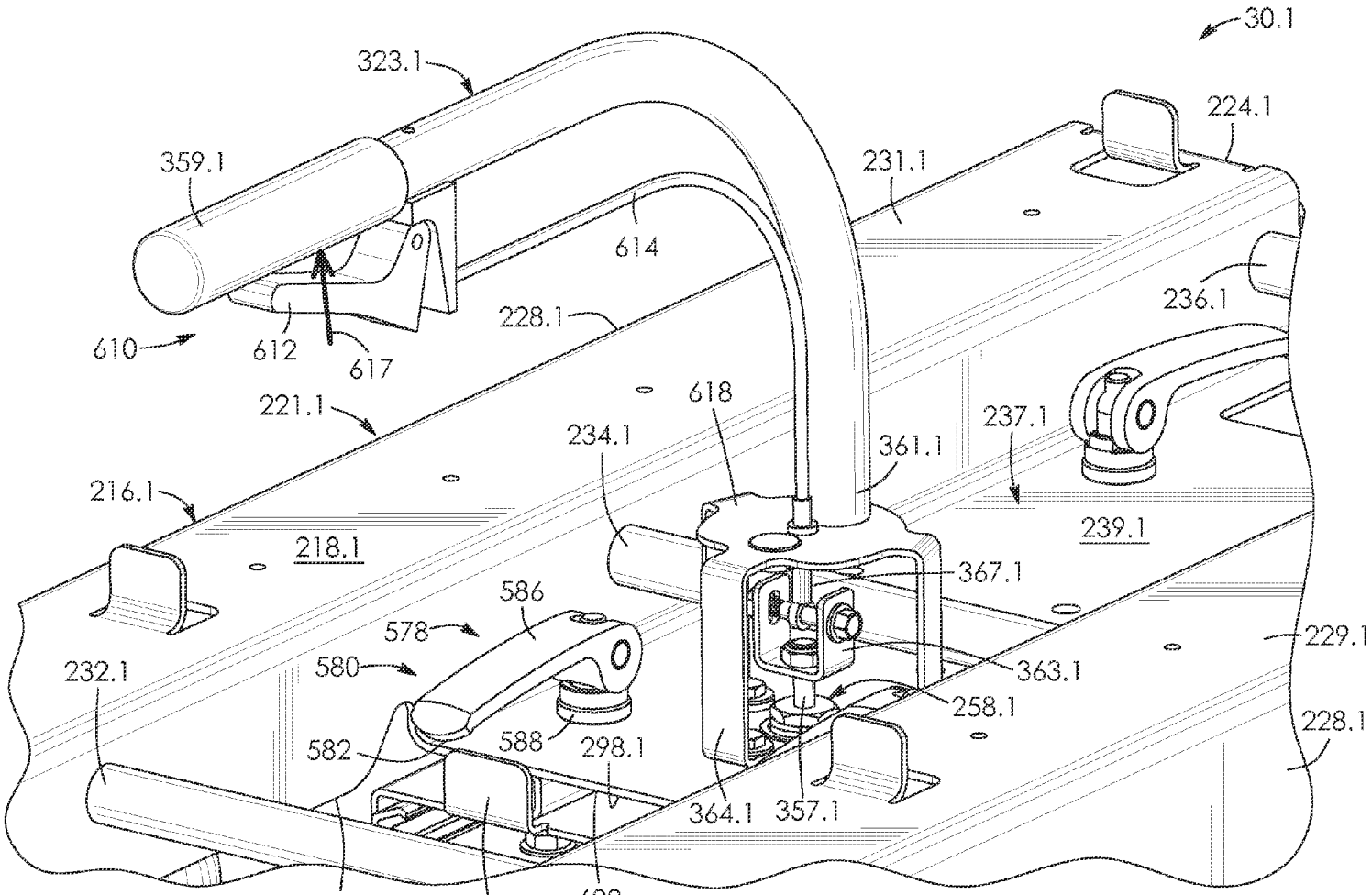
FIG. 53 is top, perspective view of part of the moveable carriage, position adjustment mechanism and quick-release coupling mechanism of FIG. 46, with the coupling mechanism shown in its locked mode, with the cover being removed and not shown to reveal part of the spring-loaded pin of the position adjustment mechanism in an upward position.

Each of the coupling brackets is u-shaped in cross-section, extends upwards from outer bracket 395.1, and has an elongate slot 602 extending therethrough from a rear end 604 to a front end 606 of the brackets 596, with the slot tapering from the front end towards the rear end of the bracket and tapering from the rear end towards the front end of the bracket as best seen in FIG. 44 for bracket 596. Front ends 607 of the brackets 592 are closed in this example, functioning as stops which abut front end 609 of mounting plate 237.1 as seen in FIG. 53 when the mounting plate fully extends overtop of outer bracket 395.1.

Slots of the coupling brackets are shaped to bolt heads 590 therethrough, with tapered aspects of the slots promoting alignment of the leg press module 225.1 with outer bracket 395.1. Referring to FIG. 48, moving the handles 586 of the cam levers towards the locked position causes the bolt heads 590 to selectively move upwards, as seen by arrow of numeral 591 so as to abut and couple to portions 608 of the coupling brackets 596 adjacent to their slots 602 as seen in FIG. 49. Closed front ends 607 of brackets 692, seen in FIG. 43, function to inhibit forward movement of the bolt heads past the slots. Handles 586 of the cam levers 580 may be moved towards their unlocked positions to remove the leg press module 225.1 from the rest of the machine 30.1 for installing a wheel chair.

Figure 51:
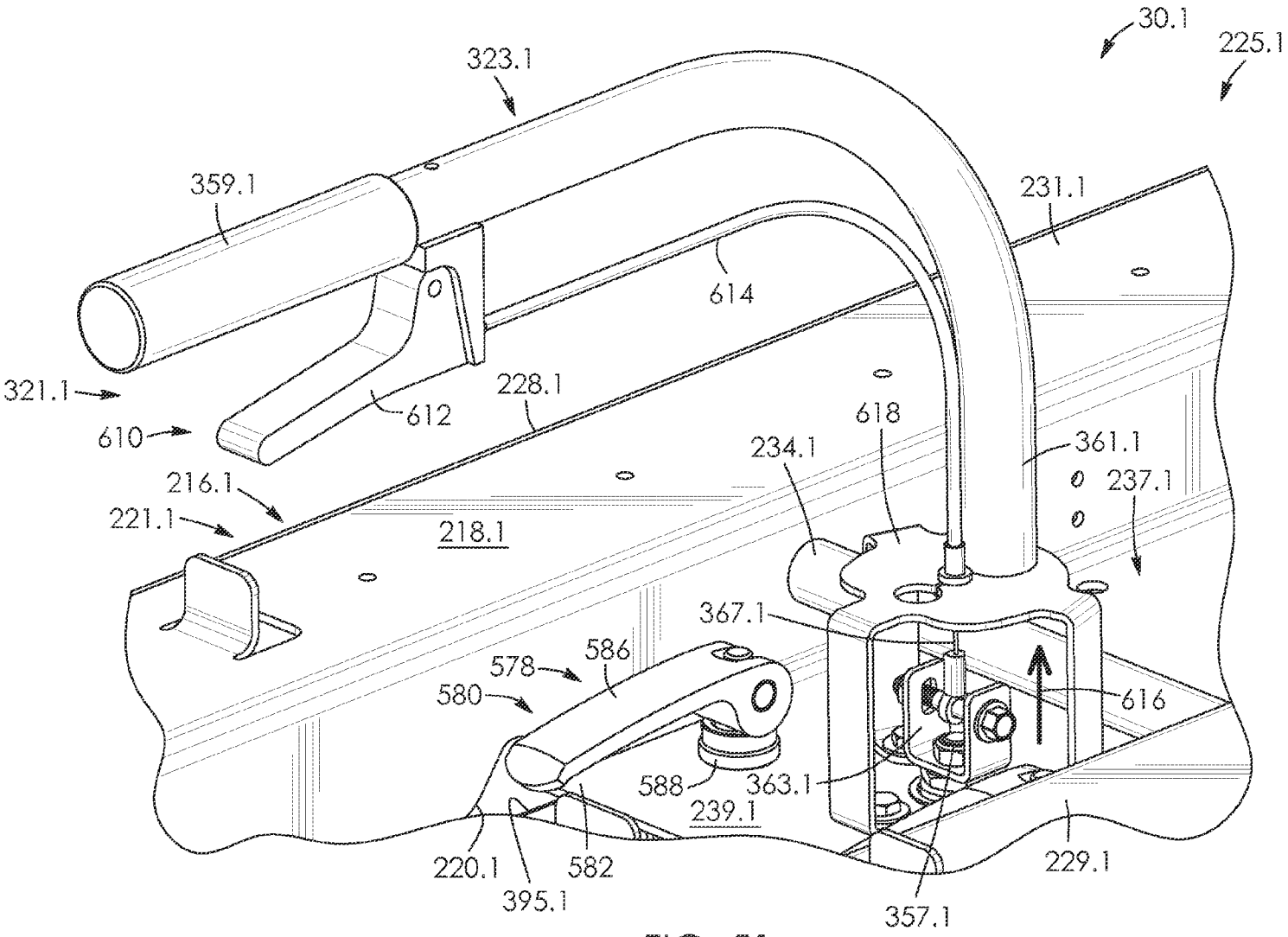
FIG. 51 is a top, perspective view of part of the moveable carriage, position adjustment mechanism and quick-release coupling mechanism of FIG. 46, with the coupling mechanism shown in its locked mode, with the cover being removed and not shown to reveal part of the spring-loaded pin of the position adjustment mechanism in a downward position.
Figure 52:
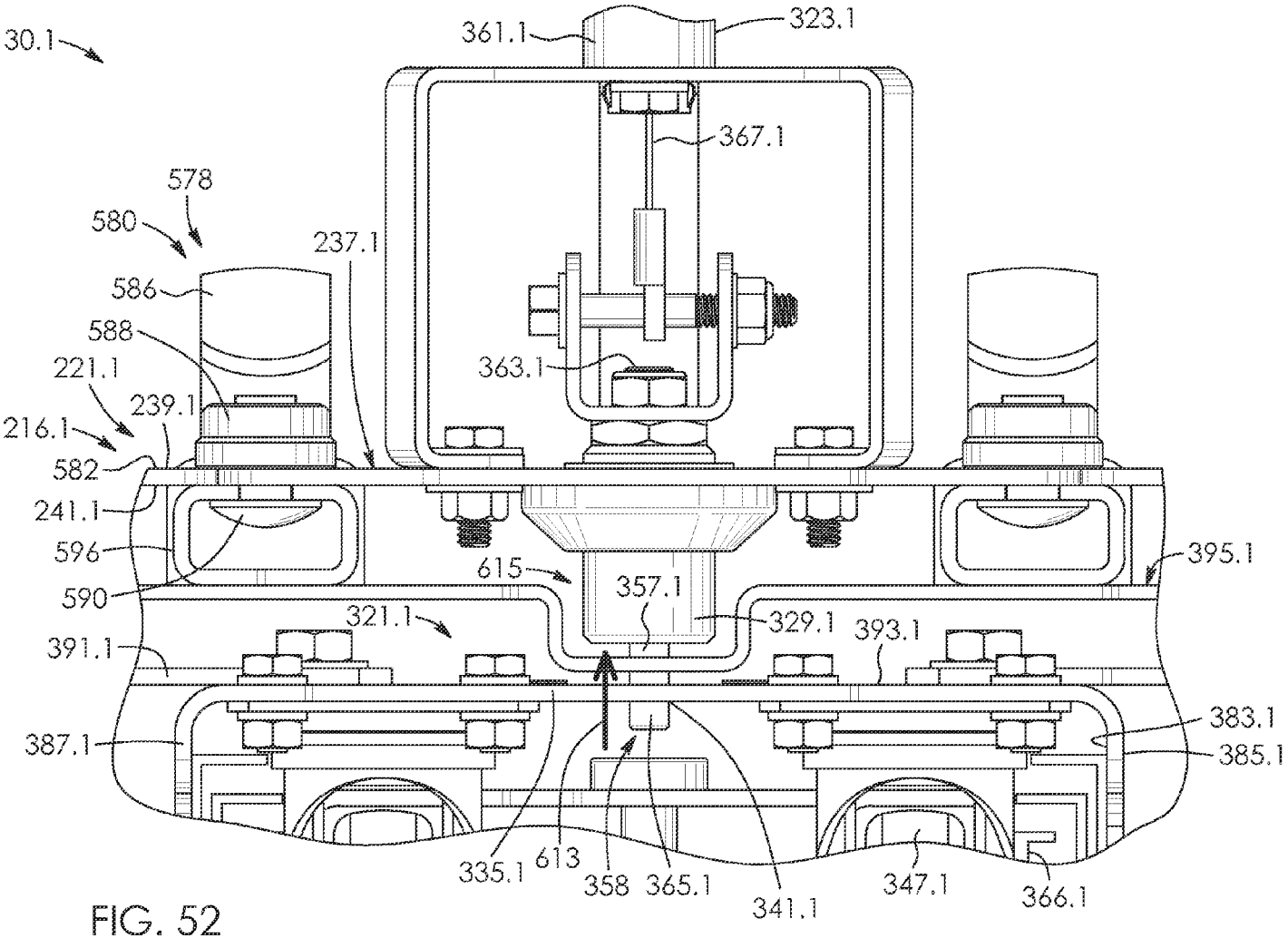
FIG. 52 is an enlarged, rear elevation view of the moveable carriage and part of the position adjustment mechanism of FIG. 46, with the pin being shown in its downward position.
Figure 54:
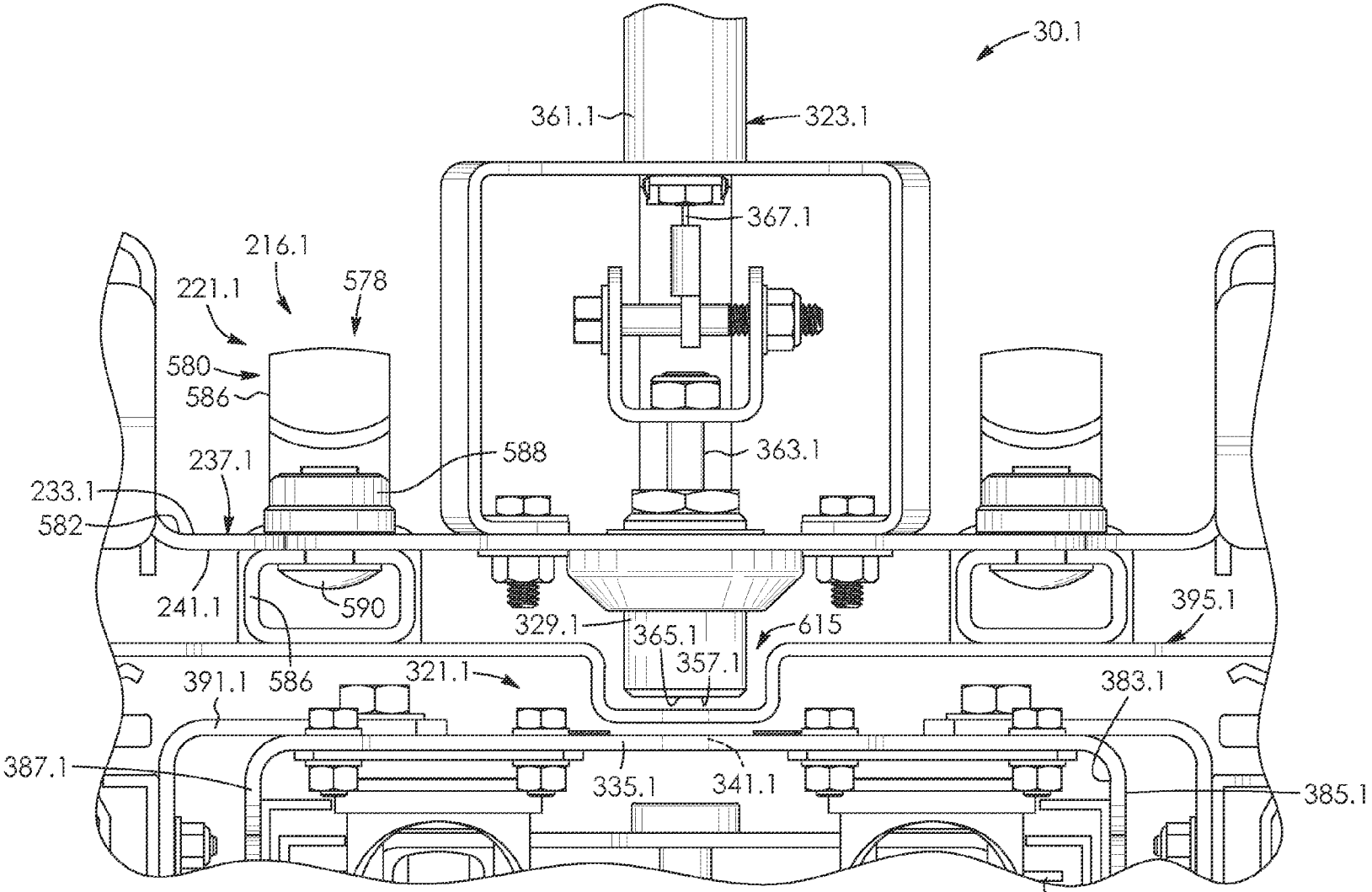
FIG. 54 is an enlarged, rear elevation view of the moveable carriage and part of the position adjustment mechanism of FIG. 46, with the pin being shown in its upward position.

As seen in FIG. 51, position adjustment mechanism 321.1 comprises a squeeze-wire mechanism 610 and comprises a squeeze lever 612 pivotally connected to gripping end 359.1 of handle 323 and a connecting member, in this example a sheathed wire 614 coupling the squeeze lever to spring-loaded pin 357.1. Selective actuation of the squeeze lever causes the pin to selectively rise upwards, as seen by arrow of numeral 616 seen in FIG. 51. The pin 357.1 is shown in its upward position in FIGS. 53 and 54. As seen in FIG. 52, outer bracket 395.1 has a centrally disposed channel 615 within which pin housing 329.1 is received and through which end 365.1 of pin 357.1 passes through and selectively into apertures 341.1 of bracket 335.1. To adjust positioning of the leg press module 225.1, squeeze lever 612 is actuated as seen by arrow of numeral 617 in FIG. 53, causing end 365.1 of pin 357.1 seen in FIG. 52 to move upwards, as seen by arrow of numeral 613 and out of aperture 341.1. Thereafter, as seen in FIG. 43, outer bracket 395.1 may be pushed forwards or rearwards relative to the seat assembly and/or seated user until a desired positioning of the leg press module 225.1 is determined, with the squeeze lever thereafter being let go to enable the pin to engage with another of the apertures 341.1 for locking in place the new positioning of the leg press module.

Figure 50:
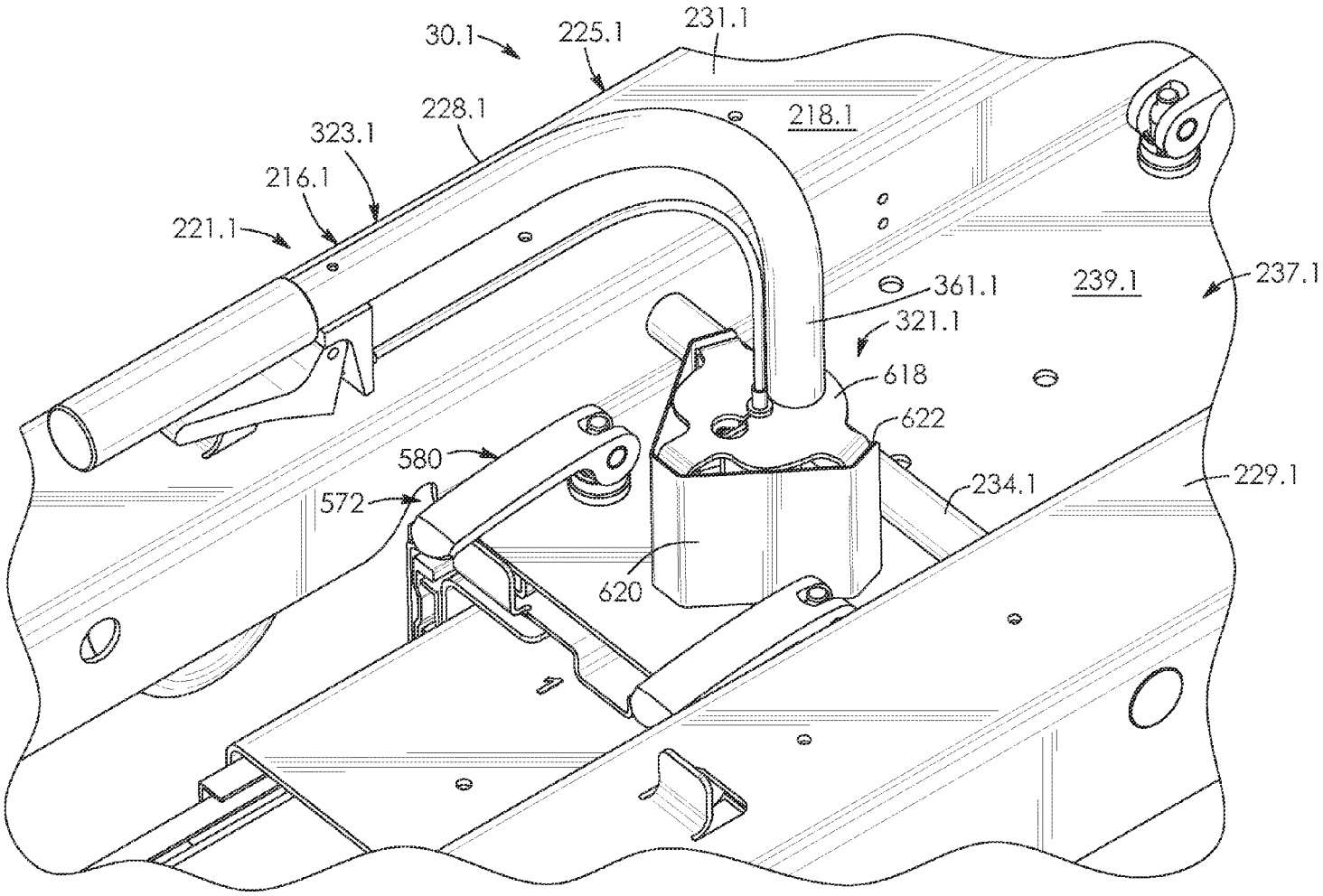
FIG. 50 is a top, perspective view of part of the moveable carriage, position adjustment mechanism and quick-release coupling mechanism of FIG. 46, with the coupling mechanism shown in its locked mode, and the spring-loaded pin of the position adjustment mechanism being enclosed within a flexible cover.

As seen in FIG. 50, second end 361.1 of handle 323.1 couples to top 239.1 of mounting plate 237.1 in this example via framing 618 within which pin 357.1 is partially enclosed around a flexible cover 620. As seen in FIG. 50, in this example selectively extends around framing 618 and couples thereto via connector mechanism, in this example, hook and loop connectors 622. The cover is made of vinyl in this example, though this is strictly not required and other materials may be used in other embodiments. In this manner, the cover may function to further enclose and protect pin 357.1 and related components of the position adjustment mechanism 321.1 adjacent thereto.

It will be understood by someone skilled in the art that many of the details provided above are by way of example only and are not intended to limit the scope of the invention which is to be determined with reference to at least the following claims.

What is claimed is:

1. An exercise machine comprising:

an upright, hollow mounting assembly having a top, a bottom opposite the top, a first side and a second side opposite the first side, wherein the sides extend from the bottom to the top of the mounting assembly;

two upper pulley assemblies rotatably mounted adjacent to the top of the mounting assembly, wherein each of the upper pulley assemblies comprises a number of adjacent pulleys, and wherein the first upper pulley assembly is adjacent to the first side of the mounting assembly and the second upper pulley assembly is adjacent to the second side of the mounting assembly;

two lower pulley assemblies rotatably mounted to the bottom of the mounting assembly, wherein each of the lower pulley assemblies comprises a number of adjacent pulleys, and wherein the first lower pulley assembly is adjacent to the first side of the mounting assembly and the second lower pulley assembly is adjacent to the second side of the mounting assembly;

four sets of a plurality of exercise resistance cables, wherein one end of each cable is connected to the mounting assembly, wherein the exercise resistance cables within each set have different stretch-resistance properties to enable a user to select a desired resistance force, wherein one of the four sets of exercise resistance cables is mounted to each of the two upper and two lower pulley assemblies and the exercise resistance cables within the set extend around and outward from the pulleys of the associated pulley assembly, and wherein the mounting assembly is configured to enclose the cables when the exercise machine is not in use.

2. The exercise machine as claimed in claim 1, wherein the mounting assembly comprises a vertically-extending, hollow housing within which the pulley assemblies are mounted and the connected ends of the exercise resistance cables are connected.

3. The exercise machine as claimed in claim 2 further comprising:

a cable mount connected to the mounting assembly to provide connection of the connected end of one of the exercise resistance cables, wherein the cable mount includes a bracket having a plurality of slots, each having an enlarged circular portion and a slotted portion extending radially outwards from the circular portion, wherein each enlarged circular portion is configured to receive a connected end of one of the exercise resistance cables.

4. The exercise machine as claimed in claim 1, further comprising a seat operatively connected to the mounting assembly.

5. The exercise machine as claimed in claim 4, wherein the set of exercise resistance cables and the pulleys of one upper pulley assembly to which they are mounted are configured to enable the user, when seated on the seat, to perform chest press exercises and to enable the user, when standing, to perform shoulder exercises, and wherein the set of exercise resistance cables and the pulleys of one lower pulley assembly to which they are mounted are configured to enable the user, when seated on the seat, to perform bicep curl exercises.

6. The exercise machine as claimed in claim 4, wherein the set of exercise resistance cables and the pulleys of one upper pulley assembly to which they are mounted are configured to enable the user, when standing, to perform shoulder press exercises, and wherein the set of exercise resistance cables and the pulleys of one lower pulley assembly to which they are mounted are configured to enable the user, when standing, to perform bicep curl exercises or leg abduction exercises.

7. The exercise machine as claimed in claim 1, wherein the exercise machine further includes an exercise step assembly operatively connected to the mounting assembly at the first side.

8. The exercise machine as claimed in claim 7, wherein the exercise step assembly is pivotally connected to the mounting assembly and is moveable from a deployed position that is spaced-apart from the mounting assembly and positioned such that the user can stand on the step assembly, to a stored position in which the user cannot stand on the step assembly.

9. The exercise machine as claimed in claim 1, further including a handle bar coupled to and extending outwards from one of the sides of the mounting assembly.

10. The exercise machine as claimed in claim 1, further comprising:

an upper mounting rod adjacent to the top of the mounting assembly and to which one of the upper pulley assemblies is mounted; and a lower mounting rod adjacent to the bottom of the mounting assembly and to which one of the lower pulley assemblies is mounted.

11. The exercise machine as claimed in claim 1, wherein each upper and lower pulley assembly includes:

a drum rotatably connected to the mounting assembly and having a plurality of spaced-apart grooves, wherein each groove is configured to receive one of the exercise resistance cables.

12. The exercise machine as claimed in claim 1, wherein the set of exercise resistance cables and the pulleys of one upper pulley assembly to which they are mounted are configured to enable the user, when standing, to perform shoulder press exercises, and wherein the set of exercise resistance cables and the pulleys of one lower pulley assembly to which they are mounted are configured to enable the user, when standing, to perform bicep curl exercises or leg abduction exercises.

13. The exercise machine as claimed in claim 1, wherein the mounting assembly, the pulley assemblies and the exercise resistance cables are configured to enable the user to perform calf raises, step-ups, hamstring exercises, adduction and abduction exercises, curls, shrugs, marching, balance stances, coordinated stepping and lower body stretching, chest presses, shoulder presses, triceps extensions, bicep curls, wrist curls, front raises, lateral raises, shrugs, external rotation exercises, proprioceptive neuromuscular facilitation upper body exercises, abdominal crunches, seated marching, and upper body stretching.

14. An exercise machine comprising:

two upright, hollow mounting assemblies, each having a top, a bottom opposite the top, a first side and a second side opposite the first side, wherein the sides extend from the bottom to the top of the mounting assembly, and wherein the hollow mounting assemblies are spaced apart from each other;

two upper pulley assemblies, one rotatably mounted adjacent to the top of each mounting assembly, wherein each of the upper pulley assemblies comprises a number of adjacent pulleys;

two lower pulley assemblies, one rotatably mounted adjacent to the bottom of each mounting assembly, wherein each of the lower pulley assemblies comprises a number of adjacent pulleys;

four sets of a plurality of exercise resistance cables, wherein the exercise resistance cables within each set have different stretch-resistance properties to enable a user to select a desired resistance force, wherein one of the four sets of exercise resistance cables is mounted to each of the two upper and two lower pulley assemblies and the exercise resistance cables within the set extend around and outward from the pulleys of the associated pulley assembly, wherein one end of each cable is connected to the mounting assembly to which its respective pulley assembly is mounted, and wherein each mounting assembly is configured to enclose the cables to which it is attached when the exercise machine is not in use.

15. The exercise machine as claimed in claim 14, wherein the housings are connected together by a horizontal crossbar.

* * * * *

UNITED STATES PATENT AND TRADEMARK OFFICE

CERTIFICATE OF CORRECTION

PATENT NO. : 9,873,012 B2
APPLICATION NO. : 14/570899
DATED : January 23, 2018
INVENTOR(S) : Roman Huppée and Robert F. Huppée It is certified that error appears in the above-identified patent and that said Letters Patent is hereby corrected as shown below:

In the Claims

Column 27, Lines 33 to 67 should read:
1. An exercise machine comprising:
an upright, hollow mounting assembly having a top, a bottom opposite the top, a first side and a second side opposite the first side, wherein the sides extend from the bottom to the top of the mounting assembly;
two upper pulley assemblies rotatably mounted adjacent to the top of the mounting assembly, wherein each of the upper pulley assemblies comprises a number of adjacent pulleys, and wherein a first said upper pulley assembly is adjacent to the first side of the mounting assembly and a second said upper pulley assembly is adjacent to the second side of the mounting assembly;
two lower pulley assemblies rotatably mounted to the bottom of the mounting assembly, wherein each of the lower pulley assemblies comprises a number of adjacent pulleys, and wherein a first said lower pulley assembly is adjacent to the first side of the mounting assembly and a second said lower pulley assembly is adjacent to the second side of the mounting assembly;
four sets of a plurality of exercise resistance cables, wherein one end of each said cable is connected to the mounting assembly, wherein the exercise resistance cables within each said set have different stretch-resistance properties to enable a user to select a desired resistance force, wherein the four sets of exercise resistance cables are mounted to respective said pulley assemblies and the exercise resistance cables within a said set extend around and outward from the pulleys of the associated pulley assembly, and wherein the mounting assembly is configured to enclose the cables when the exercise machine is not in use.

Column 28, Lines 6 to 18 should read:
3. The exercise machine as claimed in claim 2 further comprising:
a cable mount connected to the mounting assembly to provide connection of the connected end of one of the exercise resistance cables,
wherein the cable mount includes a bracket having a plurality of slots, each having an enlarged circular portion and a slotted portion extending radially outwards from the circular portion, wherein Signed and Sealed this
Twenty-ninth Day of October, 2019

Andrei Iancu

Andrei Iancu
*Director of the United States Patent and Trademark Office* each said enlarged circular portion is configured to receive a respective said connected end of one of the exercise resistance cables.

Column 28, Lines 22 to 44 should read:
5. The exercise machine as claimed in claim 4,
wherein the set of exercise resistance cables and the pulleys of one said upper pulley assembly to which they are mounted are configured to enable the user, when seated on the seat, to perform chest press exercises and to enable the user, when standing, to perform shoulder exercises, and wherein the set of exercise resistance cables and the pulleys of one said lower pulley assembly to which they are mounted are configured to enable the user, when seated on the seat, to perform bicep curl exercises.

6. The exercise machine as claimed in claim 4:
wherein the set of exercise resistance cables and the pulleys of one said upper pulley assembly to which they are mounted are configured to enable the user, when standing, to perform shoulder press exercises, and wherein the set of exercise resistance cables and the pulleys of one said lower pulley assembly to which they are mounted are configured to enable the user, when standing, to perform bicep curl exercises or leg abduction exercises.

Column 29, Lines 1 to 16 should read:
11. The exercise machine as claimed in claim 1
wherein each said upper and lower pulley assembly includes: a drum rotatably connected to the mounting assembly and having a plurality of spaced-apart grooves, wherein each said groove is configured to receive one of the exercise resistance cables.

12. The exercise machine as claimed in claim 1,
wherein the set of exercise resistance cables and the pulleys of one said upper pulley assembly to which they are mounted are configured to enable the user when standing, to perform shoulder press exercises, and wherein the set of exercise resistance cables and the pulleys of one said lower pulley assembly to which they are mounted are configured to enable the user, when standing, to perform bicep curl exercises or leg abduction exercises.

Column 29, Line 29 to Column 30, Line 31 should read:
14. An exercise machine comprising:
two upright, hollow mounting assemblies, each having a top, a bottom opposite the top, a first side and a second side opposite the first side, wherein the sides extend from the bottoms to the tops of the mounting assemblies, and wherein the hollow mounting assemblies are spaced apart from each other;
two upper pulley assemblies, one rotatably mounted adjacent to the top of each said mounting assembly, wherein each of the upper pulley assemblies comprises a number of adjacent pulleys;
two lower pulley assemblies, one rotatably mounted adjacent to the bottom of each said mounting assembly, wherein each of the lower pulley assemblies comprises a number of adjacent pulleys;
four sets of a plurality of exercise resistance cables, wherein the exercise resistance cables within each said set have different stretch-resistance properties to enable a user to select a desired resistance force
wherein the sets of exercise resistance cables are mounted to respective said pulley assemblies and the exercise resistance cables within a said set extend around and outward from the pulleys of the associated pulley assembly, wherein one end of each said cable is connected to the mounting assembly to which its respective pulley assembly is mounted, and wherein each said mounting assembly is configured to enclose the cables to which it is attached when the exercise machine is not in use.

15. The exercise machine as claimed in claim 14,
wherein the mounting assemblies are connected together by a horizontal crossbar.